US006666198B2

(12) United States Patent
Mitsutani

(10) Patent No.: US 6,666,198 B2
(45) Date of Patent: Dec. 23, 2003

(54) APPARATUS AND METHOD FOR CONTROLLING AIR-FUEL RATIO OF ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 76 days.

(21) Appl. No.: 10/120,557

(22) Filed: Apr. 12, 2002

(65) Prior Publication Data

US 2002/0170550 A1 Nov. 21, 2002

(30) Foreign Application Priority Data

Apr. 23, 2001 (JP) ..... 2001-124950

(51) Int. Cl.[7] ..... F02D 41/14

(52) U.S. Cl. ..... 123/674; 123/698; 123/520; 701/109

(58) Field of Search ..... 123/674, 698, 123/520; 701/109

(56) References Cited

U.S. PATENT DOCUMENTS 5,425,349 A * 6/1995 Nagaishi et al. ..... 123/674
5,632,261 A * 5/1997 Maki et al. ..... 123/674
5,758,631 A 6/1998 Teraoka ..... 123/674
6,253,546 B1 * 7/2001 Sun et al. ..... 701/109
6,253,750 B1 * 7/2001 Duty et al. ..... 123/698
6,321,735 B2 * 11/2001 Grieve et al. ..... 123/520

FOREIGN PATENT DOCUMENTS

JP A 9-184444 7/1997
JP A 2000-38960 2/2000

* cited by examiner

*Primary Examiner*—Erick Solis
(74) *Attorney, Agent, or Firm*—Oliff & Berridge, PLC

(57) ABSTRACT

A canister includes an adsorbent, an air layer and an air hole. An ECU obtains a physical status quantity Mgair representing the vapor stored state of the air layer, a physical status quantity Mgcan representing the fuel vapor stored state of the adsorbent, and a physical status quantity Fvptnk representing the vapor generating state in the fuel tank. The ECU then estimates a total vapor flow rate Fvpall purged to an intake system of the engine by using a physical model related to the vapor behaviors. The physical model is based on the obtained physical status quantities. The ECU corrects the fuel supply amount to the engine according to the estimated flow rate Fvpall. As a result, the air-fuel ratio feedback control is readily prevented from being influenced by the fuel vapor purging.

46 Claims, 24 Drawing Sheets

Small Amount Generated

Large Amount Generated

Fig.13

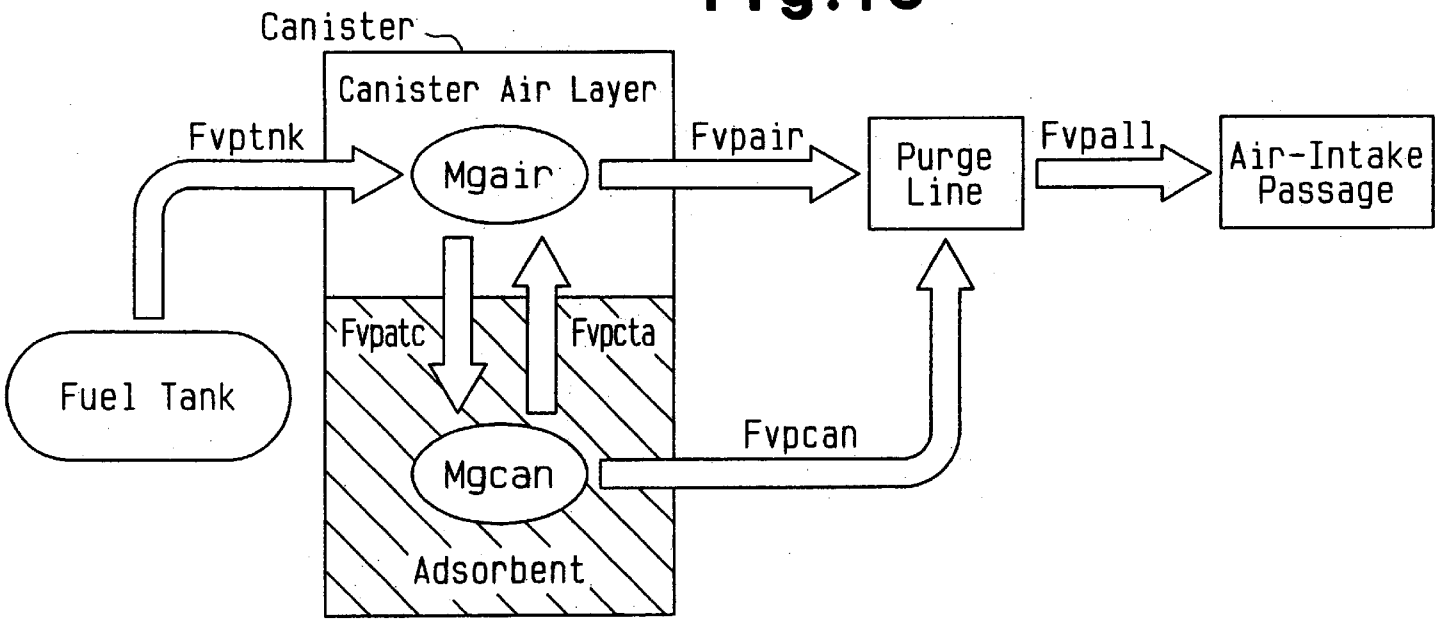

(A) Generated-In-Tank Vapor Flow Rate Fvptnk: Correct According To Deviation Rate Of B
(B) Stored-In-Air-Layer Vapor Amount Mgair: $\Delta B=A-D+E-F$
(Correct According To Deviation Amount Of F)
(C) Stored-In-Adsorbent Vapor Amount Mgcan: $\Delta C=D-E-G$
(Correct According To Deviation Amount Of G)
(D) Vapor Adsorption Speed Fvpatc: Proportional To B And [Gmax-G]
(E) Natural Desorption Speed Fvpcta: Proportional To G
(F) Air-Layer Vapor Flow Rate Fvpair: Function Of B
(G) Desorbed-From-Adsorbent Vapor Flow Rate Fvpcan: Function Of C
(H) Total Vapor Flow Rate Fvpall: F+G

APPARATUS AND METHOD FOR CONTROLLING AIR-FUEL RATIO OF ENGINE

BACKGROUND OF THE INVENTION

The present invention relates to an apparatus and a method for controlling air-fuel ratio of engine, and, more particularly, to an apparatus and a method for controlling air-fuel ratio that are suitable for use in an engine equipped with a vapor purge system which purges (discharges) vapor (fuel vapor) produced in a fuel tank into an engine intake system and processes the vapor.

In general, a vehicle equipped with a volatile liquid fuel tank employs a vapor purge system mentioned above. A typical charcoal canister type purge system temporarily collects vapor, produced in a fuel tank, in a canister. The canister incorporates an adsorbent, such as activated charcoal, and is constructed in such a way as to be able to temporarily adsorb the vapor in the adsorbent and desorb the vapor stored in the adsorbent as the canister is placed under a pressure lower than the atmospheric pressure. The vapor caught in the canister is purged, as needed, from the canister to the engine intake system through a purge line and mixed into the air fed into the engine. As the vapor is burned, together with the fuel injected from an injector, in a fuel chamber of the engine, the vapor produced in the fuel tank is processed.

There is known an air-fuel ratio control apparatus for an engine, which controls the air-fuel ratio of a flammable mixture of air and fuel supplied to a fuel chamber of the engine or the ratio of the amount of injected fuel (the amount of fuel supplied from a fuel feeding apparatus) to the amount of the intake air. Such a control apparatus performs feedback correction of the amount of injected fuel supply from an injector in such a way that the real air-fuel ratio detected by a sensor coincides with a target air-fuel ratio.

In an engine equipped with the purge system, however, a purge gas containing the aforementioned vapor is added to the original mixture to be supplied to the fuel chamber. Therefore, to adapt control that demands a strict control of the amount of supplied fuel to be burned in the fuel chamber, such as air-fuel ratio control, to an engine equipped with the purge system, it is necessary to adjust the amount of fuel supply taking the influence of the purge gas into consideration on such control.

In this respect, air-fuel ratio control taking the influence of a purge gas into consideration has conventionally been achieved as follows. For a correction value of the amount of fuel supply that is associated with the feedback of the air-fuel ratio (air-fuel ratio feedback correction value), the density (vapor density) of a fuel component in the purge gas is estimated from changes in a value detected when the flow rate of the purge gas changes. Thereafter, the flow rate of vapor to be supplied to the engine through purging is acquired from the vapor of the estimated fuel component and the flow rate of the purge gas, and the amount of fuel injected from an injector is corrected to become smaller accordingly. Every time the drive condition of the engine satisfies a predetermined condition, the vapor density is likewise obtained and the control is adapted by correcting the estimated value.

The air-fuel ratio control in such a mode sufficiently and effectively works when the vapor density is constant regardless of the purge flow rate and a change in the density of a vapor component in the purge gas is sufficiently gentle. That is, air-fuel ratio control is adapted on the premise that the purge flow rate to an engine intake passage and the flow rate of vapor contained in the passage have a linear relationship.

When a large amount of vapor is produced, such as at the time of feeding fuel, excess vapor may be adsorbed by the adsorbent temporarily, thus deteriorating the adsorbent. To cope with this problem, therefore, a purge system designed to have adsorbent-unfilled space in a canister and suppress the degradation of the adsorbent by using the layer of air (canister air layer) in that space as a buffer band has been proposed as disclosed in, for example, Japanese Unexamined Patent Publication No. Hei 9-184444.

In such a purge system, depending on the circumstance, part of vapor generated in the fuel tank may pass through the canister air layer and is directly purged into the intake passage of the engine without being caught by the adsorbent.

On the assumption that vapor flows into the engine, the air-fuel ratio control apparatus for an engine described in this publication adapts control in anticipation of the influence of the purge gas in the following two modes:

(a) a mode in which vapor is directly purged into the intake passage from the fuel tank without being adsorbed by the adsorbent, and (b) a mode in which vapor is temporarily adsorbed by the adsorbent, then desorbed therefrom and purged into the intake passage.

In the following description, purging in the former mode (a) is called "flow-from-tank purging" and purging in the latter mode (b) is called "desorption-from-adsorbent purging". The behavior of vapor during purging naturally differs between those "flow-from-tank purging" and "desorption-from-adsorbent purging". As a result, the linear relationship between the purge flow rate and the vapor flow rate, which is one of the premises for the control, does not stand always. Even with the vapor flow rate to the intake passage being the same, for example, the behavior of vapor during purging becomes quite different between a case where there is vapor flowing from the fuel tank and a case where there is not.

The air-fuel ratio control apparatus for an engine described in the above-mentioned publication separately acquires a vapor flow rate Fvptnk for the "flow-from-tank purging" to the intake passage and a vapor flow rate Fvpcan for the "desorption-from-adsorbent purging" to the intake passage. The two vapor flow rates are computed in separate calculation modes and an estimated value Fvpall of the total flow rate of vapor to be purged into the engine intake system (the total vapor flow rate) is acquired from the computed vapor flow rates.

Specifically, the vapor flow rates Fvptnk and Fvpcan are calculated from the following equations, the total (Fvptnk+Fvpcan) is estimated as the total vapor flow rate Fvpall and the amount of fuel injection from an injector is corrected based on the estimated value.

<<Reference Formulae>>

$$Fvptnk \leftarrow rvptnk/(Q \cdot Fpgall)$$

$$Fvpcan \leftarrow rvpcan \cdot Fpgall$$

$$Fvpall \leftarrow Fvptnk + Fvpcan$$

where "Q" indicates the amount of intake air, "rvptnk" indicates the vapor density in flow-from-tank purging (the ratio of vapor content in the purge gas) and "rvpcan" indicates the vapor density in desorption-from-adsorbent purging.

In other words, the air-fuel ratio control apparatus for an engine described in the publication separately computes the vapor flow rate Fvptnk in flow-from-tank purging and the vapor flow rate Fvpcan in desorption-from-adsorbent purging and computes the total vapor flow rate Fvpall as the sum of the two vapor flow rates.

Estimation of the vapor flow rate in the above-described manner can allow the vapor flow rate to be estimated in accordance with a variation in vapor density condition that is caused by whether vapor flows into the canister from the fuel tank or not. Therefore, a certain improvement on the precision of air-fuel ratio control or the like can be expected.

However, it is confirmed through tests or the like conducted by the present inventors that the vapor behavior in an actual purge system is far more complex than the one assumed at the time of setting a logic of estimating the vapor flow rate in the control apparatus. Even in case where the logic of calculating the vapor flow rate in the mode described in the publication, therefore, the calculation accuracy cannot be increased sufficiently and there is naturally a limit to the suppression of the influence of purging on the air-fuel ratio control or the like.

BRIEF SUMMARY OF THE INVENTION

Accordingly, it is an object of the present invention to provide an apparatus and a method for controlling air-fuel ratio of an engine equipped with a vapor purge system which purges and processes vapor generated in a fuel tank and that adequately restrains the influence of purging on the air-fuel ratio control or the like by estimating the purging-originated vapor flow rate to the engine more accurately.

To achieve the object, the present invention provides an air-fuel ratio control apparatus for controlling the air-fuel ratio of air-fuel mixture drawn into a combustion chamber of an engine. A canister is connected to an intake system of the engine through a purge line. The canister includes an adsorbent, an air layer located between the adsorbent and the purge line, and an air hole for introducing air into the canister. The adsorbent adsorbs fuel vapor generated in a fuel tank and permits adsorbed fuel vapor to be desorbed. Air introduced into the canister through the air hole flows to the purge line through the adsorbent. Gas containing fuel vapor is purged to the intake system from the canister through the purge line. The apparatus includes a computer, which performs feedback correction of the amount of fuel supplied to the combustion chamber such that the air-fuel ratio of the air-fuel mixture seeks a target air-fuel ratio. By using a physical model related to the fuel vapor behaviors, the computer estimates a total vapor flow rate, which represents the flow rate of fuel vapor in gas purged to the intake system, according to a total purge flow rate representing the total flow rate of the purged gas. The physical model is based on a physical status quantity representing the fuel vapor stored state of the air layer, a physical status quantity representing the fuel vapor stored state of the adsorbent, and a physical status quantity representing the vapor generating state in the fuel tank. According to the estimated total vapor flow rate, the computer corrects the fuel supply amount, which is subjected to the feedback correction.

The vapor behavior in the vapor purge system can be explained a physical model based on three physical status quantities (see FIGS. 13 and 46), or the vapor stored state of the air layer in the canister, the vapor stored state of the adsorbent in the canister, and the vapor generating state in the fuel tank. The vapor behavior in the purge system changes incessantly in accordance with the purging state and the fuel vapor generating state in the fuel tank. Since being based on the listed physical status quantities, the above physical model accurately estimates the flow rate of fuel vapor purged to the intake system through the purge line (the total vapor flow rate Fvpall) in accordance with changes of the vapor behavior. Therefore, regardless of changes in the vapor behavior in the purge system, the flow rate of fuel vapor purged to the intake system through the purge line is accurately predicted. This permits the air-fuel ratio to be accurately controlled during purging.

The present invention also provides a method for controlling the air-fuel ratio of air-fuel mixture drawn into a combustion chamber of an engine. A canister is connected to an intake system of the engine through a purge line. The canister includes an adsorbent, an air layer located between the adsorbent and the purge line, and an air hole for introducing air into the canister. The adsorbent adsorbs fuel vapor generated in a fuel tank and permits adsorbed fuel vapor to be desorbed. Air introduced into the canister through the air hole flows to the purge line through the adsorbent. Gas containing fuel vapor is purged to the intake system from the canister through the purge line. The method includes: performing feedback correction of the amount of fuel supplied to the combustion chamber such that the air-fuel ratio of the air-fuel mixture seeks a target air-fuel ratio; obtaining a physical status quantity representing the vapor stored state of the air layer; obtaining a physical status quantity representing the fuel vapor stored state of the adsorbent; obtaining a physical status quantity representing the vapor generating state in the fuel tank; estimating a total vapor flow rate, which represents the flow rate of fuel vapor in gas purged to the intake system, according to a total purge flow rate representing the total flow rate of the purged gas by using a physical model related to the fuel vapor behaviors, wherein the physical model is based on the obtained physical status quantities; and correcting the fuel supply amount, which is subjected to the feedback correction, according to the estimated total vapor flow rate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which:

FIG. 13 is a model diagram showing a vapor behavior in the entire purge system;

DETAILED DESCRIPTION OF THE PREFERRED EMBODIMENTS

Preferred embodiments of the present invention will now be described with reference to the accompanying drawings.

The present inventors studied the behavior of vapor in a vapor purge system, constructed in the following manner, in detail through tests or the like. Based on the results of the study, the inventors have proposed physical models of vapor behaviors in a purge system to be discussed later (see FIG. 13 and other associated diagrams).

According to the physical models, the following various characteristics are derived with respect to the vapor behavior in the purge system.

The vapor behavior in the purge system is expressed by the correlation among three physical status quantities which respectively indicate the vapor stored states in a canister air layer and an adsorbent of a canister and the generation state of vapor in a fuel tank.

According to the physical models, the flow rate of vapor (total vapor flow rate) to be purged into an engine intake system from a canister can be expressed as a function of the flow rate of a gas to be purged into the engine intake system (total purge flow rate) and each physical status quantity mentioned above.

According to the physical models, changes in the individual physical status quantities in the purge system can be specifically grasped from the state of purging to the engine intake system and the current values of the individual physical status quantities.

A detailed description will now be given of the details of such physical models and an air-fuel ratio control apparatus for an engine to which the physical models are adapted.

To begin with, the details of the physical models of vapor behaviors in the aforementioned purge system will be given below in Section [1]. The following is the outline of Section [1].

[1-1] Basic Structure of Purge System

Figure 1:
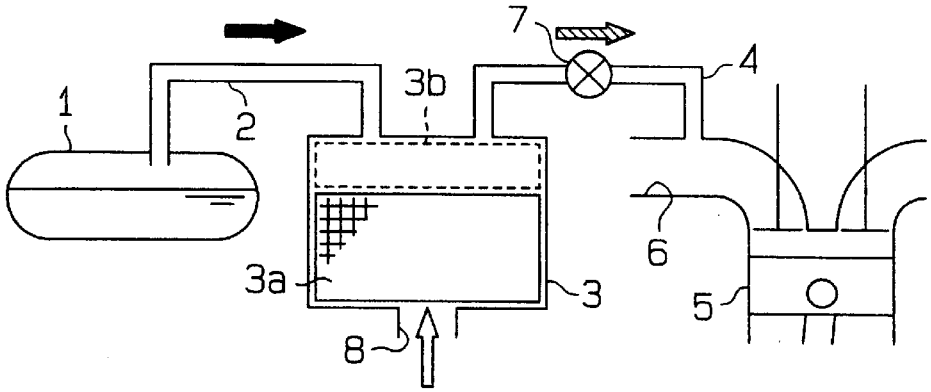
FIG. 1 is an exemplary diagram illustrating the basic structure of a vapor purge system.

This section will discuss the basic structure of a purge system to which the physical models are adapted, by referring to FIG. 1.

[1-2] Study of Vapor Behaviors in Purge System

This section will discuss the results of the study of vapor behaviors performed using the purge system that will be described in Section [1-1] and the characteristics of vapor behaviors that are derived from the results, by further referring to FIGS. 2 to 6. Section [1-2-1] will discuss the behavior of generated-in-tank vapor, Section [1-2-2] will discuss the behavior of stored-in-air-layer vapor and Section [1-2-3] will discuss the behavior of stored-in-adsorbent vapor.

[1-3] Physical Models of Vapor Behaviors in Purge System

This section will give a detailed description of the physical models proposed based on the study results in Section [1-2], by further referring to FIGS. 7 to 13. Section [1-3-1] will discuss the physical model of a vapor behavior in the canister air layer, Section [1-3-2] will discuss the physical model of a vapor behavior in the canister and Section [1-3-3] will discuss the physical model of a vapor behavior during purging. Section [1-3-4] will discuss the general image of the physical model of a vapor behavior in the entire purge system which is the generalization of those physical models.

Subsequent Section [2] will describe a specific example of an air-fuel ratio control apparatus for an engine to which the physical models are adapted. The following is the outline of Section [2].

[2-1] General Structure of Air-Fuel Ratio Control Apparatus

Figure 14:
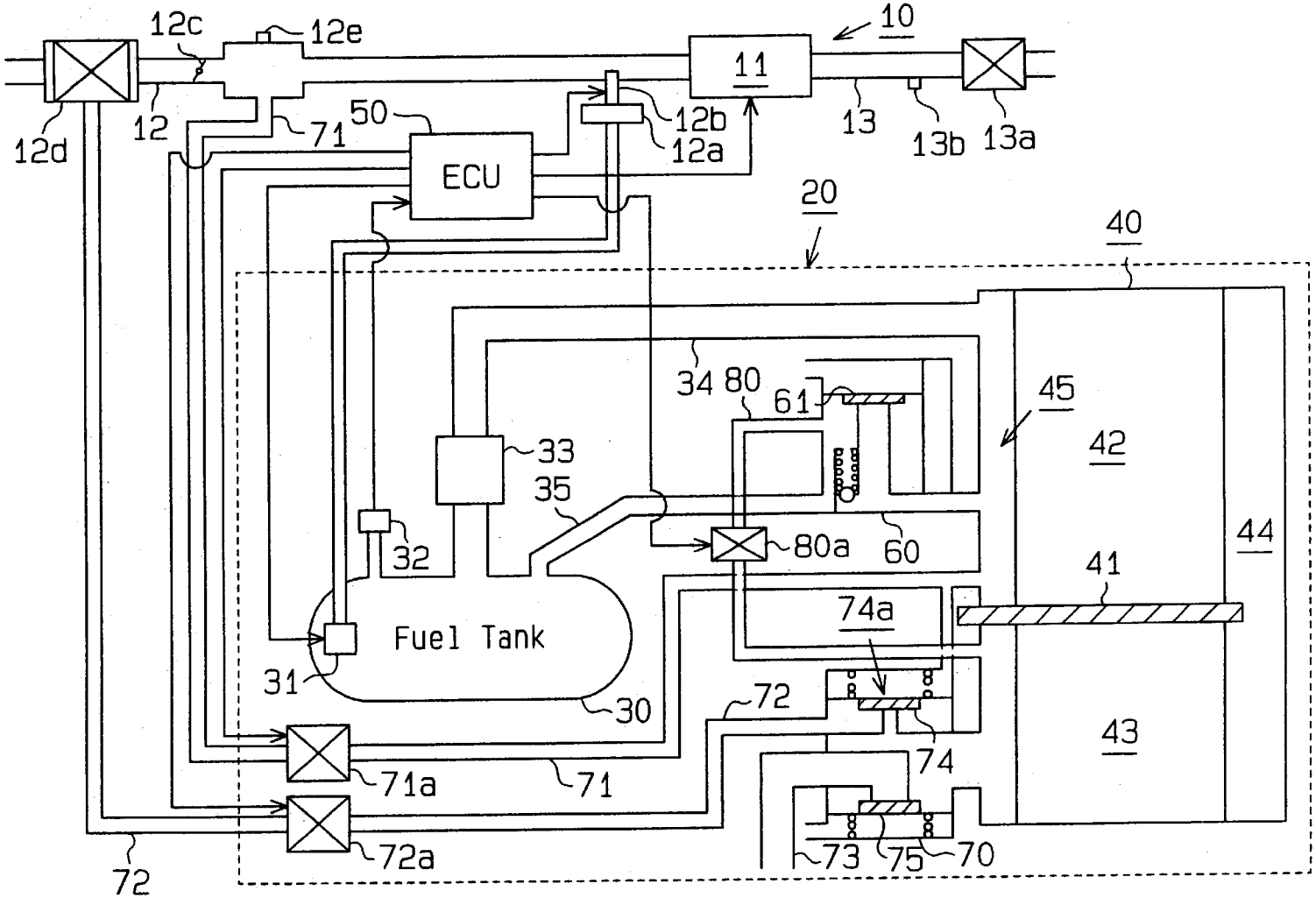
FIG. 14 is an exemplary diagram illustrating the general structure of a purge system according to one embodiment of the present invention.

This section will discuss the general structure of an air-fuel ratio control apparatus where the control based on the above physical models is adapted, by referring to FIG. 14.

[2-2] Outline of Purge Control

Figure 15:
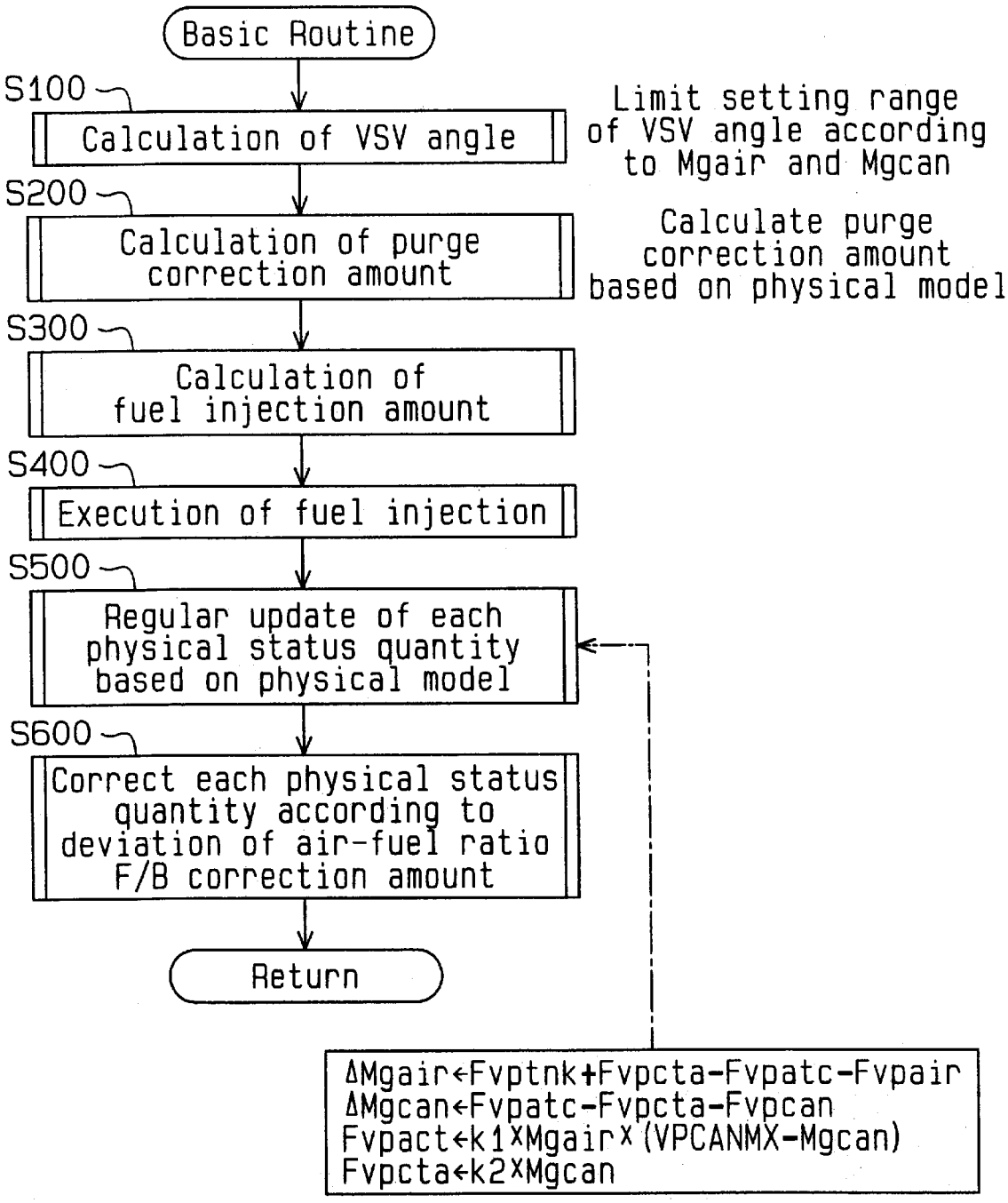
FIG. 15 is a flowchart illustrating procedures of a basic routine.

This section will schematically discuss the general image of the control that is associated with purging based on the physical models by further referring to FIG. 15.

The subsequent section will discuss the details of control whose outline will be given in Section [2-2]. Specifically, Section [2-3] will give a detailed description of a regular update process of each physical status quantity which is performed based on the physical models, by referring to FIG. 15. Section [2-4] will give a detailed description of a process associated with the calculation of a purge correction value according to air-fuel ratio control, which is performed based on the physical models, by further referring to FIGS. 16 to 22. Section [2-5] will discuss a process associated with the calculation of the amount of fuel injection in accordance with the amount of the purge correction. This section also describe the outline of air-fuel ratio feedback control by referring to FIG. 23. Section [2-6] will discuss the details of a process associated with the initialization of each physical status quantity by further referring to FIGS. 24 to 26. Section [2-7] will discuss the details of a process associated with the correction of each physical status quantity by further referring to FIGS. 27 to 34. Section [2-8] will discuss the details of a process associated with the calculation of a VSV angle by further referring to FIGS. 35 to 37.

Subsequently, Section [2-9] will discuss further improvements that can be made on the present air-fuel ratio control apparatus. The following is a brief description of the improvements. Section [2-9-1] will discuss an improvement associated with VSV control with a small angle by further referring to FIGS. 38 to 40. Section [2-9-2] will discuss an improvement associated with a process of calculating the center value of an air-fuel ratio feedback correction value by referring to FIGS. 41(*a*) and 41(*b*). Section [2-9-3] will discuss an improvement associated with a density correcting process for a purge flow rate by referring to FIG. 42. Section [2-9-4] will discuss an improvement associated with a process of reducing an update error of each physical quantity by referring to FIGS. 43 to 45. Section [2-9-5] will discuss a process associated with a measure against the direct flow-in of generated-in-tank vapor by referring to FIG. 46.

The above is the outline of the description of embodiments illustrated in this specification and the accompanying drawings. In the specification and the accompanying drawings, "vapor" indicates fuel vapor generated in a fuel tank and "purge gas" indicates the mixture of that vapor and air. Further, "vapor amount" indicates the mass of a vapor component contained in purge gas or the like and "purge flow rate" and "vapor flow rate" respectively indicate the masses of the purge gas and vapor that are moved per unit time.

[1] Physical Models of Vapor Behaviors in Purge System

[1-1] Basic Structure of Purge System

To begin with, the basic structure of a purge system to which the physical models are adapted will be described by referring to FIG. 1.

As shown in FIG. 1, this purge system comprises a canister 3 which collects vapor, an evaporation line 2 which connects the canister 3 to a fuel tank 1, and a purge line 4 which connects the canister 3 to an air-intake passage 6 that constitutes the intake system of an engine 5. A purge regulating valve (VSV) 7 is disposed in the purge line 4 so that the flow rate of a purge gas to be led into the air-intake passage 6 can be adjusted by controlling the angle of the VSV 7.

An air hole 8 for leading outside air (the atmosphere) is formed in a lower portion of the canister 3 that incorporates an adsorbent 3*a* which adsorbs and captures vapor led through the evaporation line 2. Some space is left above the adsorbent 3*a* inside the canister 3, and a layer of air (canister air layer) 3*b* which fills the space is formed. In the canister 3, the evaporation line 2 and the purge line 4 are both open to the canister air layer 3*b*.

In this purge system, vapor generated in the fuel tank 1 is fed to the canister 3 through the evaporation line 2, is temporarily mixed into the purge gas in the canister air layer 3*b*, and is then gradually adsorbed by the adsorbent 3*a*.

When the VSV 7 is opened at the time of running the engine, the differential pressure between the pressure in the air-intake passage 6 (air-intake passage internal pressure PM) and the pressure in the canister 3 causes the gas in the canister 3 to be drawn into the purge line 4 so that the drawn gas is purged to the air-intake passage 6. If the flow rate of the purge gas is sufficiently high at this time, the outside air is led through the air hole 8 and flows into the purge line 4, passing inside the adsorbent 3*a*. Such an air stream causes desorption of the vapor adsorbed by the adsorbent 3*a* so that the vapor is purged to the air-intake passage 6 through the purge line 4. The above is the outline of vapor behaviors in the purge system.

[1-2] Study of Vapor Behaviors in Purge System

The present inventors performed various tests mentioned below and studied vapor behaviors in the thus constituted purge system more specifically. The following are the results of the study.

[1-2-1] Behavior of Generated-in-Tank Vapor

This section will describe how vapor is generated in the fuel tank 1, i.e., the influence of the flow rate of vapor to be fed to the canister 3 from the fuel tank 1 (generated-in-tank vapor flow rate Fvptnk) on purging to the air-intake passage 6. The inventors conducted following tests (I) and (II) to study the influence.

(I) Test to Study the Influence of Generated-in-Tank Vapor Flow Rate Fvptnk in a Steady State First, the flow rate of vapor to be purged to the air-intake passage 6 was measured in a steady state where the generated-in-tank vapor flow rate Fvptnk was held constant and the inner pressure of the air-intake passage 6 (air-intake passage internal pressure PM) and the angle of the VSV 7 (VSV angle) are held constant, i.e., the purge flow rate to the air-intake passage 6 was held constant. In this test, the measurement was started with hardly any vapor stored in the canister 3 to eliminate the influence of vapor desorbed from the adsorbent 3*a*. Then, the measurement was carried out under a plurality of conditions where the generated-in-tank vapor flow rate Fvptnk and the VSV angle were changed.

Figure 2:
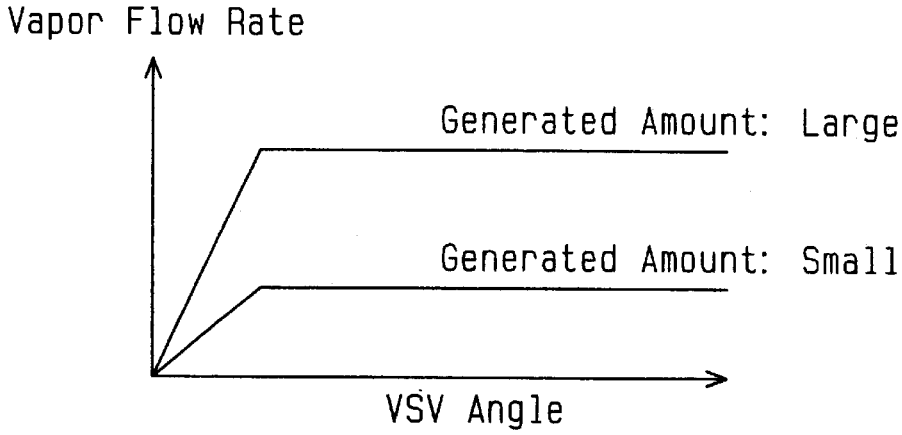
FIG. 2 is a graph showing the relationship between a vapor flow rate and a VSV angle.

The results are illustrated in FIG. 2.

(A) Given that the amount of vapor produced in the fuel tank 1 or the generated-in-tank vapor flow rate Fvptnk is constant, the vapor flow rate to the air-intake passage 6 increases in accordance with an increase in the VSV angle in an area where the VSV angle is sufficiently small, i.e., in an area where a total purge flow rate Fpgall is sufficiently low. It is to be noted however that when the total purge flow rate Fpgall exceeds a certain level, the vapor flow rate to the air-intake passage 6 is saturated to a given value.

(B) The vapor flow rate to the air-intake passage 6 that is saturated and becomes constant is determined by the generated-in-tank vapor flow rate Fvptnk. As the generated-in-tank vapor flow rate Fvptnk increases, the vapor flow rate to the air-intake passage 6 increases.

(II) Test to Study the Influence of Generated-in-Tank Vapor Flow Rate Fvptnk in a Transitional State Subsequently, with the generated-in-tank vapor flow rate Fvptnk held constant, a change in vapor flow rate after purging was started after executing purge cut (the VSV 7 fully closed) for a predetermined time was measured. In this test too, purge cut was started with hardly any vapor stored in the canister 3 to eliminate the influence of vapor desorbed from the adsorbent 3*a*. While the air-intake passage internal pressure PM after the initiation of purging and the VSV angle were set constant to keep the purge flow rate constant, a change in vapor flow rate was measured. Then, the measurement was carried out under plural conditions where the generated-in-tank vapor flow rate Fvptnk and the purge cut time were changed.

Figure 3A:
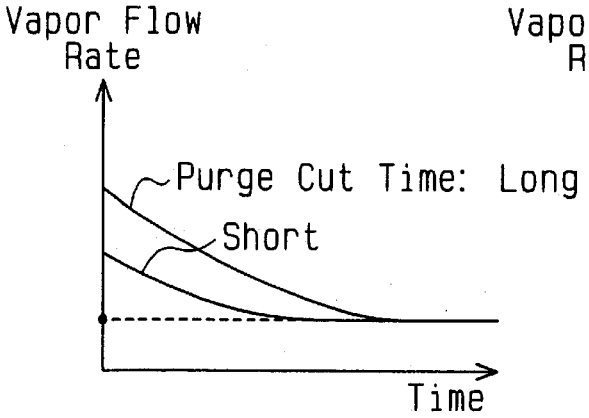
FIGS. 3(*a*) and 3(*b*) are graphs showing changes in vapor flow rate from the beginning of purging.
Figure 3B:
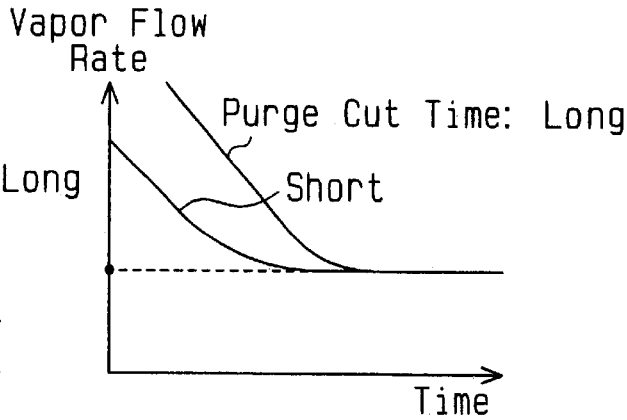

The results are illustrated in FIGS. 3(*a*) and 3(*b*).

(C) The vapor flow rate immediately after purging has started increases in accordance with the length of the purge cut time and the amount of the generated-in-tank vapor flow rate Fvptnk. It is to be noted however that the vapor flow rate does not have a simple proportional relationship with respect to the purge cut time or the amount of vapor generated in the fuel tank 1 (generated-in-tank vapor flow rate Fvptnk).

(D) After purging has started, the vapor flow rate gradually decreases with the time and is eventually saturated to a given value. If the generated-in-tank vapor flow rate Fvptnk is constant, the vapor flow rate that has been saturated and become constant takes the same value. Note that with the generated-in-tank vapor flow rate Fvptnk being constant, the vapor flow rate that has been saturated and become constant is the same as the vapor flow rate that has been saturated and become constant in the aforementioned steady state.

Although not illustrated in FIGS. 3(*a*) and 3(*b*), similar measurement was carried out under plural conditions where the VSV angle and the air-intake passage internal pressure PM were changed. From the results, it is confirmed that even if those parameters are changed, i.e., even if the total purge flow rate Fpgall (the flow rate of the purge gas to be led into the air-intake passage 6) is changed, the tendencies shown in the test results (C) and (D) do not change.

In an area where the total purge flow rate Fpgall is lower than a certain level, however, the value of the vapor flow rate at the beginning of purging and the rate at which the vapor flow rate decreases thereafter become larger in accordance with an increase in total purge flow rate Fpgall while the above tendencies do not change. It is, however, confirmed that when the total purge flow rate Fpgall becomes greater than a certain level, the value of the vapor flow rate at the beginning of purging and the rate at which the vapor flow rate decreases thereafter hardly vary.

[1-2-2] Behavior of Stored-in-Air-Layer Vapor

This section will discuss the influence of vapor flow rate mixed and stored in the canister air layer 3*b* (stored-in-adsorbent vapor) on the flow rate of vapor flowing into the air-intake passage 6. The inventors studied the influence of the stored-in-adsorbent vapor based on the results of the test of studying the influence of the generated-in-tank vapor flow rate Fvptnk in the transitional state.

The inventors studied the relationship between the total amount of the purge gas led into the canister 3 from the fuel tank 1 in the aforementioned purge cut time or the calculated value of the generated-in-tank vapor flow rate Fvptnk during the purge cut time and the vapor flow rate to the air-intake passage 6 immediately after purge cut was recovered or immediately after purge cut was stopped and purging was started. Used in the study as the vapor flow rate immediately after the initiation of purging is a measured value in an area where the total purge flow rate Fpgall is sufficiently large and the measured value does not depend on a change in Fpgall, i.e., the maximum value of the above vapor flow rate under such a condition.

Assuming that all the vapor led into the canister 3 during the purge cut period is stored in the canister air layer 3*b* at this time, there does not seem to be a particular causal relationship between a stored-in-air-layer vapor amount Mgair and the maximum value of the vapor flow rate to the air-intake passage 6. Actually, however, the vapor led into the canister 3 from the fuel tank 1 is gradually adsorbed by the adsorbent 3*a*.

Suppose that according to the physical model of a vapor behavior in the canister 3 which will be discussed later (see Section 2-5), the adsorption speed of vapor to the adsorbent 3*a* from the canister air layer 3*b* is proportional to the stored-in-air-layer vapor amount Mgair. According to the assumption, the stored-in-air-layer vapor amount Mgair at the beginning of purging becomes the total amount of adsorption of vapor from the canister air layer 3*b* adsorbed in the adsorbent 3*a* subtracted from the calculated value of the generated-in-tank vapor flow rate Fvptnk during the purge cut period. It was confirmed from the examination of the test results that the stored-in-air-layer vapor amount Mgair which is estimated based on the assumption has a very high correlation with the vapor flow rate immediately after the initiation of purging.

The following two tendencies relating to the behavior of the stored-in-adsorbent vapor were confirmed from the examination results.

(E) When there is no flow rate of vapor to be desorbed from the adsorbent 3*a* and purged (desorbed-from-adsorbent vapor flow rate Fvpcan), the maximum vapor flow rate to the air-intake passage 6 is acquired almost uniquely by the stored-in-air-layer vapor amount Mgair.

(F) The maximum vapor flow rate then, which increases in accordance with an increase in stored-in-air-layer vapor amount Mgair, is eventually saturated.

[1-2-3] Behavior of Stored-in-Adsorbent Vapor

This section will describe the behavior of the amount of vapor adsorbed and stored in the adsorbent 3*a* (stored-in-adsorbent vapor amount Mgcan). The inventors conducted following tests (I) and (II) to examine the behavior.

(I) Test to Study the Influence of Stored-in-Adsorbent Vapor During Purging

First, purging was initiated with a predetermined amount of vapor adsorbed in the adsorbent 3*a* and a change in the vapor flow rate to the air-intake passage 6 thereafter was measured. At the same time, the amount of adsorption of vapor remaining in the adsorbent 3*a* (stored-in-adsorbent vapor amount Mgcan) was measured also. Such measurement was carried out plural times while changing the initial condition of the stored-in-adsorbent vapor amount Mgcan. In this test, to eliminate the influence of the generated-in-tank vapor, the measurement was performed with the flow of the vapor from the fuel tank 1 blocked.

Figure 4:
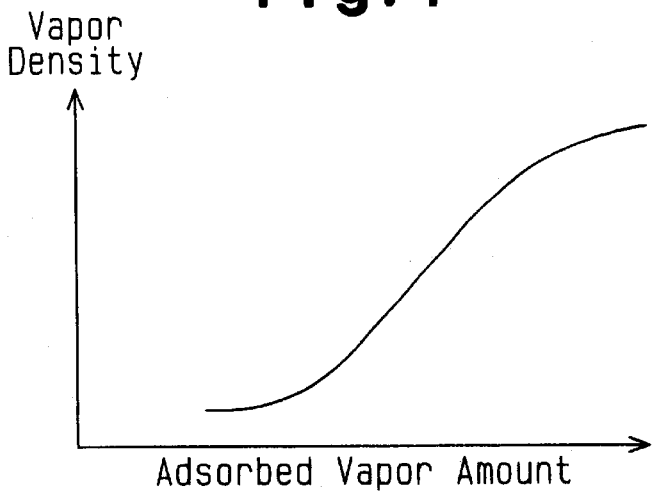
FIG. 4 is a graph showing the relationship between an adsorbed vapor flow rate and a vapor density.

The results are illustrated in FIG. 4. FIG. 4 shows the relationship between the vapor density (the density of a vapor component in the gas to be purged to the air-intake passage 6) and the adsorption amount (stored-in-adsorbent vapor amount Mgcan) acquired from the result of executing the measurement plural times while changing the initial condition of the stored-in-adsorbent vapor amount Mgcan and the purge flow rate to the air-intake passage 6. As shown in FIG. 4, the relationship is constant even if the initial condition of the stored-in-adsorbent vapor amount Mgcan and the purge flow rate to the air-intake passage 6 are changed.

With regard to the behavior of the stored-in-adsorbent vapor during purging, the following tendencies were confirmed.

Figure 5:
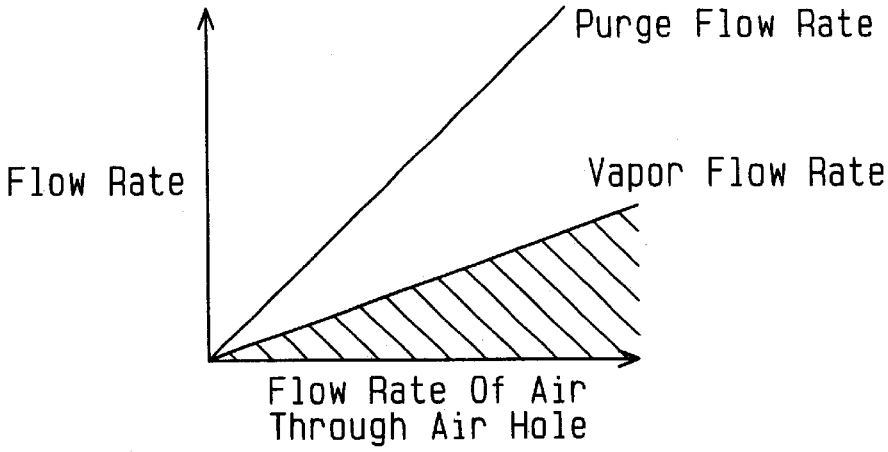
FIG. 5 is a graph showing the relationship between the flow rate of each component of a purge gas and the flow rate of air from an air hole.

(G) When there is no vapor flow to the purge line 4 from the canister air layer 3*b*, given that the stored-in-adsorbent vapor amount Mgcan is constant, the vapor density is constant regardless of the purge flow rate to the air-intake passage 6. If the stored-in-adsorbent vapor amount Mgcan is constant, therefore, the vapor that is desorbed from the adsorbent 3*a* by the force of the stream of air led through the air hole 8 and is purged during purging, i.e., the flow rate of desorbed-from-adsorbent vapor (desorbed-from-adsorbent vapor flow rate Fvpcan) is proportional to the purge flow rate to the air-intake passage 6 as shown in FIG. 5.

(H) It is apparent that as vapor stored in the adsorbent 3*a* is desorbed and purged, the stored-in-adsorbent vapor amount Mgcan gradually decreases. Therefore, the stored-in-adsorbent vapor amount Mgcan can be acquired relatively from the calculated value of the flow rate of vapor desorbed from the adsorbent 3*a* and purged.

(II) Test to Study the Influence of Stored-in-Adsorbent Vapor During Purge Cut

A part of the stored-in-adsorbent vapor seems to be gradually desorbed to the canister air layer 3*b* naturally without depending on the air stream through the air hole 8. Accordingly, the inventors executed purge cutting every predetermined time during measurement associated with the study of the influence of the stored-in-adsorbent vapor during purging and the examined the behavior of the stored-in-adsorbent vapor from a change in the vapor flow rate before and after purge cutting.

Figure 6:
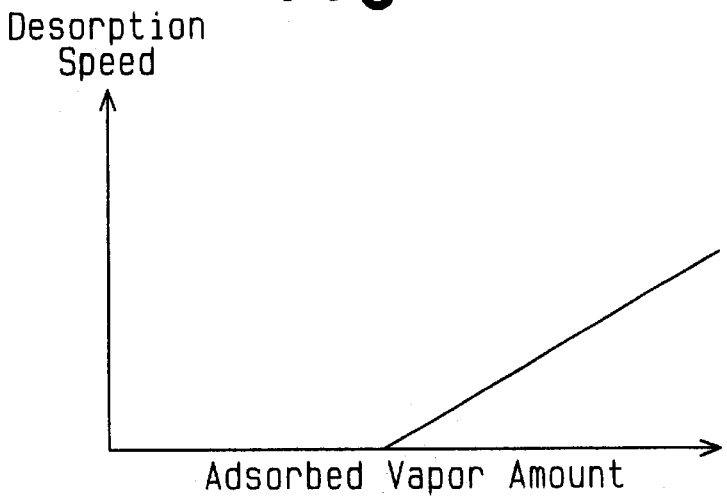
FIG. 6 is a graph showing the relationship between an adsorbed vapor flow rate and a desorption speed.

FIG. 6 shows the relationship between the desorption speed of vapor from the adsorbent 3*a* and the stored-in-adsorbent vapor amount Mgcan during purge cutting, both acquired from the results of the study. The desorption speed of vapor here is obtained from a difference between vapor flow rates before and after purge cutting and the execution time for the purge cutting.

With regard to the behavior of the vapor that is naturally desorbed from the adsorbent 3*a,* the following tendencies were confirmed from those relationships, as shown in FIG. 6.

(I) The flow rate of vapor that is naturally desorbed from the adsorbent 3*a* to the canister air layer 3*b* during purge cutting, i.e., a natural desorption speed Fvpcta, has a nearly linear relationship with the stored-in-adsorbent vapor amount Mgcan.

(J) It is to be noted, however, that the flow rate of such vapor which is desorbed naturally is significantly lower than the flow rate of vapor which is desorbed from the adsorbent 3*a* by the air stream led through the air hole 8 during the execution of purging and purged (desorbed-from-adsorbent vapor flow rate Fvpcan).

[1-3] Physical Models of Vapor Behaviors in Purge System

This section will give a detailed description of the physical models proposed by the inventors based on the results of studying vapor behaviors.

[1-3-1] Physical Model of a Vapor Behavior in Canister Air Layer

First, a description will be given of a physical model of the behavior of vapor stored in the canister air layer 3*b* at the time of executing purging, by further referring to FIGS. 7 to 10. According to the physical model, vapor stored in the canister air layer 3*b* at the time of executing purging behaves as follows.

(a) During the execution of purging, the purge gas containing a vapor component in the canister air layer 3*b* is sucked into the purge line 4 to be purged by a higher priority over the air that is led through the air hole 8 and passes inside the adsorbent 3*a*. That is, air-layer purging to the air-intake passage 6 of the engine is executed by a higher priority over desorption-from-adsorbent purging.

(b) During the execution of purging, a maximum air-layer purge flow rate Fpgairmx or the maximum value of the flow rate of the gas to be purged to the air-intake passage 6 from the canister air layer 3*b* (air-layer purge flow rate Fpgair) is derived uniquely by the amount of vapor stored in the canister air layer 3*b* or the value of the stored-in-air-layer vapor amount Mgair. Likewise, a maximum air-layer vapor flow rate Fvpairmx or the maximum value of the flow rate of vapor in the gas to be purged to the air-intake passage 6 from the canister air layer 3*b* (air-layer vapor flow rate Fvpair) is derived uniquely by the value of the stored-in-air-layer vapor amount Mgair.

The following will describe the theoretical grounds of the assumptions (a) and (b) and the details thereof.

Figure 7:
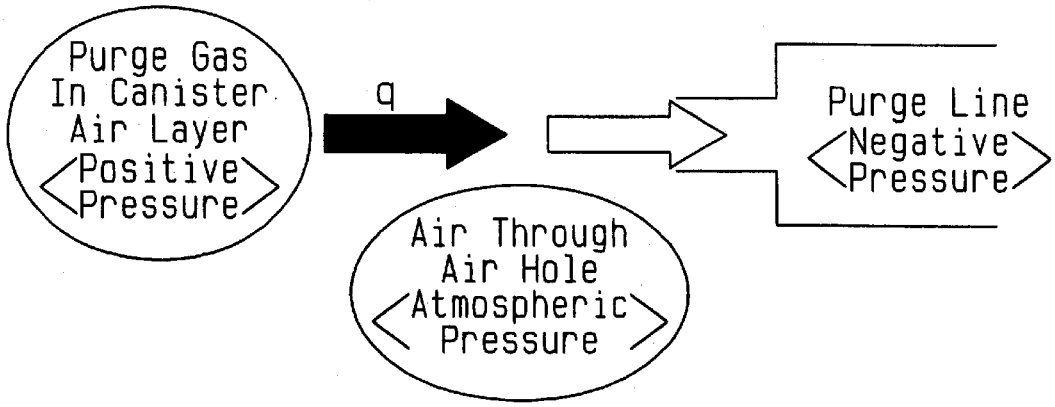
FIG. 7 is a model diagram showing the behavior of a purge gas in a purge system when purging is executed.

As explained in Sections [1-2-1] and [1-2-2], it is confirmed that when the total purge flow rate Fpgall and the generated-in-tank vapor flow rate Fvptnk exceed predetermined limits during purging with the stored-in-adsorbent vapor amount Mgcan being "0", the total vapor flow rate Fvpall becomes a constant value (see FIGS. 2, 3(*a*) and 3(*b*) and other associated diagrams). In view of the measuring results, the inventors assumed a physical model as shown in FIG. 7 for the behavior of purge gas in the canister 3 during purging.

During purging, the gas that contains a vapor component stored in the canister air layer 3*b* (purge gas) is sucked into the purge line 4 and the air (outside air) led through the air hole 8 from outside is sucked into the purge line 4 at the same time. The purge gas in the canister air layer 3*b* is, therefore, sucked into the purge line 4 while being interfered with the air led through the air hole 8. According to the physical model, therefore, the behavior of the purge gas is modeled on the assumption that "the purge gas in the canister air layer 3*b* is sucked into the purge line 4 via the air led through the air hole 8 during purging".

The purge gas in the canister air layer 3*b* has a higher pressure than the atmospheric pressure by the partial pressure of the vapor contained inside the gas. In the present specification, a pressure lower than the atmospheric pressure is called "negative pressure" and a pressure higher than the atmospheric pressure is called "positive pressure". Therefore, the pressure of the purge gas in the canister air layer 3*b* is positive. By way of contrast, the pressure of the air from the air hole 8 is the atmospheric pressure and the inner pressure of the purge line 4 during purging is negative.

According to the pressure relation, the purge gas in the canister air layer 3*b* whose pressure is positive and highest forces out the air through the air hole 8 that is the atmospheric pressure and is preferentially sucked into the purge line 4 whose pressure has become negative. Thus, the assumption in the paragraph (a) is derived. The assumed matter in the paragraph (a) is supported by evidences as apparent from the test results (see FIGS. 2, 3(*a*) and 3(*b*) and other associated diagrams).

Even if the total flow rate of the purge gas to be sucked into the purge line 4 is unlimited, the flow rate of the purge gas to be sucked into the purge line 4 from the canister air layer 3*b*, or the air-layer purge flow rate naturally has a limit. The physical model is designed on the assumption that of the flow rate of the gas to be purged to the air-intake passage 6, the deficiency that goes over the limit of the air-layer purge flow rate Fpgair or the maximum air-layer purge flow rate Fpgairmx is supplemented by the air through the air hole 8. The maximum air-layer purge flow rate Fpgairmx is determined by the limit of the flow rate of the purge gas that can force out the air through the air hole 8 and flow out of the canister air layer 3*b*. The value of the maximum air-layer purge flow rate Fpgairmx can be acquired theoretically from an assumed model as shown in FIG. 8.

Figure 8:
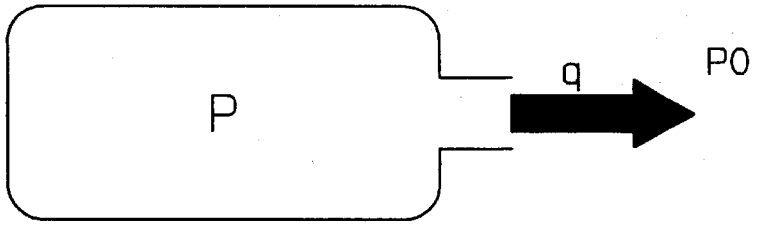
FIG. 8 is a model diagram showing the behavior of an air-layer purge gas in a purge system when purging is executed.

In the model in FIG. 8, the canister air layer 3*b* is considered as a container which has an opening and is placed in the air. The maximum air-layer purge flow rate Fpgairmx can be acquired as the flow rate of the purge gas that is injected from the container which is considered as the canister air layer 3*b*. As shown in FIG. 8, the inner pressure of the container or the inner pressure of the canister air layer 3*b* is indicated by a symbol "P", the outer pressure of the container or the atmospheric pressure is indicated by a symbol "P0", and the flow rate of the purge gas injected from the container or the maximum air-layer purge flow rate Fpgairmx is indicated by "q". Given that the density of the purge gas in the container (canister air layer 3*b*) is denoted by a symbol "ρ", the flow rate q is acquired from a following equation 1 based on the Bernoulli's theorem.

$$q = \sqrt{\frac{2}{\rho}(P - P0)} \qquad \text{Equation (1)}$$

The pressure P in the container in the model in FIG. 8 can be expressed by the sum of the a partial pressure Px of the vapor component in the purge gas in the canister air layer 3*b* and a partial pressure P0 of the air component. The amount of vapor stored in the canister air layer 3*b* (stored-in-air-layer vapor amount Mgair) is denoted by a symbol "G". Given that a symbol "V" denotes the volume of the canister air layer 3*b*, a symbol "T" denotes the absolute temperature of the purge gas in the canister air layer 3*b*, a symbol "M" denotes the mass of the purge gas, a symbol "mx" denotes the molecular weight of vapor and a symbol "R" denotes a gas constant, the flow rate q (=maximum air-layer purge flow rate Fpgairmx) is further obtained from the following equation (2).

$$q = \sqrt{\frac{2Px \cdot V}{M + G}} = \sqrt{\frac{2RT}{mx} \cdot \frac{G}{M + G}} \qquad \text{Equation (2)}$$

Assuming that the partial pressure P0 of the air component in the purge gas in the canister air layer 3*b* is always the atmospheric pressure and given that a value α is "α=1/M" and a value β is "$\beta^2$=2RT/(mx·M)", an equation (3) below is derived.

$$q = \beta\sqrt{\frac{\alpha \cdot G}{1 + \alpha \cdot G}} \qquad \text{Equation (3)}$$

Let a symbol "v" denotes the flow rate of the vapor component that belongs to the flow rate q, i.e., the air-layer vapor flow rate Fvpair. The flow rate v of the vapor component is proportional to the density of the vapor component in the purge gas and the flow rate q. Let a value $\gamma^2$=2RT/(mx·$M^3$), an equation (4) below is obtained.

$$v = \frac{G}{M + G}q = \sqrt{\frac{2RT}{mx} \cdot \left(\frac{G}{M + G}\right)^3} = \gamma\sqrt{\left(\frac{\alpha \cdot G}{1 + \alpha \cdot G}\right)^3} \qquad \text{Equation (4)}$$

Assuming that a change in the temperature of the canister air layer 3*b* when the purge system is used is sufficiently small and the absolute temperature T is constant, any of the values α, β and γ can be considered as a constant unique to the purge system. The proper values of the values α, β and γ can be acquired through tests or the like.

In the conditions of the normal use of an ordinary purge system, a change in absolute temperature T is not large enough to influence the precision of computing the flow rates q and v and the assumption is sufficiently satisfied. A measure in case where the influence of a change in absolute temperature T is not negligible will be discussed later (see Section [2-4], FIG. 20 and other associated diagrams).

Therefore, the flow rate q and the flow rate v or the maximum air-layer purge flow rate Fpgairmx and the maximum air-layer vapor flow rate Fvpairmx are expressed as a function of the amount G of vapor stored in the canister air layer 3*b*, i.e., the stored-in-air-layer vapor amount Mgair. Accordingly, the assumption of the paragraph (b) is derived.

Figure 9:
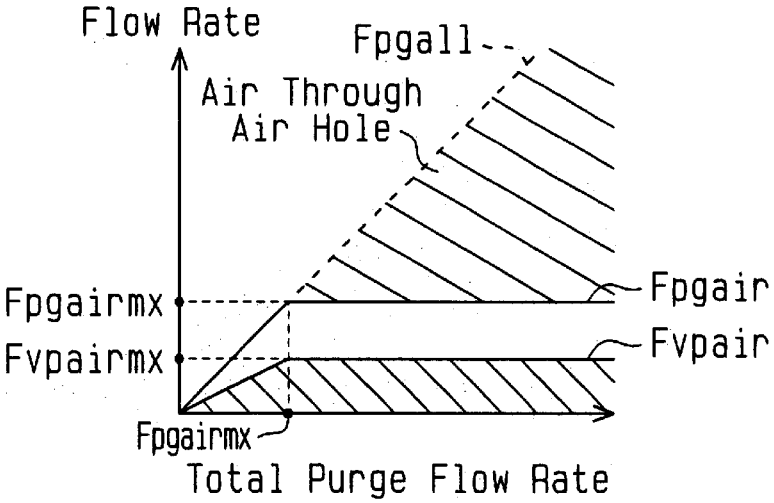
FIG. 9 is a graph showing the relationship between the flow rate of each component of a purge gas and a total purge flow rate.

According to the physical model assumed above, as apparent from the above, if the stored-in-air-layer vapor amount Mgair is constant, the relationship between each component of the purge gas to be discharged to the air-intake passage 6 during purging and the total purge flow rate Fpgall becomes as illustrated in FIG. 9.

Until the total purge flow rate Fpgall reaches the maximum air-layer purge flow rate Fpgairmx that is determined according to the stored-in-air-layer vapor amount Mgair (Fpgall<Fpgairmx), all the purge gas to the air-intake passage 6 is occupied by the purge gas from the canister air layer 3*b*. As shown in FIG. 9, therefore, the air-layer purge flow rate Fpgair at that time becomes the same as the total purge flow rate Fpgall (Fpgair=Fpgall). When the total purge flow rate Fpgall exceeds the maximum air-layer purge flow rate Fpgairmx (Fpgall>Fpgairmx), the air-layer purge flow rate Fpgair is saturated to the maximum air-layer purge flow rate Fpgairmx (Fpgair=Fpgairmx). The deficiency of the flow rate of the purge gas (Fpgall−Fpgairmx) at that time is supplemented by the flow rate of the air led through the air hole 8.

The air-layer vapor flow rate Fvpair is acquired from the vapor density of the purge gas of the canister air layer 3*b* and the air-layer purge flow rate Fpgair and the density is determined by the stored-in-air-layer vapor amount Mgair. With the stored-in-air-layer vapor amount Mgair being constant, therefore, the air-layer vapor flow rate Fvpair takes a value proportional to the air-layer purge flow rate Fpgair as shown in FIG. 9. If the air-layer purge flow rate Fpgair is saturated to its maximum flow rate Fpgairmx, the air-layer vapor flow rate Fvpair is naturally saturated to its maximum flow rate Fvpairmx. Note that the vapor density rvpair of the air-layer purge or the ratio of the air-layer vapor flow rate Fvpair to the air-layer purge flow rate Fpgair is acquired as the ratio of the maximum air-layer purge flow rate Fpgairmx to the maximum air-layer vapor flow rate Fvpairmx (Fvpairmx/Fpgairmx), both computed based on the equations (3) and (4).

Figure 10:
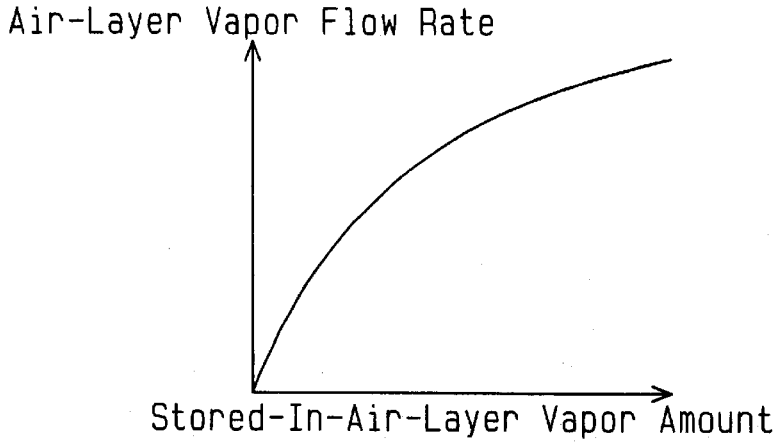
FIG. 10 is a graph showing the relationship between a stored-in-air-layer vapor amount and an air-layer vapor flow rate.

According to the physical model, the correlation between the stored-in-air-layer vapor amount Mgair and the air-layer vapor flow rate Fvpair when the total purge flow rate Fpgall is set constant is as illustrated in FIG. 10.

With the total purge flow rate Fpgall being set constant, as shown in FIG. 10, the air-layer vapor flow rate Fvpair increases according to the equation (3) as the stored-in-air-layer vapor amount Mgair increases. It is to be noted however that the rate of an increase in air-layer vapor flow rate Fvpair has a tendency to gradually decreases in accordance with an increase in stored-in-air-layer vapor amount Mgair.

It should be noted that the theoretical values of the air-layer purge flow rate Fpgair and the air-layer vapor flow rate Fvpair that were acquired based on the above-described physical model almost coincide with the results of the test conducted with a real apparatus by the inventors and the assumption described in the paragraph (b) are proved.

[1-3-2] Physical Model of Vapor Behavior in Canister in Steady Mode

Figure 11:
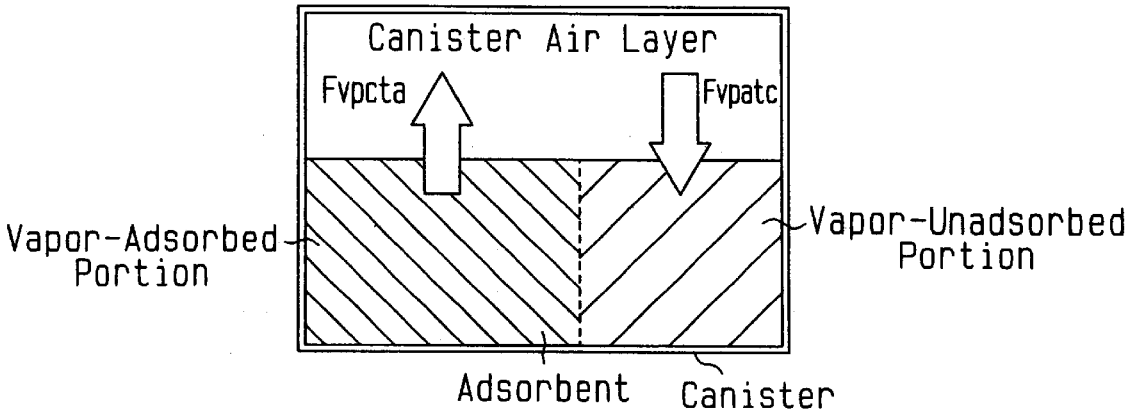
FIG. 11 is a model diagram showing a vapor behavior in a canister in a steady mode.

The following will discuss a physical model of the behavior of vapor in the canister 3 in a steady mode, by further referring to FIG. 11. The physical model is designed to explain the behavior of vapor in the canister 3 in a steady mode, i.e., when there is no vapor flow from the fuel tank 1 or the flow of the purge gas to the air-intake passage 6 originated by the execution of purging. According to the model, vapor which is exchanged between the canister air layer 3*b* and the adsorbent 3*a* in a steady mode behaves as follows.

(c) The flow rate of that vapor in the purge gas stored in the canister air layer 3*b* which is to be adsorbed to the adsorbent 3*a* in a steady mode, i.e., a vapor adsorption speed Fvpatc, increases in accordance with the stored-in-air-layer vapor amount Mgair.

(d) As the area of the adsorbent 3*a* where vapor is not adsorbed increases, the vapor adsorption speed Fvpatc becomes greater.

(e) The flow rate of vapor which is naturally desorbed from the adsorbent 3*a* and is discharged into the purge gas in the canister air layer 3*b* in a steady mode, i.e., a natural desorption speed Fvpcta, increases in accordance with the stored-adsorbent vapor amount Mgcan.

The following will describe the theoretical grounds of the assumptions (c) to (e) and the details thereof.

The adsorbent 3*a* is so constructed as to adsorb vapor as the vapor is adhered to the surfaces of multiple particles with specific volumes and large surface areas, such as activated charcoal. While the surface of the entire adsorbent 3*a* that can adsorb vapor is vast, the adsorption ability is limited. A model as shown in FIG. 11 is proposed on the assumption that with a certain amount of vapor adhered, the entire surface of the adsorbent 3*a* has a portion where vapor has already been adhered (vapor-adsorbed portion) and a portion where vapor has not been adhered yet (vapor-unadsorbed portion).

According to the model, it is assumed that in a steady mode, vapor is gradually drifted to the purge gas in the canister air layer 3*b* from the vapor-adsorbed portion of the adsorbent 3*a* and vapor is gradually drifted to the vapor-unadsorbed portion of the adsorbent 3*a* from the purge gas.

It is easily predictable that if the partial pressure of vapor in the purge gas in the canister air layer 3*b* is high, the amount of vapor that is moved to the vapor-unadsorbed portion of the adsorbent 3*a* in a steady mode increases. The partial pressure of vapor rises almost in proportional to an increase in stored-in-adsorbent vapor amount Mgcan. It can therefore be estimated that the vapor adsorption speed Fvpatc also increases in accordance with an increase in stored-in-air-layer vapor amount Mgair as mentioned in the assumption (c). According to the present embodiment, the vapor adsorption speed Fvpatc is so treated as to be simply proportional to the stored-in-air-layer vapor amount Mgair ($Fvpatc \propto Mgair$).

Strictly speaking, it has not been proved that the vapor adsorption speed Fvpatc and the stored-in-air-layer vapor amount Mgair have a simple proportional relationship. Normally, however, the vapor adsorption speed Fvpatc becomes very small as compared with the generated-in-tank vapor flow rate Fvptnk or the vapor flow rate Fvpair or Fvpcan to the air-intake passage 6 from the canister air layer 3*b* or the adsorbent 3*a* during purging. It is therefore practically sufficient to compute the vapor adsorption speed Fvpatc in accordance with the assumed proportional relationship. Of course, it is possible to estimate the vapor adsorption speed Fvpatc more strictly by conducting further examination tests to acquire the detailed correlation between the vapor adsorption speed Fvpatc and the stored-in-air-layer vapor amount Mgair and using the correlation in the computation of the vapor adsorption speed Fvpatc.

As the surface area of the vapor-unadsorbed portion of the adsorbent 3*a* decreases, the vapor adsorption capability temporarily drops. It is therefore easily predictable that the greater the vapor-unadsorbed portion of the adsorbent 3*a* is, the higher the vapor adsorption speed Fvpatc becomes, as mentioned in the assumption (d). It is also possible to acquire, through tests or the like, a maximum adsorption amount VPCANMX of vapor in the adsorbent 3*a*, i.e., the stored-in-adsorbent vapor amount Mgcan at the time of saturation where the entire adsorption surface of the adsorbent 3*a* is filled with vapor and no more vapor adsorption is permissible. The area of the vapor-unadsorbed portion is proportional to a value which is the current stored-in-adsorbent vapor amount Mgcan subtracted from the maximum adsorption amount VPCANMX. According to the present embodiment, the vapor adsorption speed Fvpatc is so treated as to be simply proportional to the stored-in-air-layer vapor amount Mgair. That is, the vapor adsorption speed Fvpatc is considered as proportional to a value which is the current stored-in-adsorbent vapor amount Mgcan subtracted from the maximum adsorption amount VPCANMX (Fvpatc∝|VPCANMX−Mgcan|). Although the proportional relationship has not been proved, it is practically sufficient as in the case of the assumption (c). Of course, it is possible to estimate the vapor adsorption speed Fvpatc more strictly by conducting further examination tests to acquire the correlation between the vapor adsorption speed Fvpatc and the stored-in-air-layer vapor amount Mgair in detail and using the correlation in the computation of the vapor adsorption speed Fvpatc.

It is confirmed that natural desorption of vapor from adsorbent 3*a* in a steady mode occurs at a given probability with respect to adsorbed vapor. As mentioned in the assumption (e), the natural desorption speed Fvpcta increases as the amount of vapor adsorbed in the adsorbent 3*a* or the stored-in-adsorbent vapor amount Mgcan increases. Because the probability of the natural desorption of vapor is constant, the natural desorption speed Fvpcta is proportional to the stored-in-adsorbent vapor amount Mgcan (Fvpcta cc Mgcan).

As apparent from the foregoing description, it is possible to predict the vapor behavior in the canister 3 in a steady mode based on the physical model. Even in a non-steady mode, the vapor behavior in a steady mode is considered to hold true only with additional factors of vapor flow-in from the fuel tank 1 and purging-originated vapor flow-out to the air-intake passage 6.

Every time the adsorbent 3*a* repeats vapor adsorption and desorption, the adsorbent 3*a* is gradually degraded to lower the vapor adsorption capability. The degradation can be explained as a reduction in maximum adsorption amount VPCANMX. Therefore, such degradation may cause a slight error in the estimated value of the vapor adsorption speed Fvpatc. Even in such a case, if the value of the maximum adsorption amount VPCANMX is adequately updated in accordance with the degree of the degradation of the adsorbent 3*a,* the vapor adsorption speed Fvpatc can be estimated accurately regardless of such degradation. The actual apparatus has only a slight degradation-originated reduction in maximum adsorption amount VPCANMX, which has little influence on various kinds of engine control. Even without any measure taken against the degradation, therefore, a practical problem hardly would arise.

[1-3-3] Physical Model of Vapor Behavior During Purging

This section will discuss a physical model of a vapor behavior during purging. Because the behavior of vapor to be purged from the purge gas in the canister air layer 3*b* to the air-intake passage 6 is as explained in Section [1-3-1], this section will consider the behavior of vapor to be desorbed from the adsorbent 3*a* and purged during purging.

During purging, vapor adsorbed by the adsorbent 3*a* is desorbed therefrom by the stream of the air led through the air hole 8 and purged to the air-intake passage 6. Therefore, the flow rate of vapor to be desorbed from the adsorbent 3*a* and purged during purging or the desorbed-from-adsorbent vapor flow rate Fvpcan is nearly proportional to the flow rate of the air that passes inside the adsorbent 3*a* or an inside-adsorbent air flow rate Fpgcan (Fvpcan∝Fpgcan).

Further, it is easily predictable that the larger the amount of vapor to be adsorbed by the adsorbent 3*a* is, the higher the flow rate of vapor that is desorbed from the adsorbent 3*a* becomes. Furthermore, it has been known that the vapor density in the purge gas rvpcan to be purged to the air-intake passage 6 together with the air led through the air hole 8 (desorbed-from-adsorbent purge gas) is uniquely acquired in accordance with the stored-in-adsorbent vapor amount Mgcan (rvpcan←Fnc.{Mgcan}).

The foregoing description leads to the following conclusions.

(f) The desorbed-from-adsorbent vapor flow rate Fvpcan is proportional to the flow rate of the air led through the air hole 8 during purging or the inside-adsorbent air flow rate Fpgcan.

(g) The vapor density of the desorbed-from-adsorbent purge gas rvpcan is acquired uniquely from the stored-in-adsorbent vapor amount Mgcan. That is, the desorbed-from-adsorbent vapor flow rate Fvpcan with the inside-adsorbent air flow rate Fpgcan being constant is determined uniquely by the stored-in-adsorbent vapor amount Mgcan.

Figure 12:
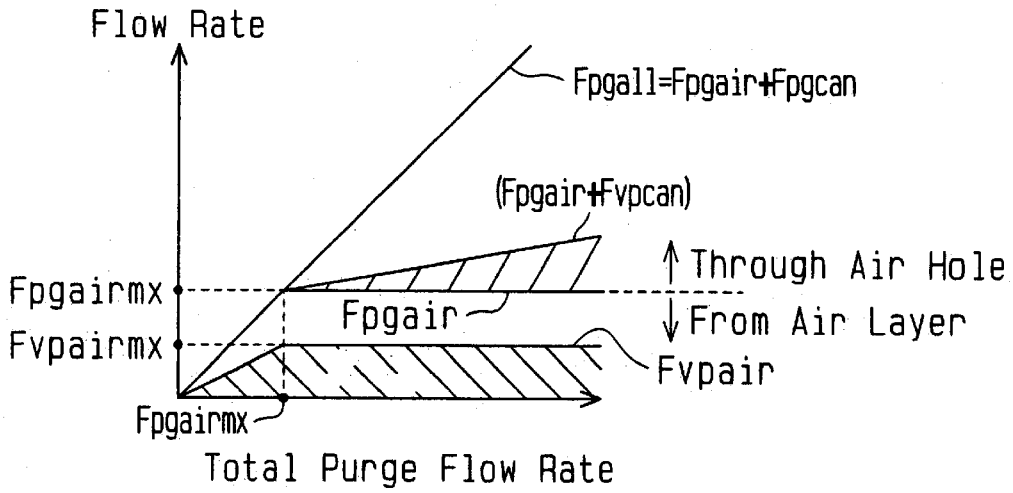
FIG. 12 is a graph showing the relationship between the flow rate of each component of a purge gas and a total purge flow rate.

In additional consideration of the vapor behavior of the air-layer purge derived in Section [1-3-1] (see FIG. 9), it is possible to estimate each component in the purge gas that is discharged to the air-intake passage 6 during purging. Given that the stored-in-air-layer vapor amount Mgair and the stored-in-adsorbent vapor amount Mgcan are constant, the relationship between each component of the purge gas to the air-intake passage 6 and the total purge flow rate Fpgall becomes as illustrated in FIG. 12.

Specifically, when the total purge flow rate Fpgall exceeds the maximum air-layer purge flow rate Fpgairmx, the flow rate of the purge gas from inside the canister air layer 3*b* (air-layer purge flow rate Fpgair) reaches the highest limit and the deficiency is supplemented by the flow rate of the air led through the air hole 8. Therefore, the deficient flow rate or the flow rate of the difference between the total purge flow rate Fpgall and the maximum air-layer purge flow rate Fpgairmx (Fpgall−Fpgair) becomes the inside-adsorbent air flow rate Fpgcan that is led through the air hole 8.

At this time, the vapor density rvpcan occupying the inside-adsorbent air flow rate Fpgcan is constant unless the stored-in-adsorbent vapor amount Mgcan changes. Therefore, with the stored-in-adsorbent vapor amount Mgcan being constant, the desorbed-from-adsorbent vapor flow rate Fvpcan in an area where the total purge flow rate Fpgall exceeds the maximum air-layer purge flow rate Fpgairmx is proportional to the inside-adsorbent air flow rate Fpgcan. Therefore, the desorbed-from-adsorbent vapor flow rate Fvpcan increases monotonously in accordance with an increase in total purge flow rate Fpgall.

[1-3-4] Physical Model of Vapor Behavior in the Entire Purge System

In summary, the physical model that shows a vapor behavior in the entire purge system as shown in FIG. 13 can be derived. The following will explain individual parameters in the physical model shown in FIG. 13 and relational expressions relating to the computation of the values.

(A) Generated-in-Tank Vapor Flow Rate Fvptnk

The amount (flow rate) of vapor generated in the fuel tank 1 and flowing to the canister air layer 3*b* [g/sec]. While the flow rate can be acquired by measuring a change in the inner pressure of the fuel tank 1 or the like, it can be predicted in accordance with the deviation rate of the estimated value of the stored-in-air-layer vapor amount Mgair (a time-dependent change in the amount of deviation).

(B) Stored-in-Air-Layer Vapor Amount Mgair

The amount of vapor stored in the canister air layer 3*b* [g]. The value of this parameter is updated every predetermined time in accordance with the generated-in-tank vapor flow rate Fvptnk, the vapor adsorption speed Fvpatc, the natural desorption speed Fvpcta and the air-layer vapor flow rate Fvpair. This value is corrected in accordance with the amount of deviation of the estimated value of the air-layer vapor flow rate Fvpair that is detected by monitoring the air-fuel ratio feedback correction value.

<<Relational Expression>>

$$\Delta Mgair \leftarrow Fvptnk - Fvpatc + Fvpcta - Fvpair$$

where ΔMgair indicates the updated amount of the stored-in-air-layer vapor amount Mgair per unit time (one second).

(C) Stored-in-Adsorbent Vapor Amount Mgcan

The amount of vapor [g] stored in the adsorbent 3*a* in the canister 3. The value of this parameter is updated every predetermined time in accordance with the vapor adsorption speed Fvpatc, the natural desorption speed Fvpcta and the desorbed-from-adsorbent vapor flow rate Fvpcan.

<<Relational Expression>>

$$\Delta Mgcan \leftarrow Fvpatc - Fvpcta - Fvpcan$$

where ΔMgcan indicates the updated amount of the stored-in-adsorbent vapor amount Mgcan per unit time (one second).

(D) Vapor Adsorption Speed Fvpatc

The flow rate of vapor that is adsorbed by the adsorbent 3*a* from the canister air layer 3*b* in a steady mode (the adsorption amount per unit time) [g/sec]. This parameter is proportional to the stored-in-air-layer vapor amount Mgair and the area of the vapor-unadsorbed portion of the adsorbent 3*a* (VPCANMX−Mgcan).

<<Relational Expression>>

$$Fvpatc \leftarrow k1 \cdot Mgair \cdot (VPCANMX - Mgcan)$$

where k1 indicates a predetermined constant.

(E) Natural Desorption Speed Fvpcta

The flow rate of vapor that is naturally desorbed from the adsorbent 3*a* to the canister air layer 3*b* without the stream of the air through the air hole 8 [g/sec]. The value of this parameter is proportional to the stored-in-adsorbent vapor amount Mgcan.

<<Relational Expression>>

$$Fvpcta \leftarrow k2 \cdot Mgcan$$

where k2 indicates a predetermined constant.

(F) Air-Layer Vapor Flow Rate Fvpair

The flow rate of vapor that is purged to the air-intake passage 6 from the canister air layer 3*b* during purging [g/sec]. The value of this parameter is acquired as a function of the stored-in-air-layer vapor amount Mgair and the total purge flow rate Fpgall.

<<Relational Expressions>>

$$Fvpair \leftarrow rvpair \cdot Fpgair$$

$$rvpair \leftarrow Fvpairmx/Fpgairmx(=Fnc.\{Mgair\})$$

$$Fpgair \leftarrow Fpgall(Fpgair \leqq Fpgairmx)$$

(G) Desorbed-From-Adsorbent Vapor Flow Rate Fvpcan

The flow rate of vapor that is desorbed from the adsorbent 3*a* with the stream of the air led through the air hole 8 during purging and is purged to the air-intake passage 6 [g/sec]. The value of this parameter is proportional to the inside-adsorbent air flow rate Fpgcan. The proportional constant (equivalent to the vapor density rvpcan of the desorption-from-adsorbent purging) is determined uniquely by the stored-in-adsorbent vapor amount Mgcan.

<<Relational Expressions>>

$$Fvpcan \leftarrow rvpcan \cdot Fpgcan$$

$$rvpcan \leftarrow Fnc.\{Mgcan\}$$

$$Fpgcan \leftarrow Fpgall - Fpgairmx(Fpgcan \geqq 0)$$

Refer to Sections [1-3-1] and [2-4-2] and other associated descriptions for the expressions.

(H) Total Vapor Flow Rate Fvpall

The total flow rate of vapor that is discharged to the air-intake passage 6 during purging [g/sec]. The value of this parameter is the sum of the air-layer vapor flow rate Fvpair and the desorbed-from-adsorbent vapor flow rate Fvpcan.

<<Relational Expression>>

$$Fvpall \leftarrow Fvpair + Fvpcan$$

Refer to Section [2-4-2] and other associated descriptions for the expression.

As apparent from the above, according to the physical model, it is possible to adequately grasp a change in vapor behavior in the purge system without depending on the results of actual measurements by a sensor or the like and accurately estimate the total vapor flow rate Fvpall to the engine during purging. The use of the estimated total vapor flow rate Fvpall can make it possible to ensure higher precision in air-fuel ratio feedback control.

According to the physical model, changes in the individual parameters associated with the vapor behavior can always be grasped in detail, so that fine control can be performed on various kinds of engine controls other than the air-fuel ratio feedback control while monitoring the changes in the parameters.

[2] Specific Example of Application of Physical Models

[2-1] General Structure of Air-Fuel Ratio Control Apparatus

This section will discuss the general structure of a specific example of an air-fuel ratio control apparatus for an engine to which control based on the physical models is adapted, by referring to FIG. 14.

As shown in FIG. 14, an engine 10 has a fuel chamber 11, an air-intake passage 12 and an exhaust passage 13. In driving the engine 10, fuel (e.g., gasoline) stored in a fuel tank 30 is pumped out by a fuel pump 31, is fed to a delivery pipe 12*a* via a fuel supply passage, and then injected into the air-intake passage 12 by an injector 12*b*. Provided upstream the air-intake passage 12 is throttle valve 12*c* which varies the flow-passage area of the air-intake passage 12 based on the depression of an accel pedal (not shown). Further provided in the air-intake passage 12 are an air cleaner 12*d* which purifies the intake air and an intake-air pressure sensor 12*e* which detects the inner pressure of the air-intake passage 12 (air-intake passage internal pressure PM).

A catalyst converter 13*a* for purifying the exhaust gas from the engine 10 is provided in the exhaust passage 13 and an air-fuel ratio sensor 13*b* for detecting the oxygen density in the exhaust gas is disposed upstream the catalyst converter 13*a*. The air-fuel ratio of an air-fuel mixture to be burned in the fuel chamber 11 is acquired in accordance with a detection signal from the air-fuel ratio sensor 13*b*.

A vapor purge system 20 has a canister 40 which captures vapor generated in the fuel tank 30 and a purge line 71 which purges the captured vapor to the air-intake passage 12 of the engine 10.

Provided at the ceiling portion of the fuel tank 30 in the vapor purge system 20 are an inner tank pressure sensor 32 which detects the inner pressure in the fuel tank 30 and a breather control valve 33. The inner tank pressure sensor 32 detects the pressure in the fuel tank 30 and the pressure in an area which communicates with the tank 30. The breather control valve 33 is a differential pressure valve of a diaphragm type. When the inner pressure of the fuel tank 30 becomes higher than the inner pressure of a breather line 34 by a predetermined pressure at the time of fuel supply, the breather control valve 33 is autonomically opened to escape vapor to the canister 40 via the breather line 34.

The fuel tank 30 is communicatable with the canister 40 via a vapor line 35 having a smaller inside diameter than the breather line 34. An inner-tank-pressure control valve 60 provided between the vapor line 35 and the canister 40 is a diaphragm type differential pressure valve which has a similar function to that of the breather control valve 33. A diaphragm valve body 61 in the inner-tank-pressure control valve 60 opens the control valve 60 only when the pressure in the fuel tank 30 becomes higher than the pressure in the canister 40 by a predetermined pressure.

The canister 40 has an adsorbent (such as activated charcoal) inside and is designed in such a way that after vapor is adsorbed and temporarily stored in the adsorbent, the vapor adsorbed in the adsorbent can be desorbed when the canister 40 is set under a pressure lower than the atmospheric pressure, i.e., in a negative pressure state. The canister 40 is communicatable with the air-intake passage 12 via the purge line 71 as well as is communicatable with the fuel tank 30 via the breather line 34 and the vapor line 35. The canister 40 also communicates with an atmosphere inlet line 72 and an atmosphere exhaust line 73 via an atmosphere valve 70.

A purge regulating valve (VSV) 71*a*, which functions as a purge regulator, is provided in the purge line 71. The VSV 71*a* is not a simple open/close valve, but is of a type which can arbitrarily adjust the angle from the fully closed state (angle of 0%) to the fully open state (angle of 100%). The VSV 71*a* is driven externally under duty control.

An atmosphere inlet valve 72*a* is provided in the atmosphere inlet line 72 that communicates with the air cleaner 12*d*.

Two diaphragm valve bodies 74 and 75 having different functions are provided in the atmosphere valve 70. The first diaphragm valve body 74 has rear-side space 74*a* which communicates with the purge line 71. When the pressure of the purge line 71 becomes a negative pressure equal to or lower than a predetermined pressure, the first diaphragm valve body 74 is opened to permit the flow of the outside air into the canister 40 from the atmosphere inlet line 72. When the pressure of the canister 40 reaches a positive pressure equal to or higher than a predetermined pressure, the second diaphragm valve body 75 is opened to discharge excess air to the atmosphere exhaust line 73 from the canister 40.

The interior of the canister 40 is defined into a first adsorbent chamber 42 and a second adsorbent chamber 43 by a partition 41. While both adsorbent chambers 42 and 43 are filled with an adsorbent (activated charcoal), both chambers are connected to each other at the canister bottom (the right-hand side in FIG. 14) via a ventilation filter 44. The fuel tank 30 is communicatable with one portion of the first adsorbent chamber 42 via the vapor line 35 and the inner-tank-pressure control valve 60 and another portion of the first adsorbent chamber 42 via the breather control valve 33 and the breather line 34. The atmosphere inlet line 72 and the atmosphere exhaust line 73 are communicatable with the second adsorbent chamber 43 via the atmosphere valve 70. The purge line 71 provided with the VSV 71*a* connects the first adsorbent chamber 42 of the canister 40 to the downstream position of the throttle valve 12*c* of the air-intake passage 12. The purge line 71 connects the first adsorbent chamber 42 to the downstream position of the throttle valve 12*c* in accordance with the valve opening action of the VSV 71*a*.

Formed in the first adsorbent chamber 42 is a canister air layer 45 which separates the adsorbent from the ceiling portion of the canister 40 to which the breather control valve 33, the breather line 34 and the purge line 71 are open. Therefore, the vapor that is led through the vapor line 35 and the breather line 34 is temporarily mixed into the purge gas in the canister air layer 45 and is gradually adsorbed in the adsorbent in the first adsorbent chamber 42. Even when a lots of vapor flows from the fuel tank 30, such as at the time of fuel supply, the canister air layer 45 serves as a buffer to suppress the degradation of the adsorbent.

Even in case where the second diaphragm valve body 75 constituting the atmosphere valve 70 is opened to discharge excess air inside the canister 40 from the atmosphere exhaust line 73, the vapor that is stored in the purge gas in the canister air layer 45 is adsorbed by the adsorbent inside the second adsorbent chamber 43 at the time of passing the chamber 43.

In addition, the vapor purge system 20 is provided with a bypass line 80 for introducing negative pressure so as to connect the inner-tank-pressure control valve 60 (or one end portion of the vapor line 35) to the second adsorbent chamber 43 of the canister 40. A bypass control valve 80*a* is provided in the bypass line 80. When the bypass control valve 80*a* is opened, the second adsorbent chamber 43 is directly connected to the fuel tank 30 via the bypass line 80 and the vapor line 35.

The engine 10 and the vapor purge system 20 are further equipped with an electronic control unit (ECU) 50 as an engine controller and a purge controller. The ECU 50, which is a computer, is connected directly or indirectly with various sensors needed to control the operation of the engine 10, such as an engine speed (NE) sensor and a cylinder identification sensor, in addition to the intake-air pressure sensor 12*e* and the inner tank pressure sensor 32. The ECU 50 is also connected with the injector 12*b*, the fuel pump 31, the VSV 71*a*, the atmosphere inlet valve 72*a* and the bypass control valve 80*a* via the respective drive circuits.

Based on various kinds of information given from the individual sensors, the ECU 50 executes engine controls, such as air-fuel ratio feedback control, fuel injection amount control and ignition timing control. The ECU 50 performs vapor purge control and self-diagnosis of the purge system (i.e., leak diagnosis or the like of the purge path) by adequately controlling the opening/closing of the VSV 71*a*, the atmosphere inlet valve 72*a* and the bypass control valve 80*a* while identifying the output signal of the inner tank pressure sensor 32.

The angle of the VSV 71*a* is adjusted by controlling the duty ratio of a drive signal which is sent to the VSV 71*a* from the associated drive circuit. Specifically, the VSV 71*a* is fully closed when the duty ratio is 0%, and the VSV 71*a* is fully open when the duty ratio is 100%. The VSV 71*a* of the vapor purge system 20 is designed in such a way that the flow rate of the gas to be purged to the air-intake passage 12 from the canister 40 (total purge flow rate Fpgall) is proportional to the duty ratio under a given condition of the air-intake passage internal pressure PM. Because the duty ratio is a control parameter which uniquely corresponds to the real angle of the VSV 71*a*, the duty ratio will be referred to as "VSV angle Dvsv" in the following description.

(Outline of Vapor Purging in Vapor Purge System)

When the fuel in the fuel tank 30 evaporates and the evaporation pressure becomes equal to or higher than a predetermined pressure, the inner-tank-pressure control valve 60 autonomically opens to let vapor flow into the canister 40 from the fuel tank 30. In case where the evaporation pressure of vapor rises abruptly inside the fuel tank 30, such as at the time of fuel supply, the breather control valve 33 autonomically opens to let a lot of vapor flow into the canister 40 from the fuel tank 30. The vapor that has flowed into the canister 40 is temporarily mixed with the purge gas in the canister air layer 45 and is then gradually adsorbed by the adsorbent in the canister 40.

Thereafter, when the engine operation condition satisfies a predetermined condition, such as the coolant temperature of the engine 10 reaching a predetermined purge start temperature, the VSV 71*a* which is closed is opened based on a control signal from the ECU 50. An intake negative pressure is led into the canister 40 through the air-intake passage 12 via the purge line 71 and the purge gas containing vapor stored in the canister 40 is purged to the air-intake passage 12.

When the flow rate of the gas to be purged (total purge flow rate Fpgall) becomes equal to or higher than a predetermined flow rate, the open state of the atmosphere inlet valve 72*a* is maintained and fresh air is introduced into the canister 40 from the air cleaner 12*d* via the atmosphere inlet line 72. The negative pressure and the supply of the fresh air desorb vapor from the adsorbent, so that the vapor is purged to the air-intake passage 12 via the purge line 71. According to the vapor purge system 20, therefore, the atmosphere inlet line 72, the atmosphere inlet valve 72*a*, the atmosphere valve 70 and so forth are equivalent to the aforementioned "air hole".

[2-2] Outline of Purge Control

This section will schematically discuss the outline of purge control in the present control apparatus by further referring to FIG. 15.

The ECU 50 in the control apparatus performs a process of holding the air-fuel ratio of a mixture to be burnt in the fuel chamber 11 to a desired target value (e.g., stoichiometric air-fuel ratio) based on the adjustment of a fuel injection amount (injection time) TAU from the injector 12*b* while executing the above-described vapor purge process. The ECU 50 attempts to adapt the air-fuel ratio control that considers the influence of the vapor purging by correcting the fuel injection amount in accordance with the total vapor flow rate Fvpall that is estimated based on the physical models. Furthermore, the ECU 50 further improves the adaptation of the air-fuel ratio control by executing various kinds of processes, such as maintaining the precision in estimating the total vapor flow rate Fvpall and the alleviation of the influence of vapor purging on the air-fuel ratio control.

FIG. 15 shows a "basic routine" which illustrates the outline of the process contents that relate to the adaptation of vapor purging to such air-fuel ratio control. The processing of this routine is repeatedly executed by the ECU 50 while the engine 10 is running. The routine illustrates the general image of the processing in an easy-to-understand mode and does not completely coincide with the actual procedures taken by the ECU 50.

First, the ECU 50 performs a calculation process for the angle (duty ratio) Dvsv of the VSV 71*a*, as shown in step 100 in FIG. 15. The VSV angle Dvsv is set in this step to adjust the total vapor flow rate Fvpall within a range where the influence on air-fuel ratio control can be suppressed based on the physical models. The details of this process will be given later in Section [2-8].

Then, the ECU 50 estimates the current total vapor flow rate Fvpall based on the physical models and computes the amount of purge correction in accordance with the estimated value in next step 200. At this time, the ECU 50 predicts the total vapor flow rate Fvpall based on the total purge flow rate Fpgall, which is grasped based on the VSV angle Dvsv computed in step 100, and the aforementioned various physical status quantities (such as Mgair and Mgcan). The details of this process will be given later in Section [2-4].

In subsequent step 300, the ECU 50 calculates the fuel injection amount TAU from the injector 12*b* in accordance with the calculated purge correction amount. In step 400, the ECU 50 controls the driving of the injector 12*b* and executes fuel injection in accordance with the calculated fuel injection amount TAU. The details of the process associated with the calculation of the fuel injection amount TAU will be given later in Section [2-5].

As shown in step 500, the ECU 50 performs a process associated with a regular update of the values of the individual physical status quantities in accordance with the physical models. The regular update process keeps the physical status quantities at proper values according to changes in vapor behaviors in the vapor purge system 20. The details of the regular update process will be given later in Section [2-3].

As indicated in step 600, the ECU 50 also performs a process of grasping errors in the individual physical status quantities in accordance with the deviation of the air-fuel ratio feedback correction term (hereinafter called "air-fuel ratio F/B correction term") during purging and correcting those values. The correcting process keeps the physical status quantities at proper values. The details of this process will be given later in Section [2-7].

[2-3] Regular Update Process of Each Physical Status Quantity Based on the Physical Models (S500 in FIG. 15)

This section will discuss the details of the process by the ECU 50 that is associated with the regular update of the individual physical status quantities in the control apparatus.

According to the physical models, as described above, the stored-in-air-layer vapor amount Mgair increases by the flow rate of vapor flowed from the fuel tank 30 (generated-in-tank vapor flow rate Fvptnk) per unit time. The stored-in-air-layer vapor amount Mgair increases or decreases the flow rate of vapor that is exchanged between the canister air layer 45 and the adsorbent 42 per unit time. Specifically, the stored-in-air-layer vapor amount Mgair decreases by the vapor adsorption speed Fvpatc and increases by the natural desorption speed Fvpcta. During purging, the stored-in-air-layer vapor amount Mgair decreases by the air-layer vapor flow rate Fvpair per unit time.

Further, according to the physical models, the stored-in-adsorbent vapor amount Mgcan increases by the vapor adsorption speed Fvpatc and decreases by the natural desorption speed Fvpcta per unit time. During purging, the stored-in-adsorbent vapor amount Mgcan decreases by the desorbed-from-adsorbent vapor flow rate Fvpcan per unit time.

Therefore, changes ΔMgair and ΔMgcan in both vapor amounts per unit time are given by expressions shown in FIG. 15. As mentioned above, the vapor adsorption speed Fvpatc is acquired as a parameter proportional to the stored-in-air-layer vapor amount Mgair and the area of the vapor-unadsorbed portion of the adsorbent and the natural desorption speed Fvpcta is acquired as a parameter proportional to the stored-in-adsorbent vapor amount Mgcan (see Sections [1-3-2] and [1-3-4] and FIG. 13 and other associated diagrams). If the regular update process is carried out every predetermined time Ts [sec], therefore, the amounts of update of the vapor amounts Mgair and Mgcan for each process become integral values of changes ΔMgair and ΔMgcan per unit time over the predetermined time Ts.

The ECU 50 in the control apparatus executes the regular update process every unit time (one second) to update the values of the stored-in vapor amounts Mgair and Mgcan.

Therefore, the amounts of update of the vapor amounts Mgair and Mgcan at the time of the present process with the control apparatus is executed by the control apparatus become equal to the value of the changes ΔMgair and ΔMgcan per unit time.

[2-4] Process of Calculating Purge Correction Amount (S200 in FIG. 15)

This section will give a detailed description of a process of calculating a purge correction amount in the control apparatus by further referring to FIGS. 16 to 22.

Figure 16:
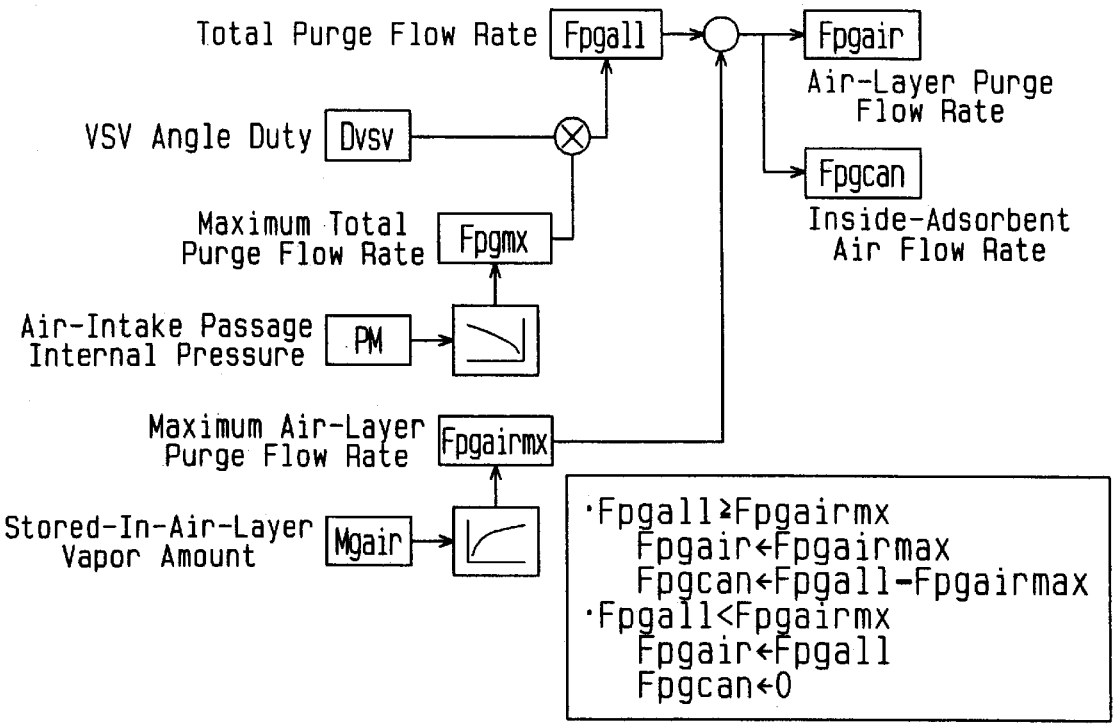
FIG. 16 is a block diagram showing a logic of calculating each purge flow rate.
Figure 17:
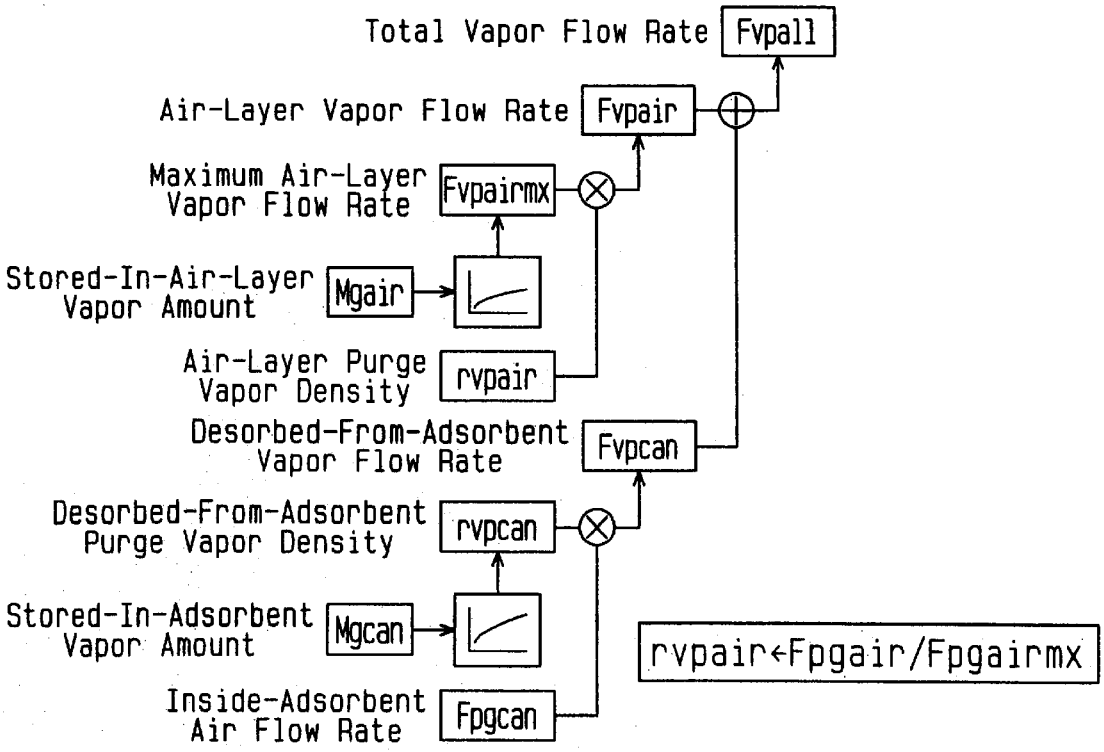
FIG. 17 is a block diagram showing a logic of calculating each vapor flow rate.

As mentioned above, the control apparatus estimates the total vapor flow rate Fvpall based on the total purge flow rate Fpgall and the individual physical status quantities in accordance with the physical models, and acquires a purge correction amount from the estimated value. FIG. 16 shows a logic of calculating each purge flow rate associated with the estimation of the total vapor flow rate Fvpall and FIG. 17 shows a logic of calculating each vapor flow rate associated with that estimation. The following will discuss a process of calculating the total vapor flow rate Fvpall by the ECU 50 of the control apparatus by referring to FIGS. 16 and 17.

[2-4-1] Process of Calculating Individual Purge Flow Rates (FIG. 16)

First, the ECU 50 computes the total purge flow rate Fpgall based on the air-intake passage internal pressure PM detected by the intake-air pressure sensor 12*e* and the VSV angle Dvsv that is grasped based on an instruction signal to the VSV 71*a*. Specifically, the total purge flow rate Fpgall is calculated in a calculation process discussed below.

It is possible to specifically acquire the total purge flow rate Fpgall at a predetermined air-intake passage internal pressure PM with the VSV 71*a* fully open (VSV angle Dvsv of 100%) or the an maximum value of the total purge flow rate (maximum total purge flow rate) Fpgmx at the predetermined air-intake passage internal pressure PM. As described above, the purge system is constructed in such a way that the VSV angle Dvsv is proportional to the total purge flow rate Fpgall under the condition of the air-intake passage internal pressure PM being constant.

Figure 18:
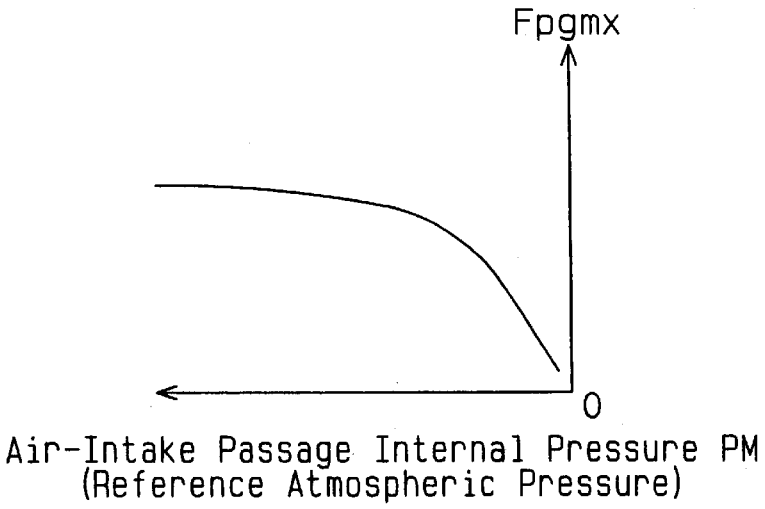
FIG. 18 is a graph showing the relationship between an air-intake passage internal pressure and a maximum total purge flow rate.

In the control apparatus, the relationship between the air-intake passage internal pressure PM obtained through tests or the like and the maximum total purge flow rate Fpgmx is stored in advance in a memory in the ECU 50 as an operational map as exemplified in FIG. 18. The ECU 50 acquires the maximum total purge flow rate Fpgmx from the detected value of the air-intake passage internal pressure PM by using the operational map and computes the total purge flow rate Fpgall by multiplying the maximum total purge flow rate Fpgmx by the VSV angle (duty ratio) Dvsv.

Subsequently, the ECU 50 computes the flow rates of the individual purge components with respect to the total purge flow rate Fpgall, i.e., the air-layer purge flow rate Fpgair and the inside-adsorbent air flow rate Fpgcan. Specifically, the computation of those flow rates is carried out as follows.

Most of the total purge flow rate Fpgall is occupied by the air-layer purge flow rate Fpgair until the total purge flow rate Fpgall reaches the maximum air-layer purge flow rate Fpgairmx. The maximum air-layer purge flow rate Fpgairmx is determined uniquely by the stored-in-air-layer vapor amount Mgair as mentioned earlier (see Section [1-3-1] and FIG. 9 and other associated diagrams).

Figure 19:
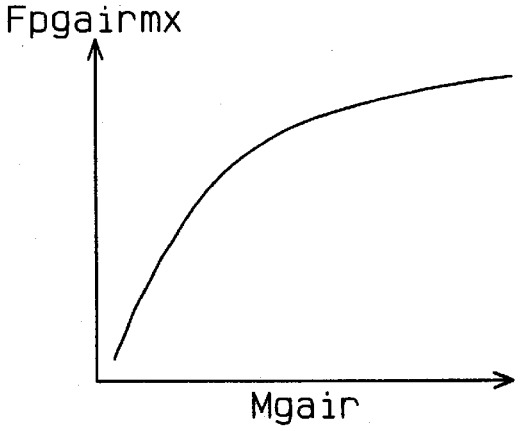
FIG. 19 is a graph showing the relationship between a stored-in-air-layer vapor amount and a maximum air-layer purge flow rate.
Figure 20:
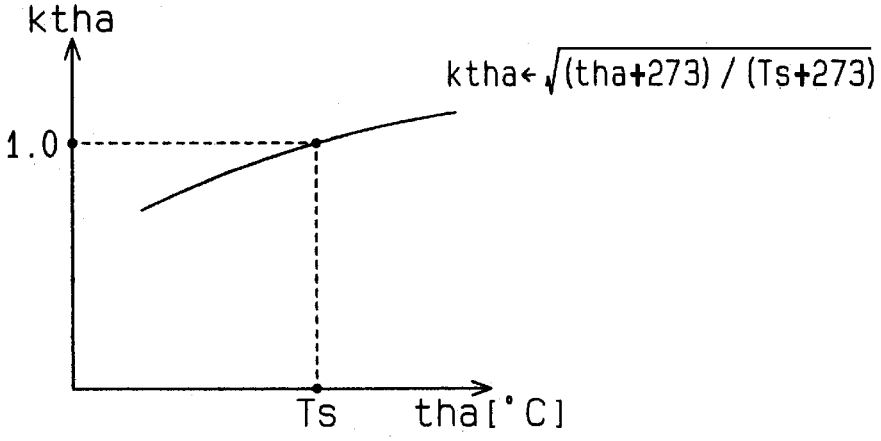
FIG. 20 is a graph showing the relationship between a temperature correcting coefficient of a flow rate and an intake air temperature.

Stored in the memory in the ECU 50 beforehand is an operational map as shown in FIG. 19 which shows the correlation between the stored-in-air-layer vapor amount Mgair and the maximum air-layer purge flow rate Fpgairmx, which has been acquired through tests or the like. First, the ECU 50 computes the maximum air-layer purge flow rate Fpgairmx by using the operational map and acquires the purge flow rates Fpgair and Fpgcan by correlating the computed flow rate Fpgairmx with the acquired total purge flow rate Fpgall. Specifically, when the total purge flow rate Fpgall is less than the maximum air-layer purge flow rate Fpgairmx, the air-layer purge flow rate Fpgair is set to the same value as the total purge flow rate Fpgall and the inside-adsorbent air flow rate Fpgcan is set to "0". When the total purge flow rate Fpgall is equal to or higher than the maximum air-layer purge flow rate Fpgairmx, the air-layer purge flow rate Fpgair is set to the same value as the maximum air-layer purge flow rate Fpgairmx. In addition, a value obtained by subtracting the maximum air-layer purge flow rate Fpgairmx from the total purge flow rate Fpgall is set as the value of the inside-adsorbent air flow rate Fpgcan. The foregoing description has discussed the contents of the process of calculating the individual purge flow rates as shown in FIG. 16.

As indicated in the equation (3) or the theoretical equation of the maximum air-layer purge flow rate Fpgairmx, the flow rate Fpgairmx is a parameter which depends on the absolute temperature T of the purge gas of the canister air layer 45 to some extent. The control apparatus computes the flow rate Fpgairmx, considering that under normal use conditions, a change in absolute temperature T is small and hardly affects the calculation precision. There may be a case where the influence of the absolute temperature T cannot be ignored depending on the structure of the purge system, the use conditions thereof and so forth. In such a case, a reduction in the calculation precision can be suitably avoided by calculating the flow rate Fpgairmx in the following manner.

As indicated in the theoretical equation (3), the maximum air-layer purge flow rate Fpgairmx is proportional to the square root of the absolute temperature T. Therefore, an absolute temperature Ts [K] of the purge gas in the canister air layer 45, which would be measured or estimated in preparing the operational map (FIG. 19) through tests or the like, and an absolute temperature Tn [K] of the purge gas at the time of calculating the flow rate Fpgairmx should be acquired beforehand. As the value of the flow rate Fpgairmx computed using the operational map is multiplied by the square root of the ratio (Tn/Ts) of those absolute temperatures, the influence of the absolute temperature T can be reflected into the computed value of the flow rate Fpgairmx. The following will discuss one example of such a calculation process.

The temperature of the purge gas in the canister air layer 45 is considered as substantially identical to the temperature (intake-air temperature) tha of the air to be led into the air-intake passage 12. The control systems of most of engines mounted in vehicles monitor the intake-air temperature tha whose value is indicated in Celsius [° C.]. Given that Ts [° C.] is the estimated temperature at the time of preparing the operational map for calculating the maximum air-layer purge flow rate Fpgairmx, the aforementioned ratio of the absolute temperatures, ktha, is given by an expression shown on the upper right in FIG. 20 ($ktha^2 \leftarrow (tha+273)/(Ts+273)$). The correlation between the ratio ktha and the intake-air temperature tha is seen on a graph also shown in FIG. 20. Therefore, the ratio ktha is computed as a temperature correcting coefficient of the flow rate in accordance with the intake-air temperature tha by using the operational map indicating that correlation prestored in the memory in ECU 50. Then, the maximum air-layer purge flow rate Fpgairmx is acquired by multiplying the value calculated using the operational map exemplified in FIG. 19 by the temperature correcting coefficient ktha. Of course, the same results would be acquired even if the temperature correcting coefficient ktha is calculated from the relational expression shown in FIG. 20 every time the flow rate Fpgairmx is calculated.

[2-4-2] Process of Calculating Individual Vapor Flow Rates (FIG. 17)

Further, the ECU 50 executes a process of calculating individual vapor flow rates illustrated in FIG. 17 by using the computed purge flow rates, i.e., the total purge flow rate Fpgall, the air-layer purge flow rate Fpgair, the inside-adsorbent air flow rate Fpgcan and the maximum air-layer purge flow rate Fpgairmx. The following will give a detailed description of the calculation process.

As described in Section [1-3-1], the vapor behaviors in air-layer purging have the following characteristics.

The vapor density of the air-layer purge gas, rvpair, is acquired as the ratio (Fvpairmx/Fpgairmx) of the maximum air-layer vapor flow rate Fvpairmx obtained based on the theoretical equation 4 to the computed maximum air-layer purge flow rate Fpgairmx.

The maximum air-layer vapor flow rate Fvpairmx is uniquely acquired from the stored-in-air-layer vapor amount Mgair in accordance with the theoretical equation 4.

Figure 21:
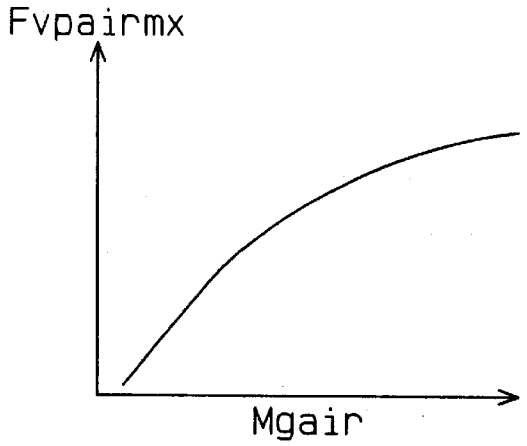
FIG. 21 is a graph showing the relationship between a stored-in-air-layer vapor amount and a maximum air-layer purge flow rate.

Therefore, the ECU 50 obtains the maximum air-layer vapor flow rate Fvpairmx from the stored-in-air-layer vapor amount Mgair first and computes the air-layer purge vapor density rvpair as the ratio of the flow rate Fvpairmx to the maximum air-layer purge flow rate Fpgairmx. Then, the ECU 50 multiplies the vapor density rvpair by the maximum air-layer vapor flow rate Fvpairmx to acquire the air-layer vapor flow rate Fvpair. According to the control apparatus, the operational map that shows the correlation between the stored-in-air-layer vapor amount Mgair and the maximum air-layer vapor flow rate Fvpairmx is stored in the memory of the ECU 50 and the maximum air-layer vapor flow rate Fvpairmx is obtained by using this operational map. FIG. 21 shows one example of the operational map.

Figure 22:
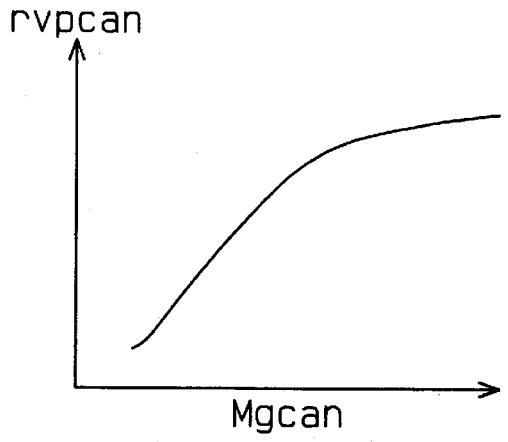
FIG. 22 is a graph showing the relationship between a stored-in-adsorbent vapor amount and a desorbed-from-adsorbent vapor density.

As described in Section [1-3-2], the vapor density of the desorbed-from-adsorbent purge gas, rvpcan, is uniquely acquired from the stored-in-adsorbent vapor amount Mgcan. The ECU 50 obtains the vapor density rvpcan from the stored-in-adsorbent vapor amount Mgcan first. The control apparatus executes a process of calculating the vapor density rvpcan by using the operational map that shows the correlation between the stored-in-adsorbent vapor amount Mgcan prestored in the memory of the ECU 50 and the vapor density rvpcan. FIG. 22 shows one example of the operational map. Then, the ECU 50 multiplies the inside-adsorbent air flow rate Fpgcan calculated beforehand by the vapor density rvpcan to acquire the desorbed-from-adsorbent vapor flow rate Fvpcan.

Further, the ECU 50 acquires the total vapor flow rate Fvpall as the sum of the obtained air-layer vapor flow rate Fvpair and desorbed-from-adsorbent vapor flow rate Fvpcan (Fvpall←Fvpair+Fvpcan). The foregoing description has discussed the contents of the process of calculating the individual vapor flow rates as shown in FIG. 17.

As indicated in the theoretical equation (4), the maximum air-layer vapor flow rate Fvpairmx is also a parameter which has a dependency similar to that of the maximum air-layer purge flow rate Fpgairmx with respect to the temperature of the purge gas in the canister air layer 45. In a case where such a temperature dependency matters, the problem can be avoided if the maximum air-layer vapor flow rate Fvpairmx is obtained by multiplying the value obtained from the operational map by the temperature correcting coefficient ktha obtained in the same manner as done in the case of the maximum air-layer purge flow rate Fpgairmx.

After the above-described calculation process, the ECU 50 computes a purge correction value fpg in accordance with the obtained total vapor flow rate Fvpall. The purge correction value fpg is a correction term equivalent to the influence of the vapor purging with respect to a fuel injection amount Qfin from the injector 12*b* per unit time (e.g., one second). Therefore, the purge correction value fpg when vapor purging is carried out based on the physical models (see FIG. 13 and other associated diagrams) becomes the value of the total vapor flow rate Fvpall with its sign inverted (fpg←−Fvpall)

[2-5] Process of Calculating Fuel Injection Amount (S300 in FIG. 15)

This section will give a detailed description of a process of calculating the fuel injection amount in the control apparatus.

The ECU 50 in the control apparatus acquires the fuel injection amount Qfin [g/sec] from the injector 12*b* per unit time approximately according to the following expression.

<<Operational Expression of Fuel Injection Amount>>

$$Qfin \leftarrow Qbase + faf + KG + fpg$$

where "Qbase" is a basic fuel injection amount [g/sec] which is calculated in accordance with the engine speed NE and engine load Q using a predetermined operational map prestored in the memory of the ECU 50. The parameter "faf" indicates an air-fuel ratio feedback correction value (hereinafter expressed as "air-fuel ratio F/B correction value"), and "KG" indicates an air-fuel ratio learned value. The air-fuel ratio F/B correction value faf and air-fuel ratio learned value KG are set in the processing of air-fuel ratio feedback control that will be discussed below.

The outline of the air-fuel ratio feedback control in the control apparatus will be discussed by referring to FIG. 23. The air-fuel ratio feedback control sets the air-fuel ratio of the mixture to be burned in the fuel chamber 11 to a target air-fuel ratio (e.g., stoichiometric air-fuel ratio) and is carried out by the ECU 50 through the correction of the fuel injection amount Qfin based on the air-fuel ratio F/B correction value faf and the air-fuel ratio learned value KG.

Figure 23:
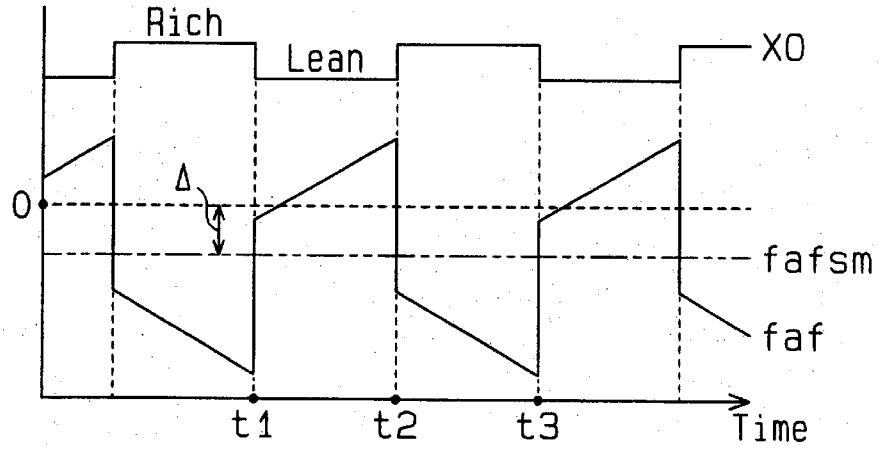
FIG. 23 is a time chart depicting the mode of air-fuel ratio control.

FIG. 23 shows changes in air-fuel ratio F/B correction value faf according to the detection results from the air-fuel ratio sensor 13*b*. A parameter "XO" whose change is shown in FIG. 23 is a value binarized based on the measured value of the air-fuel ratio that is grasped from the detection signal from the air-fuel ratio sensor 13*b*, depending on whether the measured value is smaller or larger than the target value. Therefore, "XO" is an index value of the real air-fuel ratio which indicates whether the current air-fuel ratio of the engine 10 based on the measuring result is on a lean side or a rich side with respect to the target air-fuel ratio.

The ECU 50 keeps the real air-fuel ratio of the engine 10 near the target value by adjusting the fuel injection amount Qfin through manipulation of the value of the air-fuel ratio F/B correction value faf in accordance with the index value XO of the real air-fuel ratio. More specifically, the manipulation of the air-fuel ratio F/B correction value faf is carried out in the following manner.

When the real air-fuel ratio that is grasped from the index value XO is shifted to the lean side from the rich side as done at time t1 in FIG. 23, the ECU 50 temporarily increases the air-fuel ratio F/B correction value faf by a predetermined amount and increases the fuel injection amount Qfin accordingly. Until the real air-fuel ratio is shifted back to the rich side from the lean side (period from time t1 to time t2), the ECU 50 gradually increases the air-fuel ratio F/B correction value faf by a predetermined rate. When the real air-fuel ratio is turned to the rich side from the lean side as done at time t2, the ECU 50 temporarily decreases the air-fuel ratio F/B correction value faf by a predetermined amount. Until the real air-fuel ratio is shifted back to the rich side from the lean side (period from time t2 to time t3), the ECU 50 gradually decreases the air-fuel ratio F/B correction value faf by a predetermined rate. Through this processing, the feedback correction of the fuel injection amount Qfin is performed in order to keep the air-fuel ratio near its target value. Hereinafter, the temporary change (increase or decrease) in air-fuel ratio F/B correction value faf at the time the real air-fuel ratio is shifted between the lean and rich sides is called "skip". The gradual change (decrease or increase) in air-fuel ratio F/B correction value faf until the lean/rich state of the real air-fuel ratio is inverted again since the shifting is called "integration", and a period in which the integration takes place is called "integration period".

The ECU 50 acquires a center value (air-fuel ratio F/B center value) fafav from the changes in air-fuel ratio F/B correction value faf. In other words, the air-fuel ratio F/B center value fafv represents the average of the air-fuel ratio F/B correction value faf. The ECU 50 acquires the air-fuel ratio learned value KG in such a way that the air-fuel ratio F/B center value fafav becomes nearly "0", which is a referential value, based on the center value fafav at the time a predetermined engine running condition is met, and memorizes the learned value KG. The air-fuel ratio learned value KG is separately obtained for each of plural areas separated in accordance with the engine driving states, such as the engine speed NE and the engine load Q, and is memorized. Accordingly, the desired air-fuel ratio can be secured quickly without follow-up by the integration of the air-fuel ratio F/B correction value faf even at the time of shifting the engine running condition. An engine running condition with a stable air-fuel ratio, which has sufficiently small instable elements, such as execution of vapor purging or a change in engine running condition, is selected as the predetermined engine running condition for setting the air-fuel ratio learned value KG.

The ECU 50 obtains a value which gradually increases or decreases in response to a progressive change fafsm in air-fuel ratio F/B center value fafav, i.e., a change in air-fuel ratio F/B center value fafav, and grasps a change in air-fuel ratio F/B correction value faf free of the influence of disturbance.

During purging, as described above, vapor to be discharged to the air-intake passage 12 with the vapor purging process is mixed with the mixture to be burnt in the fuel chamber 11, so that the air-fuel ratio of the mixture should naturally decrease (become richer) by the amount of vapor mixed in the vapor purging process. According to the control apparatus, however, the fuel injection amount Qfin is reduced by the amount of the mixed vapor by the purge correction value fpg as indicated by the calculation equation. If the total vapor flow rate Fvpall is estimated adequately and the proper value is set to the purge correction value fpg, therefore, the air-fuel ratio F/B correction value faf would not be affected at all even if the purging condition, such as with/without purging and a change in total purge flow rate Fpgall, is changed. In other words, if the air-fuel ratio F/B correction value faf is deviated, it seems that the purge correction value fpg, and eventually, the estimation of the total vapor flow rate Fvpall, would be in error.

The ECU 50 converts the computed fuel injection amount Qfin to the injection time TAU per single injection of each injector 12*b* in accordance with the engine speed NE or the like. Then, the ECU 50 sends an instruction signal to each injector 12*b* based on the injection time TAU and supplies and injects fuel to the engine 10. Through the above-described process, air-fuel ratio feedback control based on the adjustment of the fuel injection amount is executed in consideration of the influence of vapor purging.

[2-6] Initialization of Physical Status Quantities

According to the physical models (see FIG. 13 and other associated diagrams), as described above, the total vapor flow rate Fvpall is estimated from the individual physical status quantities (generated-in-tank vapor flow rate Fvptnk, stored-in-air-layer vapor amount Mgair and stored-in-adsorbent vapor amount Mgcan), and the purge correction value fpg can be acquired adequately in accordance with the estimated flow rate. As the regular update process described in Section [2-3] is performed according to the models, the physical status quantities can be held at proper values in line with the current condition in accordance with a change in vapor behavior in the canister 40. When the physical status quantities are unclear as in the case of executing purging for the first time since the ignition of the engine 10, it is not possible to estimate the total vapor flow rate Fvpall and the like based on the physical models as well.

When the physical status quantities are unclear, therefore, the control apparatus executes a process of initializing the values of the physical status quantities or a process of computing their initial values. To begin with, the details of the initialization process will be described by further referring to FIGS. 24 to 26.

[2-6-1] Vapor Purging Before Completing Initialization

The ECU 50 in the control apparatus acquires a total vapor flow rate actual measurement value Fvps which is computed based on a change in air-fuel ratio F/B correction value faf according to changes in purging condition, in addition to the total vapor flow rate Fvpall that is estimated according to the physical models. When the individual physical status quantities are unclear and it is before completion of the initialization where the estimation of the total vapor flow rate Fvpall is not possible, the purge correction value fpg is acquired by using the total vapor flow rate actual measurement value Fvps in place of the total vapor flow rate Fvpall. Before completion of the initialization, while a purging-originated change in air-fuel ratio F/B correction value faf is monitored, the total purge flow rate Fpgall is adjusted in such a way as to place the deviation of the change within a predetermined range.

Figure 24:
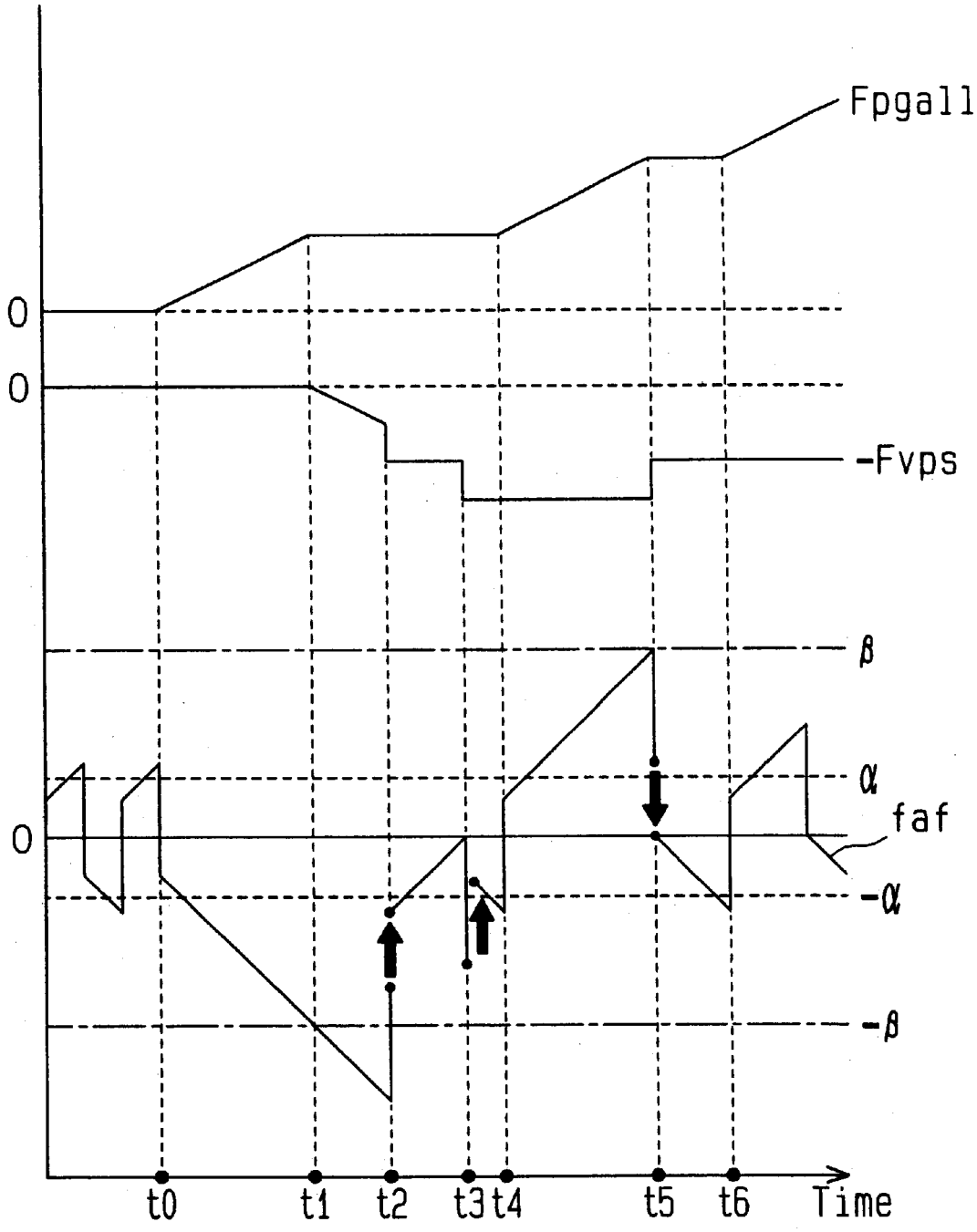
FIG. 24 is a time chart depicting a control mode in the process of initializing a physical status quantity.

FIG. 24 depicts a control mode before completion of the initialization. The following will describe individual processes of the ECU 50 which are associated with the adjustment of the total purge flow rate Fpgall before completion of the initialization (adjustment of the VSV angle Dvsv) and the computation of the total vapor flow rate actual measurement value Fvps, by referring to FIG. 24 as an example.

In the example of FIG. 24, it is assumed that after the engine is ignited, various conditions needed for executing purging, such as the completion of warm-up or the stabilization of the air-fuel ratio F/B correction value faf (whose center value fafav is kept near "0"), are satisfied at time t0. At time t0, the ECU 50 starts purging by gradually opening the VSV 71*a* which has been kept fully closed. As a result, after time t0, the total purge flow rate Fpgall gradually increases in accordance with the opening of the VSV 71*a*.

The initial value of the total vapor flow rate actual measurement value Fvps or the value at the time the engine is ignited is set to "0", and the purge correction value fpg is therefore "0". After time t0, therefore, the air-fuel ratio F/B correction value faf changes in the decreasing direction in order to compensate for an increase in the amount of vapor flowing into the air-intake passage 12 due to an increase in total purge flow rate Fpgall. FIG. 24 shows a change in the value of the total vapor flow rate actual measurement value Fvps with its sign inverted.

The ECU 50 of the control apparatus detects whether or not the air-fuel ratio F/B correction value faf has a significant deviation originated from purging, by using the following two threshold values α and β. First, when the absolute value of the air-fuel ratio F/B center value fafav after a skip process at the time the real air-fuel ratio XO shifts to a lean/rich state exceeds the threshold value α (fafav<−α or fafav >α), the ECU 50 decides that the deviation has occurred. At this time, the ECU 50 increases or decreases the total vapor flow rate actual measurement value Fvps by a predetermined value to correct the deviation.

When the absolute value of the air-fuel ratio F/B correction value faf during the integration period exceeds the threshold value β, the ECU 50 also decides that the deviation has occurred (faf<−β or fafav>β). As shown in FIG. 24, the threshold value β is set larger than the threshold value α. While it is decided that the deviation has occurred, the ECU 50 increases or decreases the total vapor flow rate actual measurement value Fvps by a predetermined rate to thereby correct the deviation.

In the example of FIG. 24, when the absolute value of the air-fuel ratio F/B correction value faf exceeds the threshold value β at time t1 due to the negative deviation of the correction value faf after time t0, the ECU 50 increases the total vapor flow rate actual measurement value Fvps by a predetermined rate thereafter. The increase in total vapor flow rate actual measurement value Fvps in such a mode continues to time t2 at which the real air-fuel ratio XO is turned to the lean side from the rich side and a skip process to increase the air-fuel ratio F/B term fat is carried out.

Further, the ECU 50 interrupts the alteration of the angle of the VSV 71*a* in the opening direction and keeps the angle until the stability of the air-fuel ratio F/B correction value faf is confirmed from the detection of such a deviation, thereby holding the total purge flow rate Fpgall in a given state. The ECU 50 of the control apparatus confirms the stability of the air-fuel ratio F/B correction value faf by the absolute value of the air-fuel ratio F/B central value fafav after the skip process becoming equal to or smaller than the threshold value α.

If the absolute value of the air-fuel ratio F/B central value fafav exceeds the threshold value α after the skip process at time t2 due to the negative deviation of the correction value faf, the ECU 50 increases the total vapor flow rate actual measurement value Fvps by a predetermined value. The ECU 50 also corrects the air-fuel ratio F/B correction value faf and its center value fafav by an amount equivalent to the increase in the actual measurement value Fvps. In the example of FIG. 24, the occurrence of a deviation is similarly detected and a similar process is executed at time t3, following time t2, at which a skip process is performed.

When the stability of the air-fuel ratio F/B correction value faf is confirmed at time t4, following time t3, at which a skip process is performed, the ECU 50 restarts changing the angle of the VSV 71*a* in the opening direction at time t4, thereby gradually increasing the total purge flow rate Fpgall again.

In the example of FIG. 24, at time t5, following time t4, at which a skip process is performed, the absolute value of the air-fuel ratio F/B central value fafav exceeds the threshold value α due to the positive deviation of the correction value faf. At this time, the ECU 50 considers that the total vapor flow rate actual measurement value Fvps has been overestimated and reduces the total vapor flow rate actual measurement value Fvps by a predetermined value and corrects the air-fuel ratio F/B correction value faf and its center value fafav by a value equivalent to the reduced amount. The ECU 50 interrupts again the alteration of the angle of the VSV 71*a* in the opening direction that has restarted in accordance with the detection of the occurrence of a deviation, and maintains the current angle.

Thereafter, when the stability of the air-fuel ratio F/B correction value faf is confirmed as done at time t6, the ECU 50 restarts changing the angle of the VSV 71*a* in the opening direction, and when the occurrence of a deviation is detected again, the ECU 50 interrupts the alteration of the angle of the VSV 71*a* in the opening direction and corrects the actual measurement value Fvps or the like. The ECU 50 acquires the actual measurement value Fvps while gradually increasing the total purge flow rate Fpgall in the manner exemplified above. The foregoing description has discussed the details of the processes of the ECU 50 that are associated with the adjustment of the total purge flow rate Fpgall before completion of the initialization (adjustment of the VSV angle Dvsv) and the computation of the total vapor flow rate actual measurement value Fvps.

According to the total vapor flow rate actual measurement value Fvps acquired through the above-described processing, the vapor density rvps of the purge gas to the air-intake passage 12 can be grasped even before initialization is completed (rvps←Fvps/Fpgall). The control apparatus initializes the individual physical status quantities (generated-in-tank vapor flow rate Fvptnk, stored-in-air-layer vapor amount Mgair and stored-in-adsorbent vapor amount Mgcan) while monitoring changes in the vapor density rvps.

[2-6-2] Initialization of Generated-in-Tank Vapor Flow Rate

Figure 25:
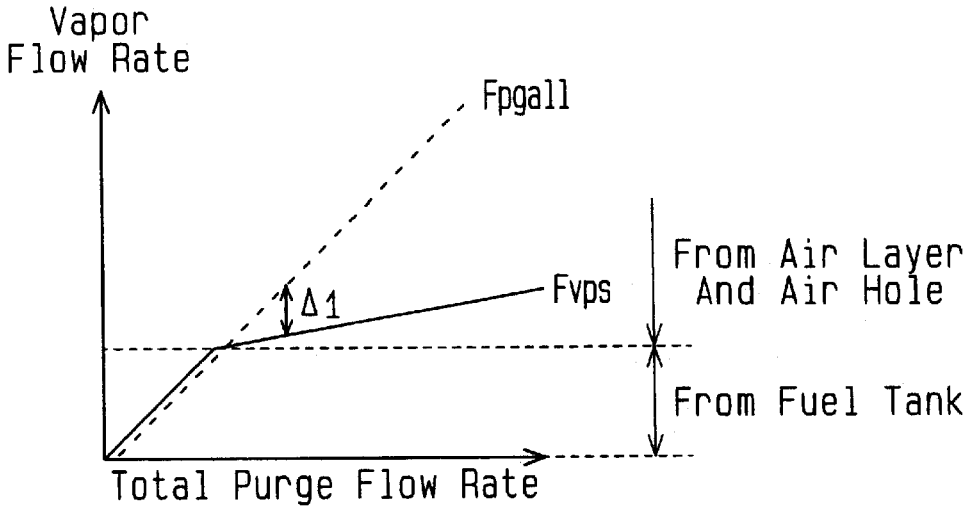
FIG. 25 is a graph showing the relationship between a total purge flow rate and the flow rate of each vapor component.
Figure 26:
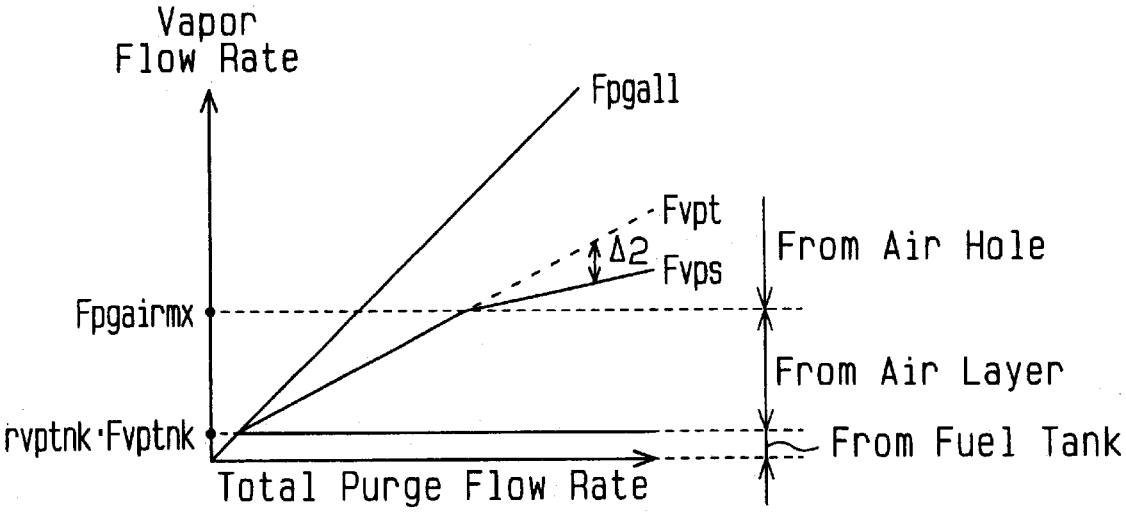
FIG. 26 is a graph showing the relationship between the total purge flow rate and the flow rate of each vapor component.

This section will give a detailed description of the initialization by further referring to FIGS. 25 and 26. To begin with, the details of a process associated with the initialization of the generated-in-tank vapor flow rate will be described by referring to FIG. 25.

As described earlier, when the inner pressure of the fuel tank 30 is higher than the inner pressure of the canister air layer 45 by a predetermined value and more, and the inner-tank-pressure control valve 60 is open, vapor flows into the canister 40 from the fuel tank 30 through the vapor line 35 (see Section [2-1] and FIG. 14). If vapor purging is executed at this time, high-pressure vapor flowing from the fuel tank 30 is led into the purge line 71 by a higher priority over the purge gas from the canister air layer 45 and the air that is led through the atmosphere inlet line 72 or the like.

In a case where the VSV 71*a* is gradually opened from the fully-closed state, therefore, most of the purge gas to the air-intake passage 12 immediately after the angle opening has started is the vapor from the fuel tank 30 that has passed through the canister air layer 45 and flowed directly into the purge line 71. Hereinafter, the vapor that is discharged to the air-intake passage 12 in such a manner is called "flowed-from-tank vapor". It is considered that most of the flowed-from-tank vapor is a vapor component, i.e., the vapor density rvps is 100%.

If the inner-tank-pressure control valve 60 is open to permit the flow-in of the vapor from the fuel tank 30 at the time of starting opening the VSV 71*a* before completion of the initialization, only the flowed-from-tank vapor flows into the air-intake passage 12 just after the valve opening has started. It seems that the flow rate of the flowed-from-tank vapor holds a given ratio to the generated-in-tank vapor flow rate Fvptnk. Therefore, the upper limit of the flowed-from-tank vapor flow rate is determined almost uniquely according to the generated-in-tank vapor flow rate Fvptnk and is acquired from the following calculation expression with the ratio being a constant rvptnk ($0 \leqq rvptnk \leqq 1$).

<<Calculation Expression>>

[flowed-from-tank vapor]←rvptnk·Fvptnk

The value of the constant rvptnk can be acquired through tests or the like as a constant unique to the structure of the vapor purge system.

Such a situation continues until the total purge flow rate Fpgall becomes greater than a certain level and the flow-in of the purge gas of the canister air layer 45 into the purge line 71 or air-layer purging is permitted. During that period, the vapor density rvps in the purge gas to be discharged to the air-intake passage 12 is almost 100%, so that the total purge flow rate Fpgall and the total vapor flow rate actual measurement value Fvps take substantially the same values (Fvps=Fpgall; Fvps/Fpgall=1).

Although the air-layer purge vapor density rvpair increases or decreases depending on the stored-in-air-layer vapor amount Mgair, it is certain that the vapor density rvpair is not 100% (see Section [1-3-1] and FIG. 9 and other associated diagrams). When the total purge flow rate Fpgall goes above the level that permits air-layer purging, an increase in the actual measurement value Fvps becomes smaller than an increase in total purge flow rate Fpgall as shown in FIG. 25, thereby providing a difference between both flow rates which have been substantially the same. Therefore, the initial value of the generated-in-tank vapor flow rate Fvptnk is acquired from the total purge flow rate Fpgall and the actual measurement value Fvps when a significant difference Δ1 is produced therebetween after purging before completion of the initialization has started, as shown in FIG. 25. Specifically, the initial value of the generated-in-tank vapor flow rate Fvptnk is acquired from the calculation expression through backward calculation on the assumption that the total vapor flow rate actual measurement value Fvps when the significant difference has occurred is the same as the flowed-from-tank vapor flow rate Fvptnk (Fvptnk [initial value]←[flowed-from-tank vapor flow rate]/rvptnk) According to the control apparatus, the ECU 50 performs the initialization of the generated-in-tank vapor flow rate Fvptnk when the difference (Fpgall−Fvps) becomes equal to or greater than Δ1.

According to the present embodiment, therefore, the initial value of the generated-in-tank vapor flow rate Fvptnk is acquired by comparing the theoretical value of the total vapor flow rate Fvpall on the assumption that the entire purge component to the air-intake passage 12 consists of the flowed-from-tank vapor (the theoretical value becomes the same as the total purge flow rate Fpgall according to the assumption) with its actual measurement value Fvps. In other words, the initial value of the generated-in-tank vapor flow rate Fvptnk is acquired by comparing the theoretical value (=100%) of the vapor density of the purge gas to the air-intake passage 12 based on the assumption with its actual measurement value (Fvps/Fpgall).

If the inner-tank-pressure control valve 60 is closed during the initialization, the initial value of the generated-in-tank vapor flow rate Fvptnk of course becomes "0". The opening/closing of the inner-tank-pressure control valve 60 can be checked by, for example, a change in the inner pressure of the fuel tank 30 that is detected by the inner tank pressure sensor 32.

[2-6-3] Initialization of Stored-in-Air-Layer Vapor Amount

This section will give a detailed description of a process associated with the initialization of the stored-in-air-layer vapor amount Mgair by referring to FIG. 26.

When the total purge flow rate Fpgall is further increased gradually after the initialization of the generated-in-tank vapor flow rate Fvptnk, the component consists of the flowed-from-tank vapor and the air-layer purge gas.

The air-layer purge vapor density rvpair is obtained uniquely by the stored-in-air-layer vapor amount Mgair and is kept constant if the stored-in-air-layer vapor amount Mgair is constant. The air-layer purge flow rate Fpgair has an upper limit (maximum air-layer purge flow rate Fpgairmx) whose value is also obtained uniquely by the stored-in-air-layer vapor amount Mgair (see Section [1-3-1] and FIG. 9 and other associated diagrams).

As shown in FIG. 25, therefore, an increase in total vapor flow rate actual measurement value Fvps after the total purge flow rate Fpgall has increased above the level that can purge the allowable flowed-from-tank vapor in the vapor purge process before completion of the initialization has a constant ratio. The ratio of an increase in the total vapor flow rate actual measurement value Fvps at that time seems to shift in accordance with the air-layer purge vapor density rvpair that is obtained from the stored-in-air-layer vapor amount Mgair.

Every time the total vapor flow rate actual measurement value Fvps is updated, the ECU 50 acquires a temporary value rvps of the air-layer purge vapor density rvpair in accordance with the updated value in the vapor purge process before completion of the initialization. The vapor density temporary value rvps is estimated to be substantially invariable except that the purge component to the air-intake passage 12 consists only of the flowed-from-tank vapor and the air-layer purge gas. The ECU 50 acquires the vapor density temporary value rvps according to the following calculation expression.

<<Calculation Expression>> rvps←(Fvps−rvptnk·Fvptnk)/(Fpgall−rvptnk·Fvptnk)

Further, the ECU 50 acquires an estimated value Fvpt of the total vapor flow rate with respect to the vapor density temporary value rvps (Fvpt←rvps·Fpgall). The estimated value Fvpt is equivalent to the theoretical value of the total vapor flow rate Fvpall on the assumption that the purge component to the air-intake passage 12 consists only of the flowed-from-tank vapor and the air-layer purge gas.

Thereafter, as the total purge flow rate Fpgall is increased so that the entire air-layer purge gas allowable can be purged, i.e., as the air-layer purge flow rate Fpgair reaches the maximum value Fpgairmx, the desorption-from-adsorbent purge gas is further added to the purge component to the air-intake passage 12. As a result, the vapor density of the purge gas to the air-intake passage 12 changes and the slope of an increase in total vapor flow rate actual measurement value Fvps changes as shown in FIG. 26. This produces a significant difference between the actual measurement value Fvps and the theoretical value Fvpt for the total vapor flow rate Fvpall. Accordingly, the total amount of the air-layer purge component can be grasped and the initial values of the stored vapor amounts Mgair and Mgcan can be acquired based on the total amount. When the difference between the actual measurement value Fvps and the theoretical value Fvpt becomes a predetermined value Δ2, the ECU 50 of the control apparatus executes the initialization process associated with the calculation of the initial values of the stored vapor amounts Mgair and Mgcan.

If a significant difference between the actual measurement value Fvps and the theoretical value Fvpt is noted and the merging of the desorption-from-adsorbent purge gas is confirmed, the maximum value of the air-layer purge flow rate Fpgair or the maximum air-layer purge flow rate Fpgairmx can be acquired from the total purge flow rate Fpgall at that time and the initialized flowed-from-tank vapor flow rate (rvptnk·Fvptnk) (Fpgairmx←Fpgall−rvptnk·Fvptnk). The maximum air-layer vapor flow rate Fvpairmx can be obtained from the total vapor flow rate actual measurement value Fvps and the flowed-from-tank vapor flow rate (rvptnk·Fvptnk) (Fvpairmx←Fvps−rvptnk·Fvptnk). Further, the maximum air-layer purge flow rate Fpgairmx and the maximum air-layer vapor flow rate Fvpairmx are acquired uniquely from the stored-in-air-layer vapor amount Mgair as mentioned above.

Based on the correlations, therefore, the initial value of the stored-in-air-layer vapor amount Mgair can be acquired through backward calculation of the calculation logic for both maximum flow rates Fpgairmx and Fvpairmx.

The ECU 50 in the control apparatus acquires an estimated maximum value tFpgmx of the total purge flow rate Fpgall from the total vapor flow rate actual measurement value Fvps. The estimated maximum value tFpgmx is the theoretical value of the maximum value of the total purge flow rate Fpgall on the assumption that the purge component to the air-intake passage 12 consists only of the flowed-from-tank vapor and the air-layer purge gas. The estimated maximum value tFpgmx is obtained in the following manner.

The value of the air-layer vapor flow rate Fvpair when the assumption is met is a value obtained by subtracting the flowed-from-tank vapor flow rate from the actual measurement value Fvps. The air-layer purge vapor density rvpair has an upper limit as apparent from the correlation between the maximum air-layer vapor flow rate Fvpairmx and the maximum air-layer purge flow rate Fpgairmx with the same stored-in-air-layer vapor amount Mgair (see FIGS. 19 and 21 and other associated diagrams). Therefore, the maximum value of the total purge flow rate Fpgall that is estimated from the actual measurement value Fvps when the largest air-layer purge vapor density rvpair is estimated becomes the estimated maximum value tFpgmx of the total purge flow rate Fpgall. Given that the maximum value of the vapor density rvpair is PRPAIRMX, therefore, the estimated maximum value tFpgmx can be acquired from the following calculation expression.

<<Calculation Expression>>

$$tFpgmx \leftarrow rvptnk \cdot Fvptnk + RVPAIRMX \cdot (Fvps - rvptnk \cdot Fvptnk)$$

The ECU 50 of the control apparatus acquires the estimated maximum value tFpgmx by using the operational map (not shown) that is prestored in the memory of the ECU 50 and indicates the correlation between the actual measurement value Fvps and the estimated maximum value tFpgmx.

In the purge system, the desorbed-from-adsorbent purge vapor density rvpcan normally becomes smaller than the air-layer purge vapor density rvpair. If the desorption-from-adsorbent purge gas is merged into the purge component to the air-intake passage 12, therefore, the rate of an increase in total vapor flow rate actual measurement value Fvps is inclined to decrease as shown in FIG. 26. As a result, as the flow rate of the desorption-from-adsorbent purge gas (inside-adsorbent air flow rate Fpgcan) increases, the difference between the total purge flow rate Fpgall and the estimated maximum value tFpgmx becomes greater.

When the difference between the total purge flow rate Fpgall and the estimated maximum value tFpgmx becomes sufficiently large as compared with the amount of a change in air-layer purge vapor density rvpair with respect to a change in stored-in-air-layer vapor amount Mgair, the merging of the desorption-from-adsorbent purge gas can be confirmed. Even when the difference between the total purge flow rate Fpgall and the estimated maximum value tFpgmx becomes equal to or greater than a predetermined value, therefore, the ECU 50 of the control apparatus initializes the stored-in-air-layer vapor amount Mgair based on the then total vapor flow rate actual measurement value Fvps at that time.

[2-6-4] Initialization of Stored-in-Adsorbent Vapor Amount

This section will give a detailed description of a process associated with the initialization of the remaining stored-in-adsorbent vapor amount Mgcan by referring to FIG. 26.

The stored-in-adsorbent vapor amount Mgcan is uniquely acquired from the desorbed-from-adsorbent purge vapor density rvpcan (see Section [1-3-3] and FIG. 22 and other associated diagrams). If the gradual increase in total purge flow rate Fpgall continues even after completion of the initialization of the stored-in-air-layer vapor amount Mgair and the vapor density rvpcan is obtained from the rate of an increase in total vapor flow rate actual measurement value Fvps, the initial value of the stored-in-adsorbent vapor amount Mgcan can be acquired.

If the initialization of the stored-in-adsorbent vapor amount Mgcan is carried out in the above-described manner, however, vapor purging before completion of the initialization should continue for some time after the initialization of the stored-in-air-layer vapor amount Mgair is completed. This delays the shift to the vapor purge process based on the physical models. The control apparatus therefore acquires the initial values in the following manner so as to initialize the stored-in-adsorbent vapor amount Mgcan at the same time as the initialization of the stored-in-air-layer vapor amount Mgair.

Before the vapor purge process (initialization process) before the completion of the initialization starts, i.e., before the first vapor purge process after the engine is ignited starts, the vapor purge system 20 is held in a steady state over a long period of time. Accordingly, the inside of the canister 40 is in an equilibrium state so that the vapor adsorption speed Fvpatc and the natural desorption speed Fvpcta seem to be balanced with each other (Fvpatc=Fvpcta). Therefore, the control apparatus acquires the initial value of the stored-in-adsorbent vapor amount Mgcan from the initial value of the stored-in-air-layer vapor amount Mgair obtained in the above-described manner on the assumption that the inside of the canister 40 is in an equilibrium state at the beginning of the initialization process.

As described in Section [1-3-3], the vapor adsorption speed Fvpatc and the natural desorption speed Fvpcta are respectively acquired from the following calculation expressions.

$$Fvpatc \leftarrow k1 \cdot Mgair \cdot (VPCANMX - Mgcan)$$

$$Fvpcta \leftarrow k2 \cdot Mgcan$$

Therefore, the stored-in-adsorbent vapor amount Mgcan in the equilibrium state where those speeds are balanced with each other can be acquired from the following calculation expression.

$$Mgcan \leftarrow k1 \cdot VPCANMX \cdot Mgair / (k1 \cdot Mgair + k2)$$

Through the execution of the expression, the initialization of the stored-in-air-layer vapor amount Mgair and the initialization of the stored-in-adsorbent vapor amount Mgcan are completed at the same time, thus ensuring immediate shifting to the vapor purge process based on the physical models. Of course, the control apparatus can be modified in such a way as to initialize the stored-in-adsorbent vapor amount Mgcan based on the rate of an increase in total vapor flow rate actual measurement value Fvps as mentioned above.

[2-7] Process of Correcting Physical Status Quantities (S600 in FIG. 15)

This section will describe a process of correcting physical status quantities in the control apparatus in detail by further referring to FIGS. 27 to 34.

While the values of both vapor amounts Mgair and Mgcan are held adequately through the regular update process (see Section [2-3]), errors may occur in those values. Even slight estimation errors in the values of the vapor amounts Mgair and Mgcan may cause errors in the update amounts of the vapor amounts Mgair and Mgcan at the time of executing the regular update process. Every time the regular update process is repeated, errors are accumulated in the values of the vapor amounts Mgair and Mgcan, eventually leading to a large deviation therebetween. Such a deviation results in an error in the total vapor flow rate Fvpall that is estimated based on the erred values, and eventually an error in the estimation of the purge correction value fpg.

In air-fuel ratio F/B control, the air-fuel ratio learned value KG is set in such a way that the center value fafav of the air-fuel ratio F/B correction value faf is held near "0". Hereinafter, the center value fafav is simply called "air-fuel ratio F/B center" unless otherwise specified. Even during vapor purging, the air-fuel ratio F/B control continues as if there seemed to be no influence of vapor purging by absorbing the influence of the purge gas to be discharged to the air-intake passage 12 with the purge correction value fpg. If the estimation of the purge correction value fpg contains an error, therefore, the air-fuel ratio F/B center would deviate from near "0" as vapor purging is executed (see Section [2-4]).

In this respect, the control apparatus monitors a change in the air-fuel ratio F/B center during purging and executes a process of correcting the values of the stored-in-air-layer vapor amount Mgair and stored-in-adsorbent vapor amount Mgcan in accordance with the detection of a deviation in the monitored change. Strictly speaking, the control apparatus detects such a deviation in air-fuel ratio F/B center in the correcting process based on the progressive change fafsm of the center value fafav.

Figure 27:
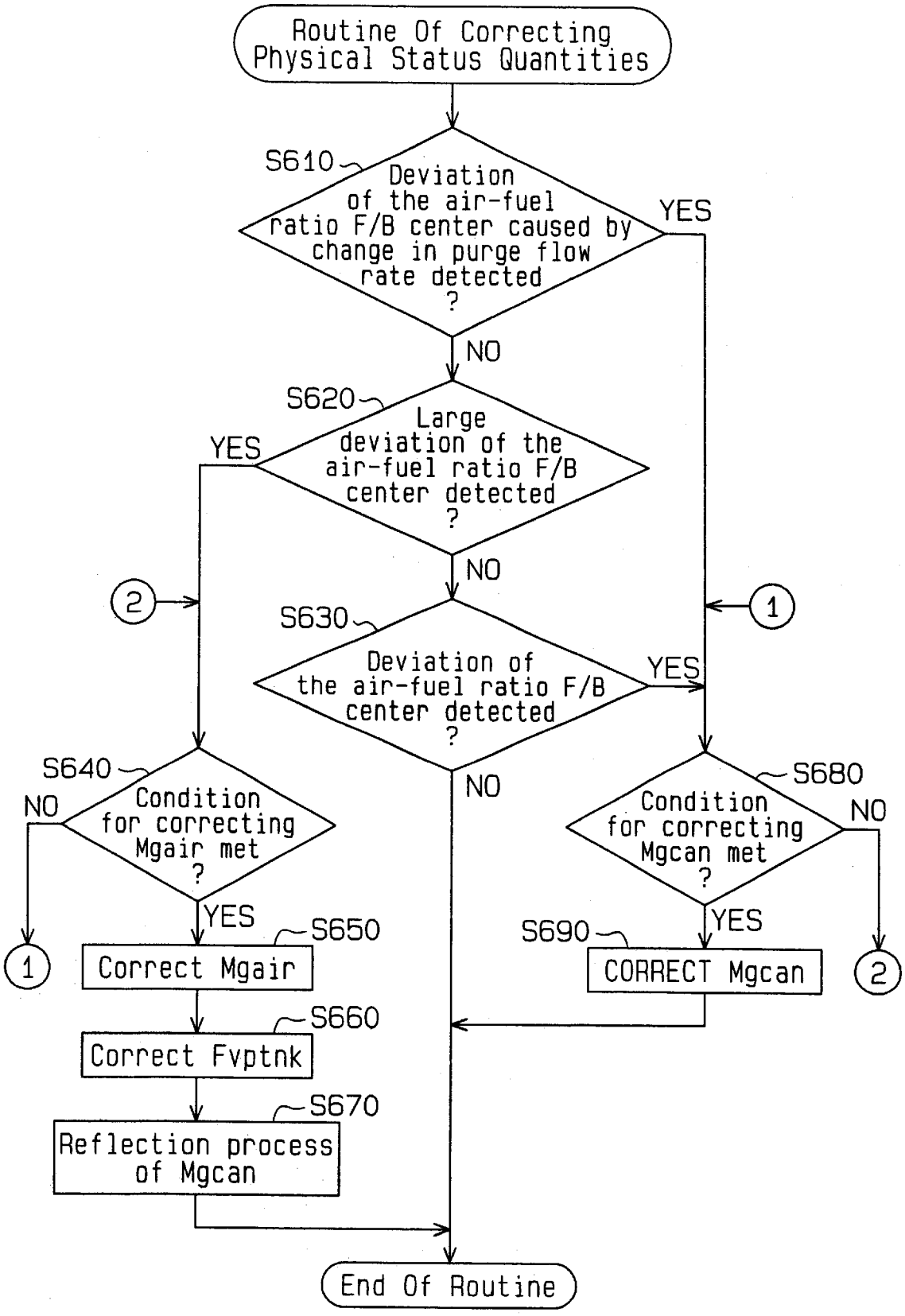
FIG. 27 is a flowchart illustrating procedures of a routine of correcting the physical status quantity.

FIG. 27 illustrates a "routine of correcting the physical status quantities" in the correcting process. The ECU 50 executes this routine following the process of computing the purge correction value (see Section [2-4]). The details of the correcting process in the control apparatus will be described below by further referring to FIG. 27.

As shown in FIG. 27, the ECU 50 selects those values of both vapor amounts Mgair and Mgcan which are needed for correction according to the mode for the deviation of the air-fuel ratio F/B center (S610 to S630 in FIG. 27) and corrects the selected values.

[2-7-1] Decision of Factor for Deviation of Air-Fuel Ratio F/B Center (S610 to S630)

The mode for the deviation of the air-fuel ratio F/B center would differ between when the value of the stored-in-air-layer vapor amount Mgair associated with the calculation of the air-layer vapor flow rate Fvpair contains an error and when the value of the stored-in-adsorbent vapor amount Mgcan associated with the calculation of the desorbed-from-adsorbent vapor flow rate Fvpcan contains an error.

The value of the stored-in-air-layer vapor amount Mgair abruptly varies greatly in accordance with a change in the air-layer purging state caused by a change in the engine running condition, such as the air-intake passage internal pressure PM during purging. The value Mgair is also abruptly changed significantly by the vapor generating state in the fuel tank 30, i.e., a change in generated-in-tank vapor flow rate Fvptnk. Further, as the purge component of the air-layer purge gas is the purge gas in the canister air layer 45 itself, an error in stored-in-air-layer vapor amount Mgair is delicately reflected on the estimation of the air-layer vapor flow rate Fvpair. If the stored-in-air-layer vapor amount Mgair contains an error, therefore, a large and abrupt deviation occurs around the air-fuel ratio F/B center during vapor purging.

A change in the vapor amount stored in the adsorbent of the canister 40 (stored-in-adsorbent vapor amount Mgcan) is relatively gentle. An error in stored-in-adsorbent vapor amount Mgcan is only reflected as an error in desorbed-from-adsorbent purge vapor density rvpcan and its influence on the value of the desorbed-from-adsorbent vapor flow rate Fvpcan itself is relatively small. In case where the stored-in-adsorbent vapor amount Mgcan contains an error, therefore, the deviation of the air-fuel ratio F/B center (fafsm[can]) gently occurs in a mode corresponding to a change in total purge flow rate Fpgall as exemplified in FIG. 28.

The control apparatus uses different progressive changes fafsm for the air-fuel ratio F/B center value fafav for the correction of the stored-in-air-layer vapor amount Mgair and for the correction of the stored-in-adsorbent vapor amount Mgcan as the index value of air-fuel ratio F/B center used in the correction. A progressive change fafsm[air] for the correction of the stored-in-air-layer vapor amount Mgair is set in such a way that its property of response to a change in air-fuel ratio F/B center value fafav is greater than that of a progressive change fafsm[can] for the correction of the stored-in-adsorbent vapor amount Mgcan. The degrees of the properties of response to a change in air-fuel ratio F/B center value fafav can be set adequately by adjusting parameters, such as the progressive change ratios of the progressive changes fafsm[air] and fafsm[can] and the value update periods.

The control apparatus is designed to perform the correcting process by selectively using the progressive changes with different response properties in accordance with the inclination of the influence of an error in each value Mgair or Mgcan on the deviation of the air-fuel ratio F/B center. The control apparatus can therefore more precisely determine values to be corrected according to the deviation of the air-fuel ratio F/B center and set the correction amounts.

More specifically, as shown in FIG. 27, the ECU 50 makes an error decision on a value to be corrected in the following manner.

(Error Decision on Stored-in-Adsorbent Vapor Amount Mgcan)

The ECU 50 decides that the deviation of the air-fuel ratio F/B center according to a change in total purge flow rate Fpgall is detected when any one of error conditions (a) and (b) given below is met (S610: YES). As long as a predetermined correcting condition (see Section [2-7-2]) is met (S680: YES), the ECU 50 corrects the value of the stored-in-adsorbent vapor amount Mgcan (S690).

(a) A difference in total purge flow rate Fpgall (or maybe inside-adsorbent air flow rate Fpgcan) between the time when the air-fuel ratio F/B center is stable and the time when the air-fuel ratio F/B center is deviated is equal to or greater than a certain value. The control apparatus decides that the air-fuel ratio F/B center is stable when a decision expression al given below is satisfied and decides that the air-fuel ratio F/B center is deviated when a decision expression a2 given below is satisfied.

<<Decision Expressions>>

$$|fafsm[can]|<SFFAFSMCAN \quad (a1)$$

$$|fafsm[can]|>ERFAFSMCAN \quad (a2)$$

"SFFAFSMCAN" in the decision expression (a1) is a stability decision value for fafsm[can] and its value is set to a predetermined constant in such a way that when the decision expression (a1) is satisfied, the air-fuel ratio F/B center stays around "0". "ERFAFSMCAN" in the decision expression (a2) is a deviation decision value for fafsm[can] and is a predetermined constant which is set based on the results of test or the like (SFFAFSMCAN<ERFAFSMCAN).

(b) A change in total purge flow rate Fpgall (or maybe inside-adsorbent air flow rate Fpgcan) continues longer than a predetermined period and the deviation of the absolute amount of the injection correction on the side according to the change in flow rate continues over that predetermined period.

Figure 28:
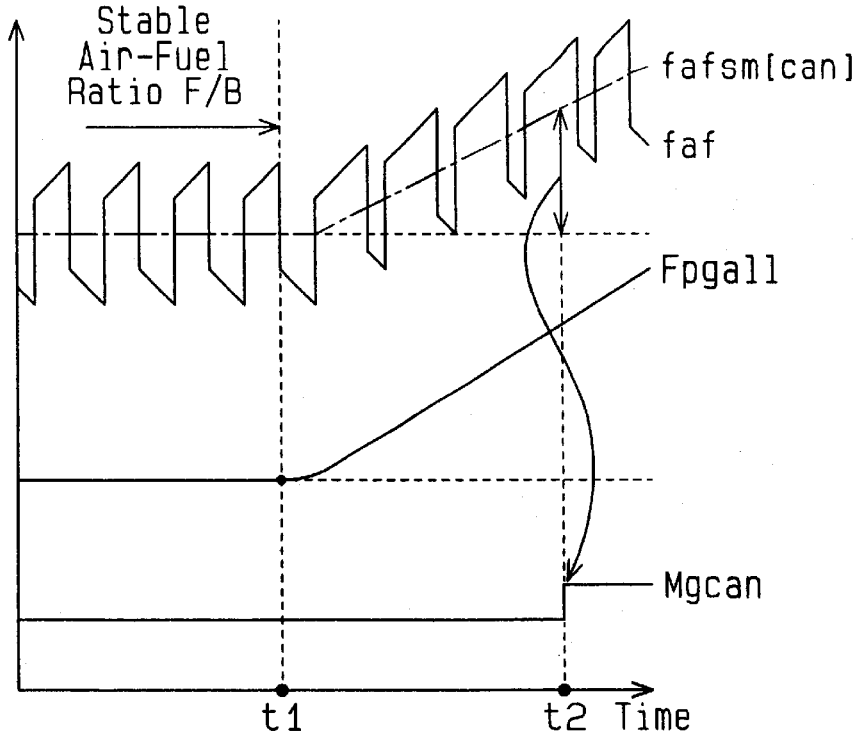
FIG. 28 is a time chart exemplifying a control mode associated with correction of the stored-in-adsorbent vapor amount.

FIG. 28 shows changes in individual parameters when the deviation of the air-fuel ratio F/B center occurs due to a change in total purge flow rate Fpgall. In FIG. 28, before time t1 is a state where the air-fuel ratio F/B center is stable (the expression (a1) is met) and at time t2 it is determined that there is the deviation of the air-fuel ratio F/B center (the expression (a2) is met).

Even when both of the error conditions (a) and (b) are not satisfied (S610: NO), the ECU 50 decides that the air-fuel ratio F/B center has some deviation, which is not too large but is not negligible, (S630: YES) when the following decision expressions (c1) and (c2) are both satisfied. In this case too, as long as the predetermined correcting condition (see Section [2-7-2]) is met (S680: YES), the ECU 50 corrects the value of the stored-in-adsorbent vapor amount Mgcan (S690).

<<Decision Expressions>>

$$|fafsm[can]|>ERFAFSMCAN \quad (c1)$$

$$|fafsm[air]|\leqq ERFAFSMAIR \quad (c2)$$

"ERFAFSMAIR" is a deviation decision value for fafsm [air]. When the expression (c2) is not met, it is determined that the air-fuel ratio F/B center has a large deviation.

(Error Decision on Stored-in-Air-Layer Vapor Amount Mgair)

When either one of the following decision expressions (d1) and (d2) is satisfied, the ECU 50 decides that the air-fuel ratio F/B center has a large deviation (S620: YES).

<<Decision Expressions>>

$$|fafsm[air]|>ERFAFSMAIR \quad (d1)$$

$$|faf|>ERFAFAIR \quad (d2)$$

When the decision expression d1 is satisfied and a predetermined correcting condition (see Section [2-7-3]) is met (S640: YES), the ECU 50 corrects the value of the stored-in-air-layer vapor amount Mgair (S650).

Note that the deviation decision values ERFAFAIR, ERFAFSMAIR and ERFAFSMCAN are set as predetermined constants equivalent to the air-fuel ratio F/B correction value faf when the deviation of the air-fuel ratio F/B center has reached a non-allowable level and the progressive changes fafsm[air] and fafsm[can] of the center value fafav (ERFAFAIR>ERFAFSMAIR>ERFAFSMCAN).

[2-7-2] Process of Correcting Stored-in-Adsorbent Vapor Amount Mgcan (S680 and S690 in FIG. 24)

This section will give a detailed description of a process of correcting the stored-in-adsorbent vapor amount Mgcan which is executed in accordance with the result of the above-described decision process.

As shown in FIG. 27, when either one of the following conditions is met, the ECU 50 determines whether or not the correcting condition for the stored-in-adsorbent vapor amount Mgcan is satisfied (S680).

It is determined through the decision process that correction of the stored-in-adsorbent vapor amount Mgcan is needed (S610: YES or S630: YES).

While a request for correcting the stored-in-air-layer vapor amount Mgair is made, the correcting condition for the vapor amount Mgair is not satisfied (S640: NO).

The correcting condition for the stored-in-adsorbent vapor amount Mgcan is set in such a way that the vapor amount Mgcan is not corrected inadequately. The following gives some conditions under which the correcting condition is not met.

(1) The inside-adsorbent air flow rate Fpgcan is less than a predetermined flow rate.

(2) The current value of the stored-in-adsorbent vapor amount Mgcan has already reached the upper or lower limit of the allowable setting range and a request for correcting the vapor amount Mgcan outside the allowable setting range has been made.

When the condition (1) is met, it is assumed that desorption-from-adsorbent purging to the extent to influence the air-fuel ratio F/B has not been carried out actually and the stored-in-air-layer vapor amount Mgair has an error.

The allowable setting range for the stored-in-adsorbent vapor amount Mgcan under the condition (2) is defined by the following two guards. No matter what correction request is made, the deviation of the stored-in-adsorbent vapor amount Mgcan from the allowable setting range is inhibited by the correction disabling condition (2).

Absolute value guard: The allowable setting range for the stored-in-adsorbent vapor amount Mgcan is defined by the amount of vapor adsorbable in the adsorbent. That is, the allowable setting range for the value of the stored-in-adsorbent vapor amount Mgcan is equal to or greater than "0" and is equal to or smaller than the maximum adsorption amount VPCANMX that is the maximum amount of vapor that is permitted to be adsorbed in the adsorbent.

Relative value guard: If vapor purging is performed properly after the ignition of the engine to sufficiently desorb the adsorbed vapor, even when a lot of vapor flows in from the fuel tank 30, the canister air layer 45 serves as a buffer to suppress a rapid increase in the amount of vapor adsorbed in the adsorbent or the stored-in-adsorbent vapor amount Mgcan. Therefore, it is theoretically possible, but is actually hardly possible for the desorbed-from-adsorbent purge vapor density rvpcan to increase rapidly after sufficient desorption is performed after the ignition of the engine.

Therefore, the minimum value of the vapor density rvpcan after the ignition of the engine is memorized and the upper limit of the stored-in-adsorbent vapor amount Mgcan is defined in such a way that the vapor density rvpcan which is estimated according to the physical models does not exceed a value obtained by adding a predetermined value to the minimum value. It is desirable to memorize the minimum value after sufficient desorption is performed, such as the inside of the canister 40 being warmed up sufficiently, the air-fuel ratio F/B being in a stable state or the total purge flow rate Fpgall being equal to or greater than a predetermined value, and when the reliability of the estimated value of the vapor density rvpcan is sufficient.

When the correcting condition is satisfied (S680: YES), the ECU 50 executes a process of correcting the stored-in-adsorbent vapor amount Mgcan in the following manner (S690).

It can be assumed that the cause for the deviation of the air-fuel ratio F/B center (fafsm[can]) at that time is an error in purge correction value fpg that is originated from an error in the estimation of the desorbed-from-adsorbent vapor flow rate Fvpcan. The desorbed-from-adsorbent vapor flow rate Fvpcan is acquired as the product of the desorbed-from-adsorbent purge vapor density rvpcan and the inside-adsorbent air flow rate Fpgcan and the vapor density rvpcan is uniquely acquired from the stored-in-adsorbent vapor amount Mgcan (see Sections [1-3-3] and [2-4-2] and FIG. 22 and other associated diagrams). It is therefore possible to acquire the amount of correction of the stored-in-adsorbent vapor amount Mgcan by obtaining an error in desorbed-from-adsorbent vapor flow rate Fvpcan which is equivalent to the deviation of the air-fuel ratio F/B center and in accordance with an estimated error in vapor density rvpcan that is grasped from the error in Fvpcan (see FIG. 28).

The ECU 50 in the control apparatus executes a process of correcting the stored-in-adsorbent vapor amount Mgcan according to the following calculation expressions in order.

<<Calculation Expressions>>

$$\Delta rvpcan \leftarrow fafsm[can]/Fpgcan$$

$$rvpcan[corrected\ value] \leftarrow rvpcan[current\ value] + \Delta rvpcan$$

$$\Delta Mgcan \leftarrow fnc.\{rvpcan[corrected\ value]\}$$

$$Mgcan[corrected\ value] \leftarrow Mgcan[current\ value] + \Delta Mgcan$$

"Δrvpcan" indicates the estimated error in vapor density rvpcan, and "ΔMgcan" indicates the amount of correction of the stored-in-adsorbent vapor amount Mgcan. The function fnc.{rvpcan [corrected value]} is a backward function of a calculation logic for the vapor density rvpcan associated with the process of calculating the desorbed-from-adsorbent vapor flow rate Fvpcan and is acquired based on the correlation between the stored-in-adsorbent vapor amount Mgcan and the vapor density rvpcan, which is shown by an operational map as exemplified in FIG. 22.

When the correcting condition is not met (S680: NO), the ECU 50 goes to a process of correcting the stored-in-air-layer vapor amount Mgair (S640). That is, in a situation which is not suitable for the correction of the stored-in-adsorbent vapor amount Mgcan, even if a request for correcting the value Mgcan has been made, the value of the stored-in-air-layer vapor amount Mgair is corrected to prevent the current purge correction value fpg from being unfitted.

[2-7-3] Process of Correcting Stored-in-Air-Layer Vapor Amount Mgair (S640 and S650)

This section will give a detailed description of a process of correcting the stored-in-air-layer vapor amount Mgair which is executed in accordance with the result of the above-described decision process, by further referring to FIGS. 29 to 32.

As shown in FIG. 27, when either one of the following conditions is met, the ECU 50 determines whether or not the correcting condition for the stored-in-air-layer vapor amount Mgair is satisfied (S640).

It is determined through the decision process that correction of the stored-in-air-layer vapor amount Mgair is needed (S620: YES).

While a request for correcting the stored-in-adsorbent vapor amount Mgcan is made, the correcting condition for the vapor amount Mgcan is not satisfied (S680: NO).

The correcting condition for the stored-in-air-layer vapor amount Mgair is set in such a way that the vapor amount Mgair is not corrected inadequately. The following gives some conditions under which the correcting condition is not met.

(1) The deviation of the air-fuel ratio F/B center in the direction of reducing the fuel injection amount Qfin is detected and a value obtained by adding the amount of the deviation to the current air-layer vapor flow rate Fvpair (the air-layer vapor flow rate Fvpair after correction) has not reached the current maximum air-layer vapor flow rate Fvpairmx.

Figure 32:
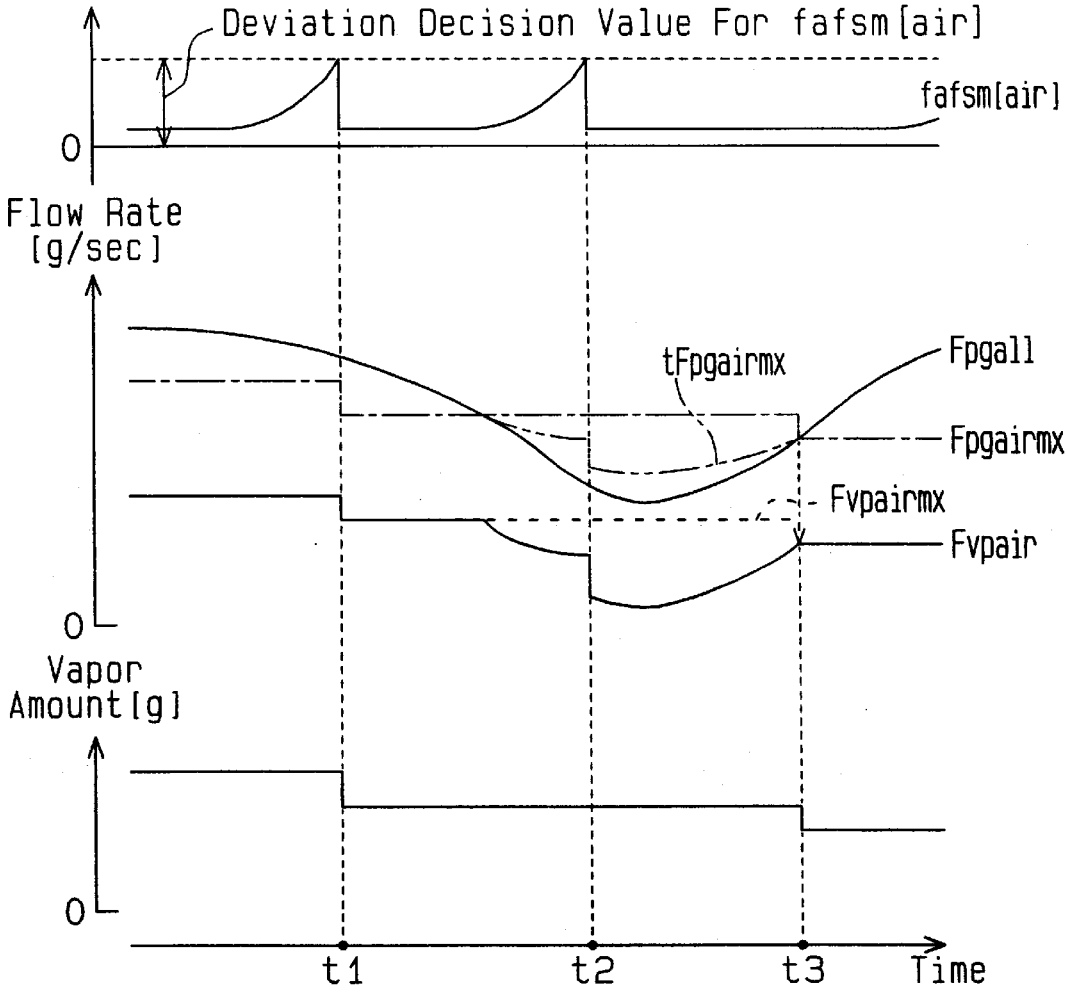
FIG. 32 is a time chart showing a control mode associated with correction of the stored-in-air-layer vapor amount.

(2) The deviation of the air-fuel ratio F/B center in the direction of reducing the fuel injection amount Qfin is detected and the current total purge flow rate Fpgall has not reached an assumed value tFpgairmx of the maximum air-layer purge flow rate Fpgairmx (time t2 in FIG. 32). The assumed value tFpgairmx is a theoretical value of the maximum air-layer purge flow rate Fpgairmx when the current air-layer vapor flow rate Fvpair is assumed to be maximum or the maximum air-layer vapor flow rate Fvpairmx.

(3) The current value of the stored-in-air-layer vapor amount Mgair has already reached the upper or lower limit of the allowable setting range and a request for correcting the vapor amount Mgair outside the allowable setting range has been made.

The allowable setting range for the stored-in-air-layer vapor amount Mgair under the condition (3) is defined by the amount of vapor which can physically exist in the canister air layer 45. The allowable setting range for the value of the stored-in-air-layer vapor amount Mgair is equal to or greater than "0" and is equal to or smaller than an air-layer saturated vapor amount VPAIRMX that is the upper limit of vapor that is permitted to exist in the canister air layer 45. The air-layer saturated vapor amount VPAIRMX is acquired as a constant which is determined in accordance with the volume of the canister air layer 45 (the volume of air present in the canister air layer 45).

When the correcting condition is satisfied (S640: YES), the ECU 50 executes a process of correcting the stored-in-air-layer vapor amount Mgair in the following manner.

Figure 29:
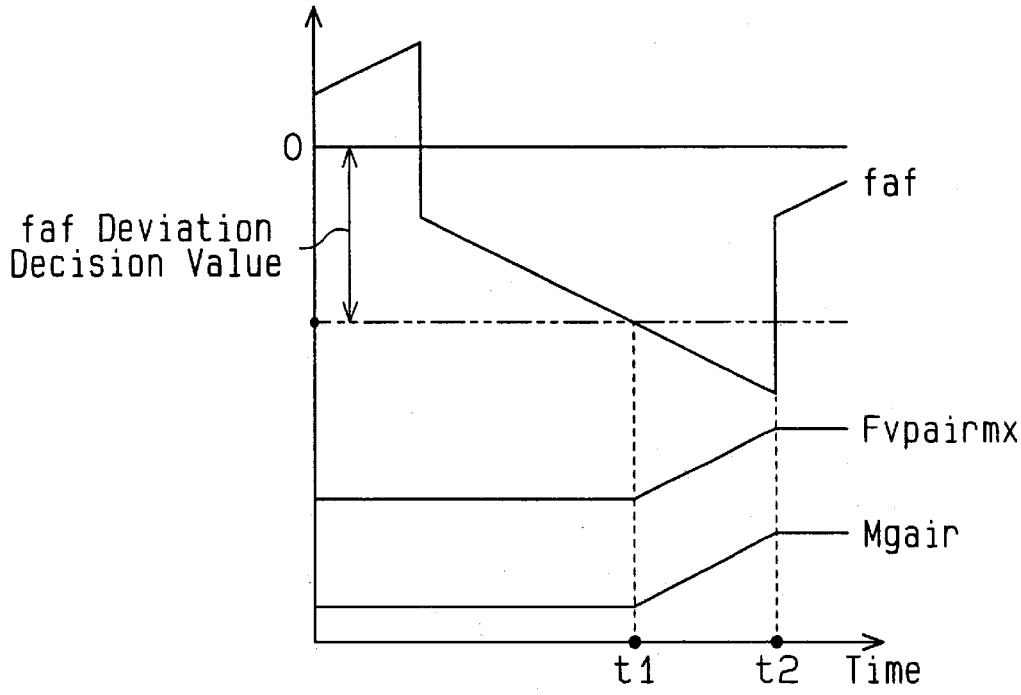
FIG. 29 is a time chart showing a control mode associated with correction of the stored-in-air-layer vapor amount.

When a large deviation of the air-fuel ratio F/B correction value faf itself which meets the decision expression (d2) is detected (|faf|>ERFAFAIR), the ECU 50 corrects the maximum air-layer vapor flow rate Fvpairmx by a predetermined rate while this deviation of the correction value faf is detected, as shown in FIG. 29. That is, during that period, the ECU 50 corrects the maximum air-layer vapor flow rate Fvpairmx by a predetermined value every predetermined period. Based on the correlation indicated by the operational map exemplified in FIG. 21, the ECU 50 corrects the stored-in-air-layer vapor amount Mgair in accordance with the maximum air-layer vapor flow rate Fvpairmx.

When a large deviation of the air-fuel ratio F/B center which meets the decision expression (d1) is detected (|fafsm

Figure 30:
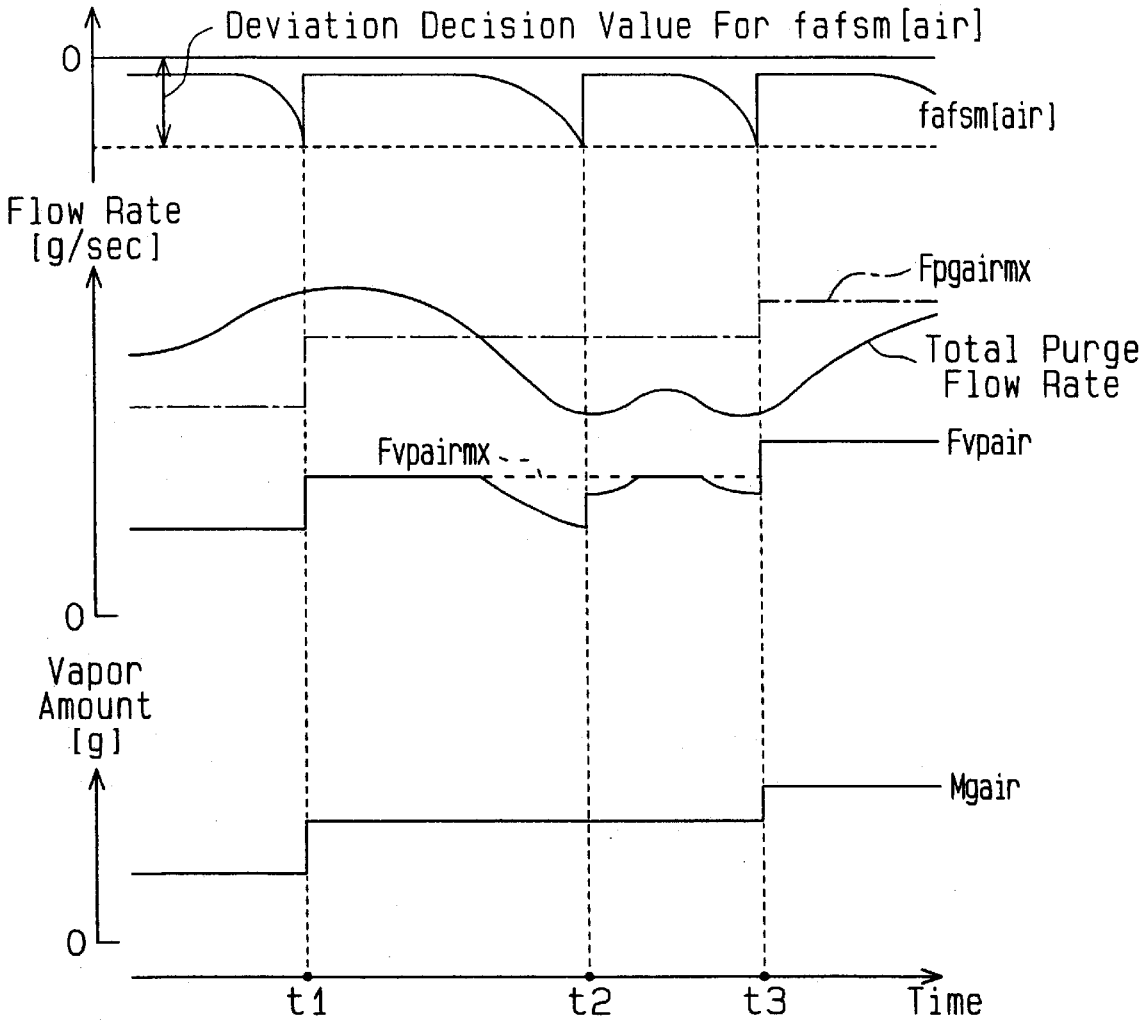
FIG. 30 is a time chart showing a control mode associated with correction of the stored-in-air-layer vapor amount.
Figure 31:
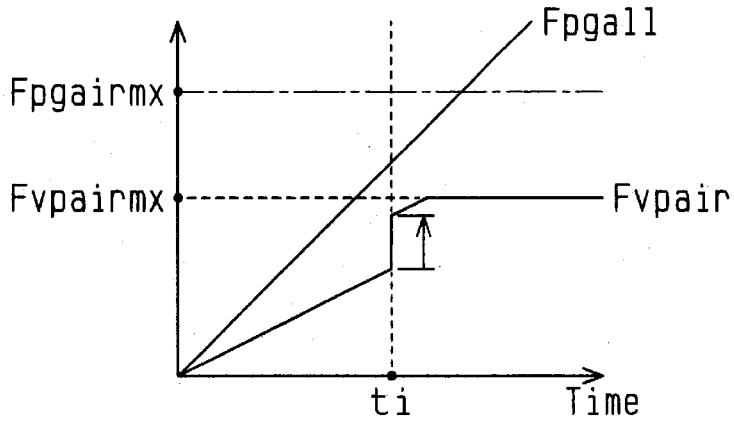
FIG. 31 is a time chart showing a control mode associated with correction of the stored-in-air-layer vapor amount.

[air]]>ERFAFSMAIR), the ECU 50 executes a process of correcting the stored-in-air-layer vapor amount Mgair in a manner exemplified in FIGS. 30 to 32.

It can be assumed that the cause for the then deviation of the air-fuel ratio F/B center (fafsm[air]) is an error in purge correction value fpg that is originated from an error in the estimation of the air-layer vapor flow rate Fvpair. When a value obtained by adding the amount of the deviation of the air-fuel ratio F/B center to the air-layer vapor flow rate Fvpair exceeds the current maximum air-layer vapor flow rate Fvpairmx, it is possible to estimate that the current maximum air-layer vapor flow rate Fvpairmx contains an estimation error.

Therefore, the ECU 50 in the control apparatus executes the process of correcting the stored-in-air-layer vapor amount Mgair according to the following calculation expressions in order.

<<Calculation Expressions>>

Fvpairmx[corrected value]←Fvpair[current value]+fafsm[air]

Mgair[corrected value]←fnc.{Fvpairmx[current value]}

The function fnc.{Fvpairmx[current value]} is a backward function of a calculation logic for the maximum air-layer vapor flow rate Fvpairmx (see Section [2-4-2] and other associated sections) and is acquired based on the correlation between the stored-in-air-layer vapor amount Mgair and the maximum air-layer vapor flow rate Fvpairmx, which is shown by the operational map as exemplified in FIG. 21. At time t1 or time t3 in FIG. 30 and at time t1 or time t3 in FIG. 32, the correction of the stored-in-air-layer vapor amount Mgair is carried out in the above-described manner.

(Process When the Correcting Condition for Stored-in-Air-Layer Vapor Amount Mgair is not Met)

When the correcting condition is not met because of the condition (1), the ECU 50 of the control apparatus performs the following process.

When the condition (1) is met as done at time t2 in FIG. 30, not all the allowable air-layer purge gas is purged to the air-intake passage 12 and the amount of the deviation of the air-fuel ratio F/B center shows only a portion of the required amount of correction of the maximum air-layer vapor flow rate Fvpairmx. Under such a circumstance, therefore, the required amount of correction of the maximum air-layer vapor flow rate Fvpairmx cannot be obtained adequately, thus disabling the proper correction of the stored-in-air-layer vapor amount Mgair.

When the condition (1) is met, therefore, the ECU 50 inhibits the correction of the stored-in-air-layer vapor amount Mgair for the time being. Then, a value obtained by adding the deviation of the air-fuel ratio F/B center to the computed value of the air-layer vapor flow rate Fvpair according to the current stored-in-air-layer vapor amount Mgair held is a temporary value of the air-layer vapor flow rate Fvpair, as exemplified in FIG. 31. This prevents the the current purge correction value fpg from being unfitted for the time being.

At time t3 in FIG. 30, the current total purge flow rate Fpgall is lower than the maximum air-layer vapor flow rate Fvpairmx that is estimated from the value of the air-layer vapor flow rate Fvpair after correction or the value of the air-layer vapor flow rate Fvpair after the deviation of the air-fuel ratio F/B center is corrected. At this time, not all the allowable air-layer purge gas is purged to the air-intake passage 12 so that it is not possible to adequately grasp the maximum air-layer purge flow rate Fpgairmx that should originally be or strictly acquire the corrected value of the stored-in-air-layer vapor amount Mgair. It is, however, certain that the maximum air-layer purge flow rate Fpgairmx that should originally be is at least equal to or greater than the theoretical value that is estimated from the value of the air-layer vapor flow rate Fvpair after correction. In this case, the correction of the stored-in-air-layer vapor amount Mgair is carried out according to the above calculation expressions to correct the vapor amount Mgair within a predictable range.

When the correcting condition is not met because of the condition (2), the ECU 50 of the control apparatus performs the following process.

When the condition (2) is met as done at time t2 in FIG. 32, not all the allowable air-layer purge gas is purged to the air-intake passage 12, so that the required correction amount of the maximum air-layer vapor flow rate Fvpairmx cannot be estimated adequately. In this case too, the ECU 50 holds the current value of the stored-in-air-layer vapor amount Mgair and simply corrects the air-layer vapor flow rate Fvpair by the deviation of the air-fuel ratio F/B center, so that the current purge correction value fpg is prevented from being unfitted.

When the correcting condition is not met because of the condition (3), the ECU 50 goes to the process of correcting the stored-in-adsorbent vapor amount Mgcan (S680). That is, if the correction of the stored-in-air-layer vapor amount Mgair is disabled in order to restrict deviation from the allowable setting range, the current purge correction value fpg is prevented from being unfitted by correcting the value of the stored-in-adsorbent vapor amount Mgcan even if a request for correcting the vapor amount Mgair has been made.

In each of the above-described cases, when the adequate correction of the stored-in-air-layer vapor amount Mgair becomes possible, i.e., when the total purge flow rate Fpgall exceeds the theoretical value of the maximum air-layer vapor flow rate Fvpairmx that is estimated from the air-layer vapor flow rate Fvpair after the correction, the stored-in-air-layer vapor amount Mgair is corrected to the proper value.

When both vapor amounts Mgair and Mgcan reach the upper and lower limits of the allowable setting range, disabling the correction of either value, the current purge correction value fpg can be prevented from being unfitted by performing one of the following processes.

Considering that the upper limits VPAIRMX and VPCANMX of the allowable setting range contain estimation errors originated from changes in passage of the time or a difference in individual, at least one of the upper limits VPAIRMX and VPCANMX is corrected to permit correction.

Considering that the air-fuel ratio learned value KG contains an error, the air-fuel ratio learned value KG is corrected in accordance with the deviation of the air-fuel ratio F/B center.

The foregoing description has discussed the details of the process associated with the correction of the stored-in-air-layer vapor amount Mgair. The ECU 50 of the control apparatus executes a process of correcting the generated-in-tank vapor flow rate Fvptnk (S660) and a process of reflecting the stored-in-adsorbent vapor amount Mgcan (S670) following the process of correcting the stored-in-air-layer vapor amount Mgair.

[2-7-4] Process of Reflecting Stored-in-Adsorbent Vapor Amount Mgcan (S670)

Figure 33:
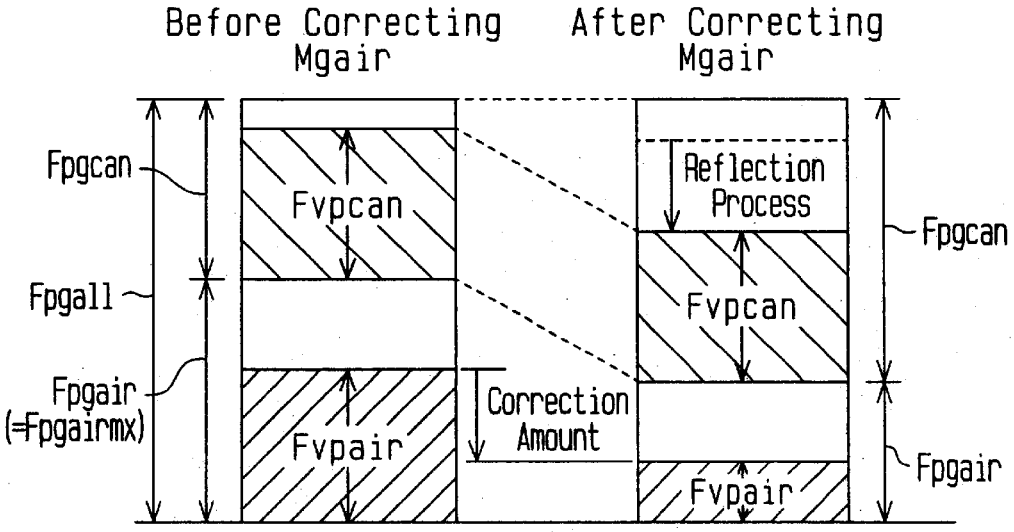
FIG. 33 is a time chart showing a control mode associated with a reflection process.

As shown in FIG. 33, when the value of the stored-in-air-layer vapor amount Mgair is corrected, the value of the maximum air-layer purge flow rate Fpgairmx changes accordingly (FIG. 33 exemplifies the down correction of the stored-in-air-layer vapor amount Mgair). Note, however, that as the total purge flow rate Fpgall does not change in the correcting process, the value of the inside-adsorbent air flow rate Fpgcan also changes according to the correction of the stored-in-air-layer vapor amount Mgair. That is, the inside-adsorbent air flow rate Fpgcan or the amount of an "increase/decrease" in maximum air-layer purge flow rate Fpgairmx made by the correcting process is "decreased/increased" (ΔFpgairmx=−ΔFpgcan). If the current value of the stored-in-adsorbent vapor amount Mgcan, i.e., the value before the correction of the stored-in-air-layer vapor amount Mgair is maintained, the inside-adsorbent air flow rate Fpgcan changes while keeping the desorbed-from-adsorbent purge vapor density rvpcan constant. As a result, the estimated value of the desorbed-from-adsorbent vapor flow rate Fvpcan also changes, so that the purge correction value fpg that should become fitted in the correcting process becomes unfitted.

Considering that the stored-in-adsorbent vapor amount Mgcan has absorbed an error in stored-in-air-layer vapor amount Mgair, therefore, the ECU 50 of the control apparatus executes the process of reflecting the stored-in-adsorbent vapor amount Mgcan in addition to the correcting process (S670 in FIG. 27). The reflecting process is to correct the stored-in-adsorbent vapor amount Mgcan in such a way that the value of the desorbed-from-adsorbent vapor flow rate Fvpcan before and after the correcting process is kept constant.

The corrected value of the stored-in-adsorbent vapor amount Mgcan in the reflecting process (the value after the reflecting process) is obtained in the following manner. First, the desorbed-from-adsorbent purge vapor density rvpcan after the reflecting process is obtained from the value of the inside-adsorbent air flow rate Fpgcan that has been changed according to the correction of the stored-in-air-layer vapor amount Mgair and the value of the desorbed-from-adsorbent vapor flow rate Fvpcan before the correcting process. Then, the corrected value of the stored-in-adsorbent vapor amount Mgcan in the reflecting process is computed from the obtained vapor density rvpcan after the reflecting process based on the correlation between the vapor density rvpcan exemplified in FIG. 22 and the stored-in-adsorbent vapor amount Mgcan.

[2-7-5] Process of Correcting Generated-in-Tank Vapor Flow Rate Fvptnk (S660)

The cause that demands the correction of the stored-in-air-layer vapor amount Mgair in the correcting process seems to the accumulation of update errors of the vapor amount Mgair in the regular update process that have originated from the estimation error of the generated-in-tank vapor flow rate Fvptnk. Therefore, the ECU 50 of the control apparatus executes the process of correcting the generated-in-tank vapor flow rate Fvptnk in a mode exemplified in FIG. 34 in addition to the correcting process for the stored-in-air-layer vapor amount Mgair (S660 in FIG. 27).

Figure 34:
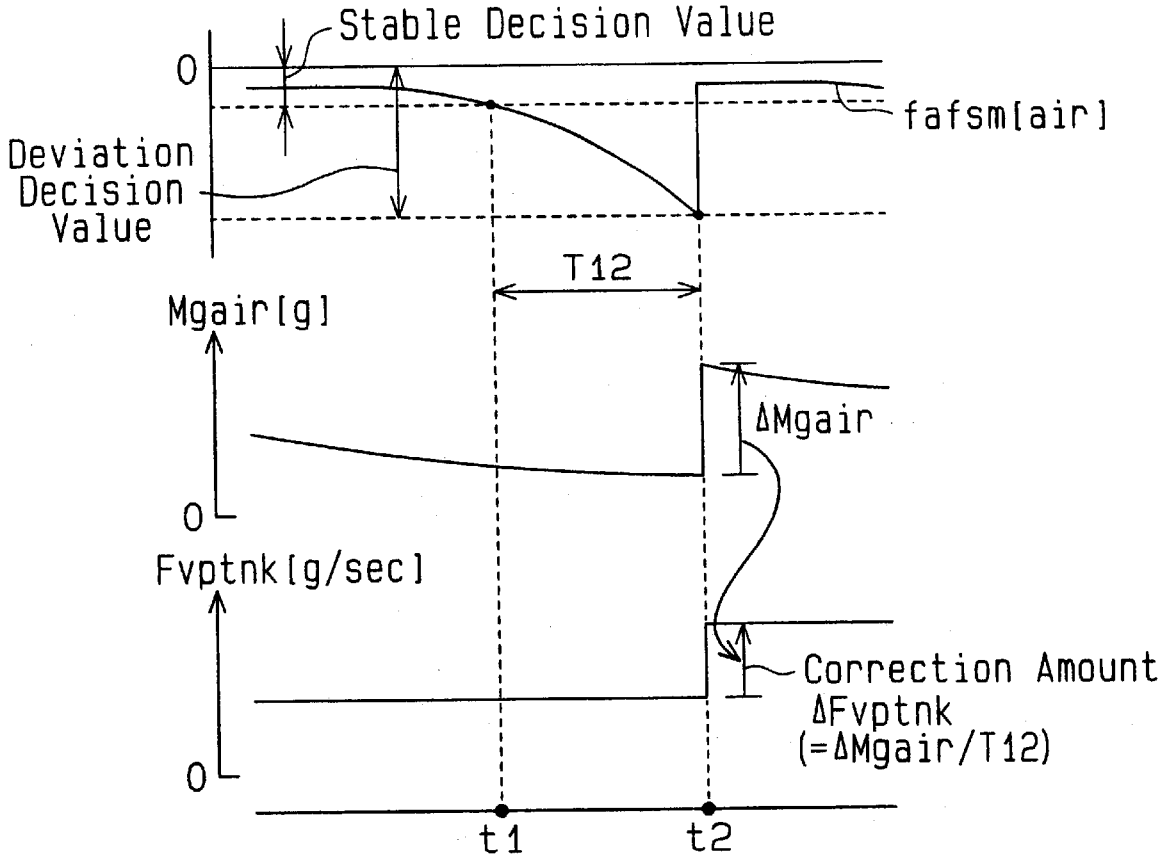
FIG. 34 is a time chart showing a control mode associated with correction of a generated-in-tank vapor flow rate.
Figure 35:
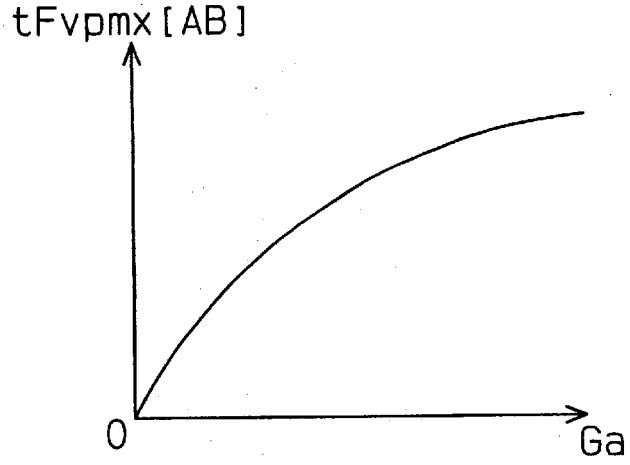
FIG. 35 is a graph showing the relationship between the amount of intake air and an absolute guard value.

While the air-fuel ratio F/B center is stable as in a period before time t1 in FIG. 34, the stored-in-air-layer vapor amount Mgair is held at the proper value and the estimation of the generated-in-tank vapor flow rate Fvptnk seems to be correct. The control apparatus determines that the air-fuel ratio F/B center is stable when the absolute value of the progressive change fafsm[air] of the air-fuel ratio F/B center for correction of the stored-in-air-layer vapor amount Mgair is equal to or smaller than the predetermined stability decision value SFFAFSMAIR.

In a period from the beginning of the deviation of the air-fuel ratio F/B center (|fafsm[air]|>SFFSFSMAIR) to the time at which correction of the stored-in-air-layer vapor amount Mgair is needed, such as a period from time t1 to time t2 in FIG. 34, it is assumed that the generated-in-tank vapor flow rate Fvptnk has an estimation error. The deviation of the air-fuel ratio F/B center seems to be caused by the accumulation of update errors of the vapor amount Mgair that have originated from the estimation error of the generated-in-tank vapor flow rate Fvptnk. Therefore, the amount of deviation of the air-fuel ratio F/B center at the time of correcting the stored-in-air-layer vapor amount Mgair or the amount of correction of the vapor amount Mgair can be considered as the accumulated value of errors in generated-in-tank vapor flow rate Fvptnk in the period (time t1 to time t2: time T12) from the occurrence of the deviation to the execution of the correcting process.

Therefore, the ECU 50 of the control apparatus executes the process of correcting the generated-in-tank vapor flow rate Fvptnk in the following mode in addition to the correcting process for the stored-in-air-layer vapor amount Mgair. Specifically, the amount of the deviation of the air-fuel ratio F/B center at the time of executing the correcting process (the current value of fafsm[air] at the time of executing the correcting process), i.e., a correcting term ΔMgair of the stored-in-air-layer vapor amount Mgair at the time of executing the correcting process is subjected to a correcting process with a differential value with respect to the time from the occurrence of the deviation to the time at which the correcting process is executed (time T12) being a correcting term ΔFvptnk of the generated-in-tank vapor flow rate Fvptnk.

<<Calculation Expressions>>

$$\Delta Fvptnk \leftarrow \Delta Mgair/T12$$

$$Fvptnk[\text{corrected value}] \leftarrow Fvptnk[\text{current value}] + \Delta Fvptnk$$

For example, the correcting process for the generated-in-tank vapor flow rate Fvptnk can be performed by performing an operation according to the calculation expressions after the correction of the stored-in-air-layer vapor amount Mgair. Similar correction of the generated-in-tank vapor flow rate Fvptnk can of course be made by using the air-fuel ratio F/B center value fafav (more preferably the progressive change fafsm[air]) at the time of correcting the stored-in-air-layer vapor amount Mgair in place of the correcting term ΔMgair in the calculation expressions.

The vapor purge system 20 equipped with the inner tank pressure sensor 32 for detecting the inner pressure of the fuel tank 30 (see FIG. 14) can grasp the vapor generating state in the fuel tank 30 from the detected value and estimate the generated-in-tank vapor flow rate Fvptnk to some extent. In accordance with the detected inner pressure of the fuel tank 30 (inner tank pressure), therefore, the allowable setting range of the generated-in-tank vapor flow rate Fvptnk is defined. Whatever correction request is made in the correcting process, the correction of the flow rate Fvptnk outside the defined allowable setting range may be restricted. For example, the allowable setting range may be defined so that the allowable upper limit of the generated-in-tank vapor flow rate Fvptnk is set in accordance with the inner tank pressure in such a way as to become larger as the inner tank pressure becomes higher. Defining the allowable setting range in accordance with the inner tank pressure can avoid improper setting of the generated-in-tank vapor flow rate Fvptnk which does not match with the detected situation.

[2-8] Process of Calculating VSV Angle (S100 in FIG. 15)

The control apparatus executes a vapor purge process which matches with the vapor behavior in the vapor purge system 20 by regulating the total purge flow rate Fpgall by adjusting the angle of the VSV 71*a* based on the prediction of the total vapor flow rate Fvpall according to the physical models. This allows the influence of the vapor purge process on the air-fuel ratio F/B control to be suppressed suitably. The following will give a detailed description of the process of calculating the VSV angle associated with such a suitable vapor purge process by further referring to FIGS. 35 to 37.

Figure 36:
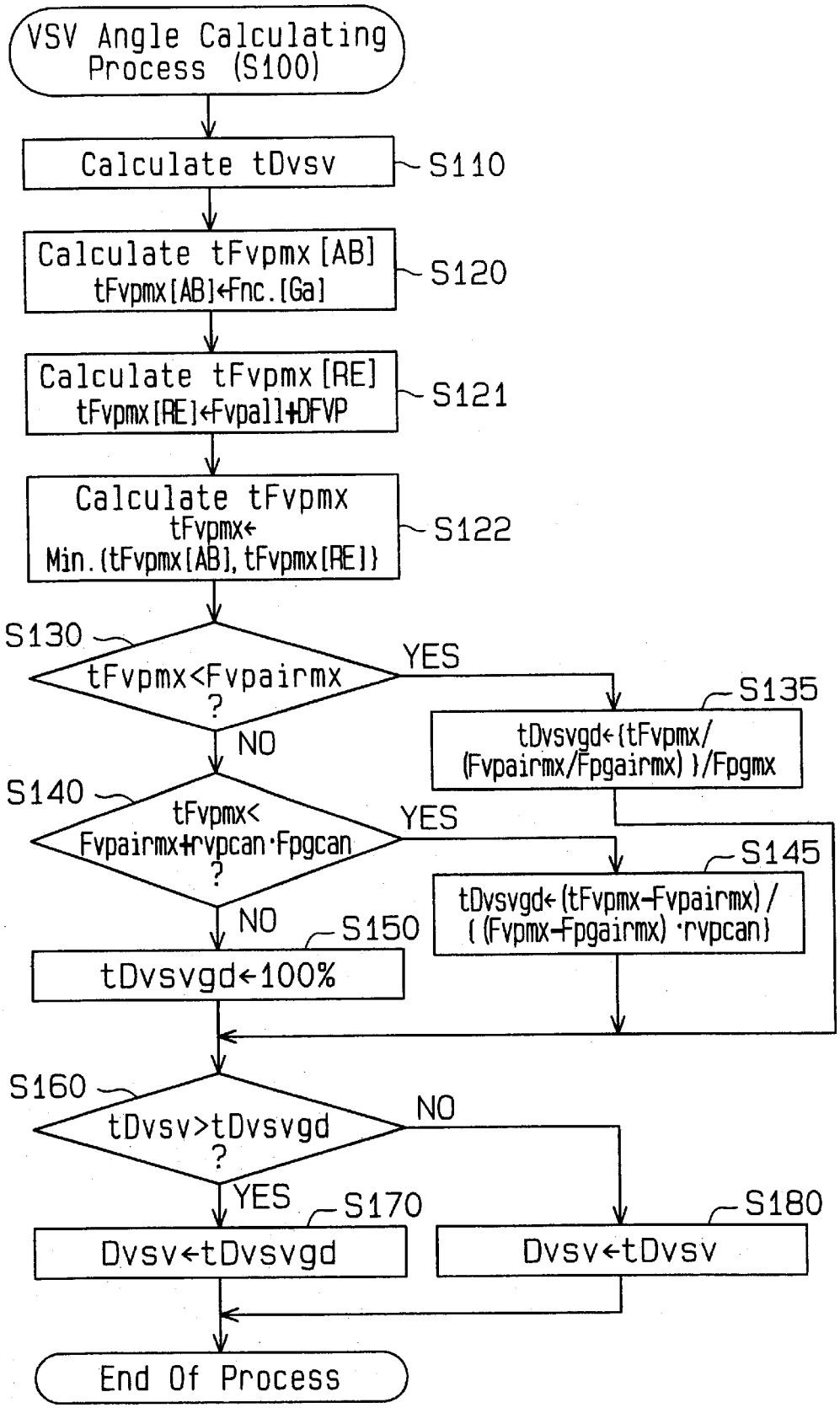
FIG. 36 is a flowchart illustrating procedures of a routine of calculating a VSV angle.

FIG. 36 illustrates a process routine associated with the calculation of the VSV angle. The routine is periodically executed by the ECU 50 when a condition for executing a vapor purge process is satisfied.

In this routine, first, the ECU 50 acquires a target value (target VSV angle) tDvsv of the VSV angle (duty ratio) Dvsv according to the engine running condition at that time (S110). The target VSV angle tDvsv is set in such a way as to ensure the proper total purge flow rate Fpgall in accordance with parameters, such as the engine speed NE, the air-intake passage internal pressure PM, an intake air amount Ga and the warm-up state of the engine 10 and the canister 40.

It is to be noted, however, that depending on the vapor behavior in the vapor purge system 20, the correlation between the total purge flow rate Fpgall and the total vapor flow rate Fvpall changes. Thus, even if the target VSV angle tDvsv is set, it is insufficient and difficult to predict the influence of vapor purging on the air-fuel ratio F/B control and set the VSV angle Dvsv and the total purge flow rate Fpgall in such a way as to suppress the influence.

In this respect, the control apparatus predicts the total vapor flow rate Fvpall after alteration of the VSV angle Dvsv using the physical models and set the VSV angle Dvsv in such a way as to guarantee suitable air-fuel ratio F/B control based on guard values to be discussed below.

[2-8-1] Calculation of Guard Value tFvpmx (S120 to S122)

(a) Calculation of Absolute Guard Value tFvpmx[AB] (S120)

When the intake air amount Ga of the engine 10 is small, even if the vapor flow rate to be purged to the air-intake passage 12 (total vapor flow rate Fvpall) is small, it has a significant influence on the air-fuel ratio F/B control. Therefore, the upper limit of the total vapor flow rate Fvpall that is permitted in accordance with the intake air amount Ga, i.e., the absolute guard value tFvpmx[AB] is defined. The absolute guard value tFvpmx[AB] is set in such a way as to permit purging of a larger amount of vapor to the air-intake passage 12 as the intake air amount Ga becomes greater.

(b) Calculation of Relative Guard Value tFvpmx[RE] (S121)

When the total vapor flow rate Fvpall rapidly changes as a consequence of the alteration of the VSV angle Dvsv, temporarily changing the purge correction value fpg significantly, an undesirable influence may be exerted on the air-fuel ratio F/B control. In case where the VSV angle Dvsv is changed to the side where the absolute value of the purge correction value fpg rapidly increases, particularly, the influence of the delay in transportation of vapor in the purge line 71 becomes greater and an error in purge correction value fpg originated from the estimation error of each physical status quantity increases. This results in a higher chance of exerting an adverse influence on the air-fuel ratio F/B control.

To avoid this shortcoming, the allowable upper limit of the total vapor flow rate Fvpall after changing the VSV angle Dvsv or the relative guard value tFvpmx[RE] is defined in accordance with the current value of the total vapor flow rate Fvpall in order to set the rate of a change in total vapor flow rate Fvpall in the increasing direction, caused by the angle alteration, within a predetermined value. The relative guard value tFvpmx[RE] is acquired from the following calculation expression.

<<Calculation Expression>>

$$tFvpmx[RE] \leftarrow Fvpall[\text{current value}] + DFVP$$

"DFVP" is the upper limit of the increasing rate of the total vapor flow rate Fvpall that can sufficiently suppress the influence on the air-fuel ratio F/B control and is set as a predetermined constant obtained as results of tests or the like. The upper limit DFVP of the increasing rate may be set variable in accordance with the intake air amount Ga or the like. In this case, it is considered that the upper limit DFVP may be set in such a way as to become larger as the intake air amount Ga becomes greater. A similar relative guard value may be set on the side of decreasing the total vapor flow rate Fvpall.

(c) Calculation of Guard Value tFvpmx (S122)

One of both guard values tFvpmx[AB] and tFVmx[RE] obtained in the above-described manner, whichever is smaller, is set as a final guard value tFvpmx. Thereafter, the VSV angle Dvsv is calculated in such a way that the predicted value of the total vapor flow rate Fvpall after angle alteration does not exceed the final guard value tFvpmx.

[2-8-2] Calculation of VSV Angle Guard Value tDvsvgd (S130 to S150)

After the guard value tFvpmx is obtained through the above-described process, the ECU 50 first calculates the VSV angle at which the total vapor flow rate Fvpall just becomes the guard value tFvpmx, i.e., a VSV angle guard value tDvsvgd in accordance with the current vapor behavior of the vapor purge system 20. The process of calculating the VSV angle guard value tDvsvgd is executed through the backward calculation of the logic of calculating the total vapor flow rate Fvpall based on the physical models when the total vapor flow rate Fvpall is set to the guard value tFvpmx. The details of the calculating process are illustrated in steps 130 to 150 in FIG. 36.

When purging to the air-intake passage 12 with the total vapor flow rate Fvpall set to the guard value tFvpmx is predicted to be only air-layer purging, i.e., when the guard value tFvpmx is less than the current maximum air-layer vapor flow rate Fvpairmx (S130: YES), the VSV angle guard value tDvsvgd is acquired from a calculation expression shown in step 135 in FIG. 36.

When purging to the air-intake passage 12 at that time is predicted to include both air-layer purging and desorption-from-adsorbent purging (S140: YES), the VSV angle guard value tDvsvgd is acquired from a calculation expression shown in step 145 in FIG. 36.

In case where the guard value tFvpmx exceeds the currently purgeable limit of the vapor flow rate (S140: NO), the VSV angle guard value tDvsvgd is set to the upper limit of the VSV angle Dvsv or 100% (S150).

[2-8-3] Calculation of VSV Angle (S160 to S180)

Then, the ECU 50 compares the VSV angle guard value tDvsvgd obtained this way with the target VSV angle tDvsv (S160). When the VSV angle guard value tDvsvgd is less than the target VSV angle tDvsv (YES), the guard value tDvsvgd is set to the VSV angle Dvsv (S170). Otherwise (NO), the target VSV angle tDvsv is directly set to the VSV angle Dvsv (S180).

Figure 37:
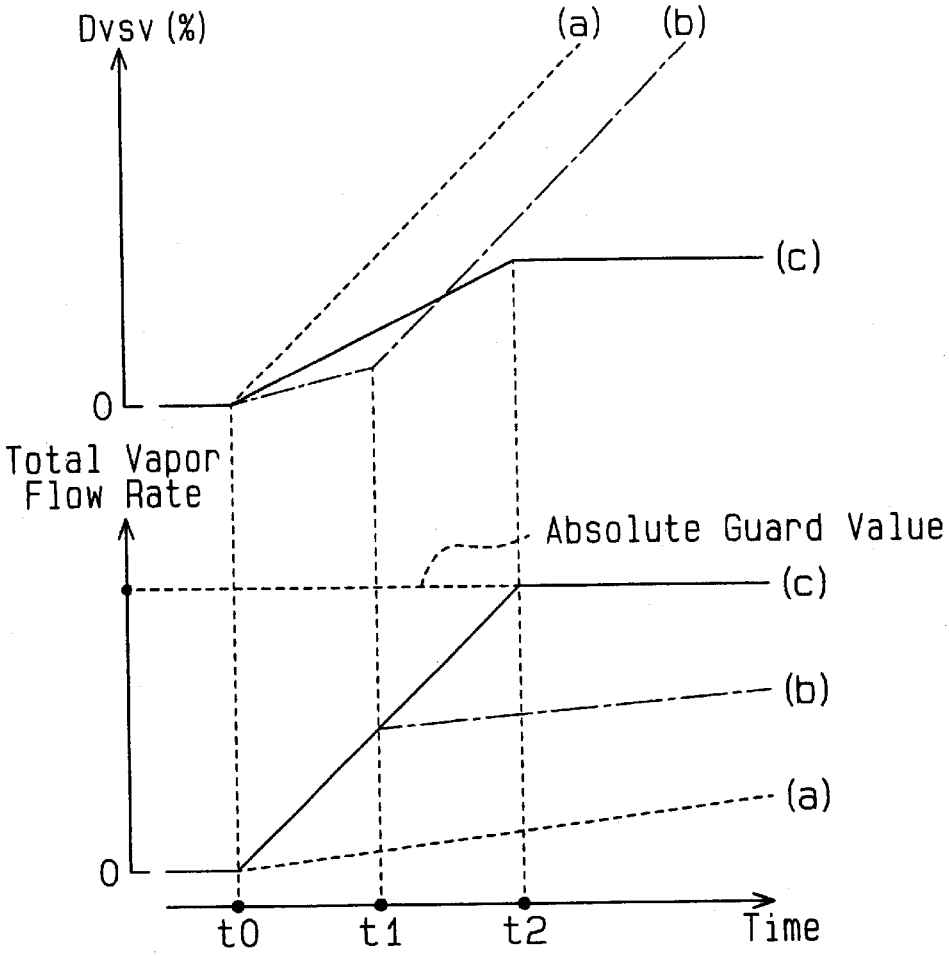
FIG. 37 is a time chart showing changes in VSV angle after purging starts and total vapor flow rate.

FIG. 37 shows an example of the control mode based on the above-described VSV angle calculating process. FIG. 37 shows a change in VSV angle Dvsv since the beginning of vapor purging and a change in total vapor flow rate Fvpall in the following three exemplified circumstances:

(a) When the amount of vapor stored in the entire canister 40 is small, (b) When the stored-in-air-layer vapor amount Mgair is large and the air-layer purge vapor density rvpair is high, and (c) When the stored-in-adsorbent vapor amount Mgcan is large and the desorbed-from-adsorbent purge vapor density rvpcan is high.

Although the VSV angle calculating process is carried out with the total vapor flow rate Fvpall taken as a basic parameter, a similar VSV angle calculating process may be carried out with the purge correction value fpg taken as the basic parameter. According to the control apparatus, the purge correction value fpg and the total vapor flow rate Fvpall have a unique relationship with each other with only difference in sign (plus or minus), and whichever is used, the control results are the same. It is to be noted however that depending on the logic of calculating the fuel injection amount Qfin (see Section [2-5]), both parameters may not have a unique relationship. In this case, with the use of the purge correction value fpg as the basic parameter, the VSV angle calculating process can be executed in the mode that copes with the influence of vapor purging on the air-fuel ratio F/B control much better.

[2-9] Other Improvements

The foregoing description has discussed the details of the air-fuel ratio control apparatus for an engine according to one embodiment of the present invention. This section will describe further improvements that can be made on the air-fuel ratio control apparatus.

[2-9-1] VSV Control with Low Angle

As described above, the VSV 71*a* of the vapor purge system 20 is constructed in such a way that the VSV angle (duty ratio) Dvsv, which is an instruction value associated with its angle control, and the total purge flow rate Fpgall to be purged to the air-intake passage 12 via the VSV 71*a* have a proportional relationship (linearity) with each other under a given condition of the air-intake passage internal pressure PM. The control apparatus acquires the total purge flow rate Fpgall from the air-intake passage internal pressure PM and the VSV angle Dvsv using the relationship and executes various processes (see Section [2-4-1] and other associated sections).

Figure 38:
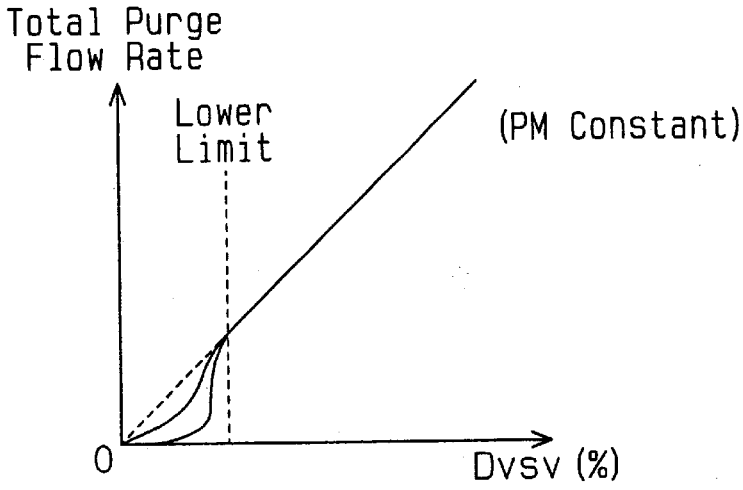
FIG. 38 is a graph showing the relationship between the VSV angle and the total purge flow rate.

Due to size allowances of the constituting parts of the VSV 71*a*, a temperature-dependent change in size, etc., however, the VSV 71*a* may not be able to keep the proportional relationship at an angle smaller than a certain value, as exemplified in FIG. 38. Hereinafter, the lower limit of the VSV angle Dvsv that can secure such a proportional relationship is called "linearity lower limit DVSVL". When the VSV angle Dvsv becomes less than the lower limit DVSVL, the total purge flow rate Fpgall cannot be grasped accurately. This disables the execution of various kinds of processes such as the calculating process of the above purge correction value based on the physical models.

Figure 39:
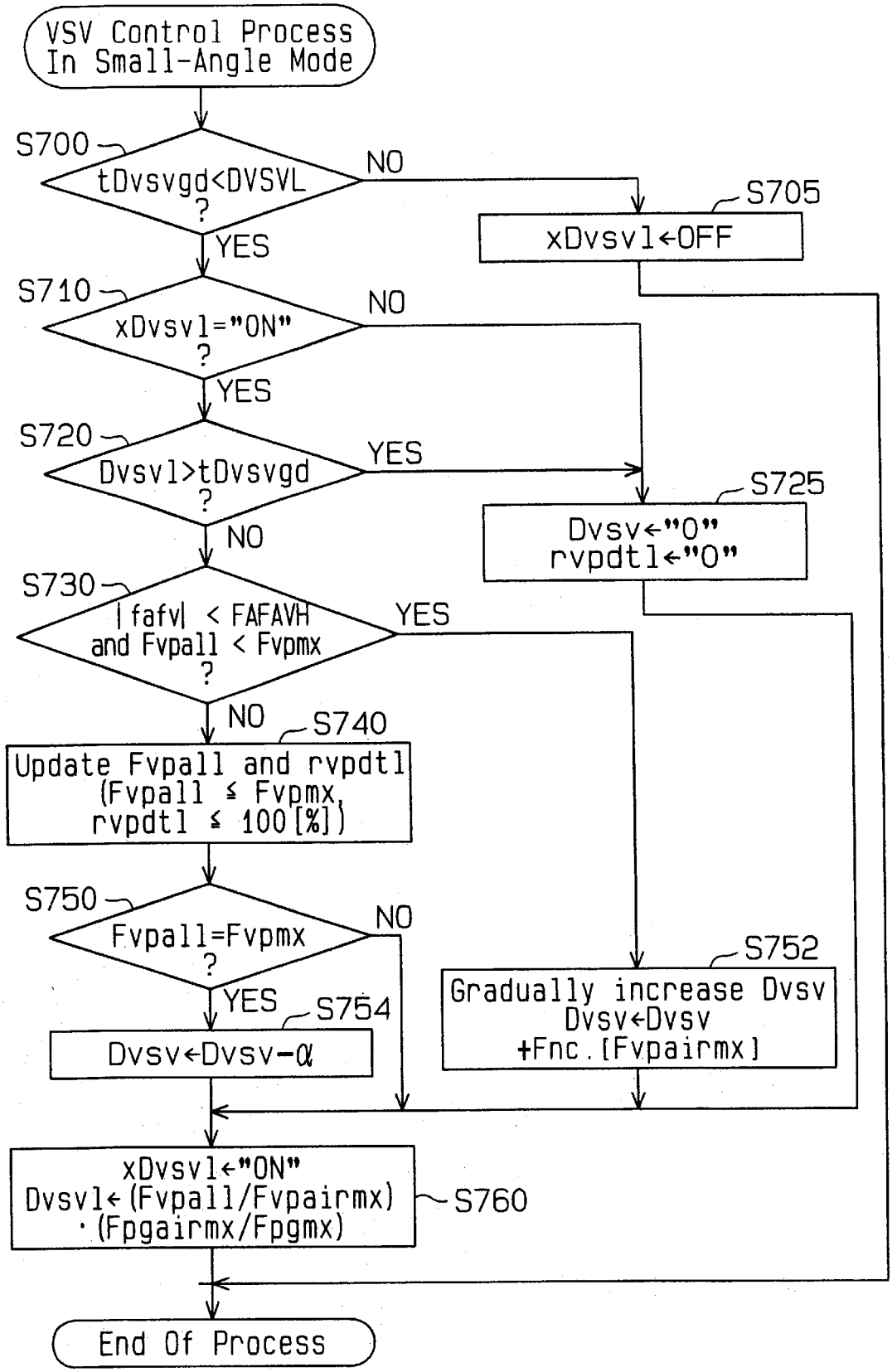
FIG. 39 is a flowchart illustrating procedures of VSV control in small-angle mode.

One way to deal with this case is to inhibit the setting of the VSV angle Dvsv to such a low angle. If a "VSV control routine at a low angle" as shown in FIG. 39 is executed, a vapor purge process can be carried out without adversely affecting air-fuel ratio F/B control even under such a situation.

Further, during small-angle processing, the vapor behavior in the vapor purge system 20 cannot be grasped accurately due to the precise total purge flow rate Fpgall being unknown. During small-angle processing, therefore, the update process and correcting process for the individual physical status quantities (see Sections [2-3] and [2-7]) are interrupted to prevent estimation errors in individual physical status quantities from spreading. A change or error in each physical status quantity which occurs during small-angle processing is corrected by the correcting process after the small-angle processing is completed.

The details of the processing will now be described by referring to FIGS. 39 and 40. The procedures of the routine are executed by the ECU 50 following the VSV angle calculating process (see Section [2-8] and FIG. 36 and other associated diagrams). When the VSV angle guard value tDvsvgd acquired in the above-described calculating process becomes less than the linearity lower limit DVSVL (S700: YES), the ECU 50 temporarily interrupts the normal vapor purge process, such as the purge correction value calculating process (see Section [2-4] and other associated sections), and executes the process in the following manner.

Figure 40:
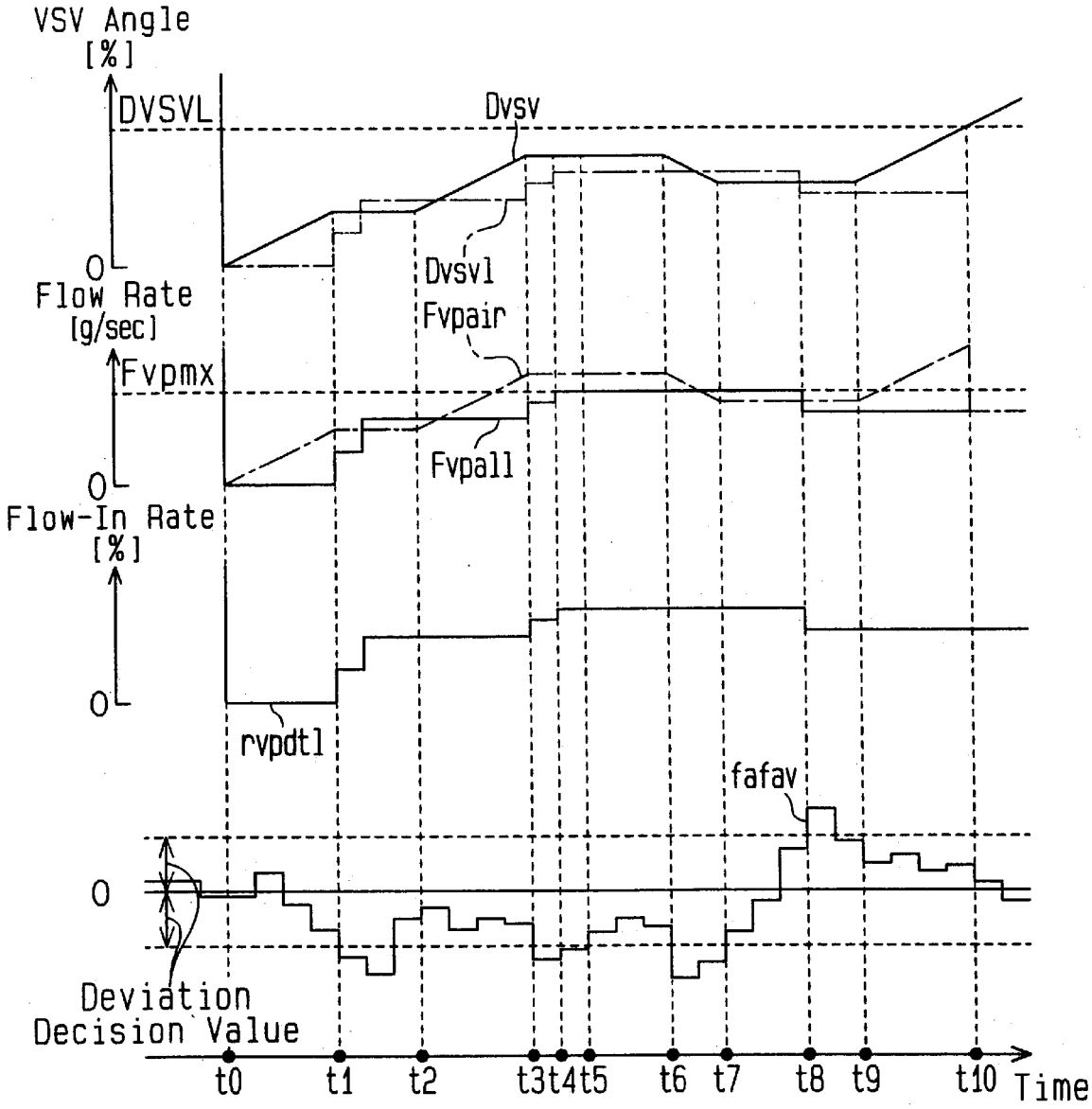
FIG. 40 is a time chart illustrating the state of VSV control in small-angle mode.

When the normal process is shifted to the small-angle process at time t0 in FIG. 40 (S710: NO), the ECU 50 temporarily fully closes the VSV angle Dvsv (Dvsv="0"%) and sets the value of a flow-in rate rvpdtl to "0" (S725). The process shifting is acknowledged by ON/OFF of a flag xDvsvl indicating that a process at a small angle has been done at the time of the previous execution of the routine (see S705 and S760).

The flow-in rate rvpdtl is a substitute for the air-layer purge vapor density rvpair that is used only in the small-angle process. The flow-in rate rvpdtl is acquired based on the deviation of the air-fuel ratio F/B center value fafav. During the small-angle process, the total vapor flow rate Fvpall is acquired from the following calculation expression in accordance with the flow-in rate rvpdtl.

<<Calculation Expression>>

$$\text{Fvpall[small-angle mode]} \leftarrow \text{rvpdtl} \cdot \text{Fvpairmx}$$

The purge correction value fpg is obtained in accordance with the total vapor flow rate Fvpall that is acquired from the calculation expression. During the small-angle process, therefore, the purge correction value fpg is obtained by a feedback process according to the deviation of the air-fuel ratio F/B center.

Unless either the deviation of the air-fuel ratio F/B center being detected or the total vapor flow rate Fvpall reaching a predetermined upper limit Fvpmx is satisfied (S730: YES), the ECU 50 gradually opens the VSV angle Dvsv (S752). The valve opening speed or the increasing rate of the VSV angle Dvsv at this time is set in accordance with the maximum air-layer vapor flow rate Fvpairmx in such a way that as the flow rate Fvpairmx becomes greater, i.e., as the vapor density during purging is estimated to be higher, the VSV 71*a* is opened and driven more gently.

When the deviation of the air-fuel ratio F/B center is detected (S730: NO), the ECU 50 temporarily interrupts the actuation of the VSV 71*a* in the opening direction and keeps the current angle and updates the flow-in rate rvpdtl according to the deviation. Further, the total vapor flow rate Fvpall is updated accordingly (S740). Here, the deviation of the air-fuel ratio F/B center is detected with the absolute value of the air-fuel ratio F/B correction value fafv exceeding a predetermined deviation decision value FAFAVH.

In the update process, the flow-in rate rvpdtl is increased or decreased to compensate for the deviation of the air-fuel ratio F/B center (S740). When the deviation of the center value fafav to the lean side with respect to the target value of the air-fuel ratio F/B is detected at times t1, t3, t4 and so forth in FIG. 40, a value equivalent to the amount of the deviation is added to the flow-in rate rvpdtl. When the deviation of the center value fafav to the rich side is detected at time t8 in FIG. 40, a value equivalent to the amount of the deviation is subtracted from the estimated value rvpdtl.

When the deviation of the air-fuel ratio F/B center is canceled by the correction of the purge correction value fpg that is made in the process of updating the flow-in rate rvpdtl and the total vapor flow rate Fvpall at times t2 and t9 in FIG. 40, the driving of the VSV 71*a* in the valve opening direction is restarted.

If the total vapor flow rate Fvpall reaches the upper limit Fvpmx, even in the case where the deviation of the air-fuel ratio F/B center has not been detected as in a period from time t5 to time t6 in FIG. 40, the driving of the VSV 71*a* in the valve opening direction is temporarily stopped and the current angle is maintained (S730: NO). The upper limit Fvpmx is the upper limit of the total vapor flow rate Fvpall that is allowable during the small-angle process and is set as a predetermined constant obtained through tests or the like.

When the total vapor flow rate Fvpall reaches the upper limit Fvpmx and the air-fuel ratio F/B center is shifted to the rich side as in a period from time t6 to time t7 in FIG. 40, the VSV 71*a* is driven by a predetermined rate in the valve closing direction (S754).

During the small-angle process, the estimated value Dvsvl of the real angle of the VSV 71*a* is acquired according to the following calculation expression in accordance with the obtained total vapor flow rate Fvpall (S760).

<<Calculation Expression>>

$$Dvsvl \leftarrow (Fvpall/Fvpairmx)\cdot(Fpgairmx/Fpgmx)$$

When the real angle estimated value Dvsvl goes higher than the VSV angle guard value tDvsvgd, the VSV angle Dvsv is fully closed (0%) again after which the valve opening of the VSV 71*a* is started again.

When the VSV angle Dvsv exceeds the linearity lower limit DVSVL at time t10 in FIG. 40, the routine returns to the normal vapor purge process. At this time, to prevent a discontinuous change in purge correction value fpg, the air-layer vapor flow rate Fvpair alone is so corrected as to coincide with the total vapor flow rate Fvpall at the time the small-angle process is completed, while keeping the value of the stored-in-air-layer vapor amount Mgair unchanged.

The foregoing description has discussed the details of the VSV angle control in small-angle mode. If the total purge flow rate Fpgall that is estimated according to the deviation of the air-fuel ratio F/B center during the small-angle process and the real angle estimated value Dvsvl are reliable, the processes of updating and correcting the individual physical status quantities may be executed based on those values. During the small-angle process, of course, only one of the update process and the correcting process can be inhibited and the other process can be resumed.

The failure of the linearity in small-angle mode is a general problem that can occur in general air-fuel ratio control apparatuses for engines equipped with a vapor purge system having a VSV. Therefore, the small-angle process can be adapted not only to any air-fuel ratio control apparatus for an engine equipped with a vapor purge system having a VSV in the same way or a similar way but to the air-fuel ratio control apparatus according to the embodiment.

Figure 41:
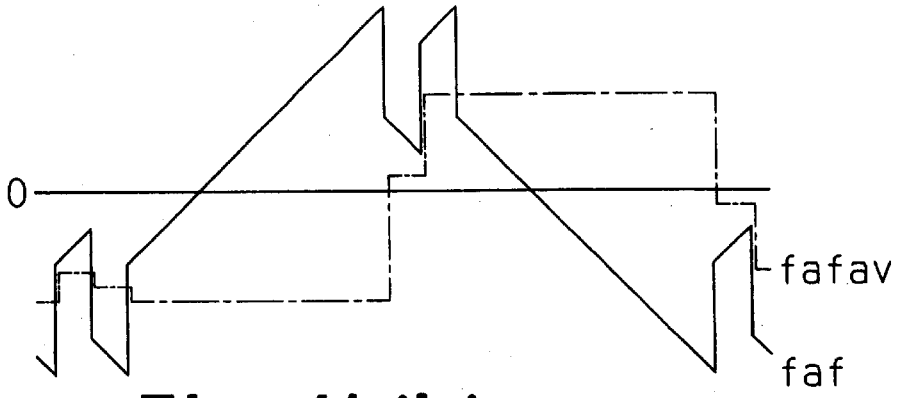
FIGS. 41(*a*) and 41(*b*) are time charts showing changes in an air-fuel ratio F/B correction value and the center value thereof.
Figure 41:
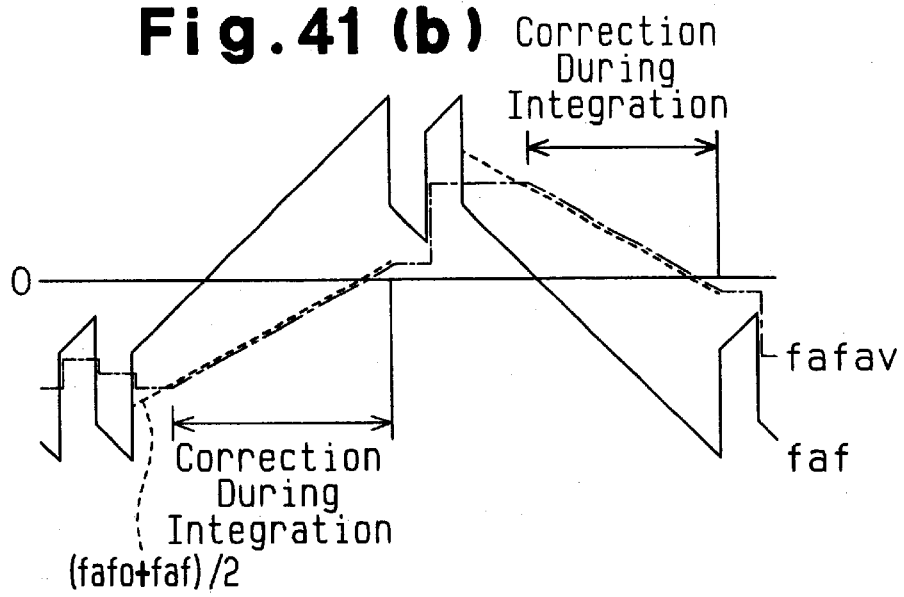

[2-9-2] Process of Calculating the Center Value of Air-Fuel Ratio Feedback Correction Value This section will discuss an improvement to be made on the control apparatus with respect to the process of calculating the air-fuel ratio F/B center value fafav by referring to FIGS. 41(*a*) and 41(*b*).

Conventionally, the air-fuel ratio F/B center value fafav is updated only at the time of skipping the air-fuel ratio F/B correction value faf as shown in FIG. 41A. In case where the purge condition or the engine running condition significantly varies to make the integration period longer, for example, the update of the air-fuel ratio F/B center value fafav stopped during that period and the value before the condition has been changed is maintained. As a result, an undesirable influence may be exerted on various processes that are to be executed by referring to the air-fuel ratio F/B center value fafav.

The influence is particularly critical to the air-fuel ratio control apparatus of the embodiment.

The air-fuel ratio control apparatus of the embodiment executes various processes including the correcting process (see Section [2-7]) based on the deviation of the air-fuel ratio F/B center. Then, the purge correction value fpg is acquired from the values of the individual physical status quantities set through those processes. With the use of the air-fuel ratio F/B center value fafav computed in the above-described manner, therefore, the update of each physical status quantity cannot sufficiently respond to a change in the condition so that the air-fuel ratio F/B precision that has been improved by the use of the vapor purge process based on the physical models cannot be maintained sufficiently.

Even in this case, the use of the process of calculating the air-fuel ratio F/B center value fafav in a manner illustrated in FIG. 41B can overcome the problem. In the example of FIG. 41B, the amplitude of the air-fuel ratio F/B correction value faf is monitored and the center value fafav is updated even during the integration period of the correction value faf.

In this example, when a value fafavl obtained from the following calculation expression is closer to the current correction value faf than the current air-fuel ratio F/B center value fafav during the integration period of the correction value faf ($|faf-fafav|>|faf-fafavl|$), the air-fuel ratio F/B center value fafav is updated to the value fafavl ($fafav \leftarrow fafavl$).

<<Calculation Expression>>

$$fafavl \leftarrow (faf0+faf)/2$$

where "faf0" is a skip center value at the time of skipping the air-fuel ratio F/B correction value faf before the integration period, i.e., an average value of the correction value faf before the skip process and the correction value faf after the skip process.

[2-9-3] Process of Correcting Density of Purge Flow Rate

If the correlation between the air-intake passage internal pressure PM and the VSV angle Dvsv is acquired beforehand through experiments or the like, the flow rate of the gas to be purged to the air-intake passage 12 through the purge line 71 can be obtained without actual measurement while the engine is running. According to the embodiment, therefore, the allowable maximum value Fpgmx of the purge flow rate is calculated from the air-intake passage internal pressure PM by using the operational map as exemplified in FIG. 18, and the total purge flow rate Fpgall is obtained through correlation of the maximum value Fpgmx with the VSV angle Dvsv (see Section [2-4-1]).

Strictly speaking, the total purge flow rate Fpgall obtained this way is simply a volumetric flow rate with the specific gravity of the purge gas being set constant. The operational map as exemplified in FIG. 18 is prepared on the assumption that the specific gravity of the purge gas to the air-intake passage 12 through the purge line 71 is the specific gravity of the air (about 1.2 g/l).

The specific gravity of the purge gas actually varies in accordance with a vapor containing ratio in the purge gas or a vapor density rvpt (=Fvpall/Fpgall) of the purge gas. According to the embodiment, therefore, the various processes are executed, regarding the total purge flow rate Fpgall obtained in the above-described manner as the volumetric flow rate [g/sec] of the gas to be purged to the air-intake passage 12.

Even in this case, it is of course possible to sufficiently secure the calculation precision for the required total purge flow rate Fpgall if the specific gravity of the purge gas during vapor purging does not differ significantly from the specific gravity of the purge gas estimated at the time of preparing the operational map (the specific gravity of the air in the embodiment). That is, according to the embodiment, the calculation precision for the required total purge flow rate Fpgall is guaranteed on the condition that the vapor density rvpt is smaller than a certain value. When the vapor density rvpt is large, therefore, a reduction in calculation precision for the required total purge flow rate Fpgall is inevitable in the embodiment.

Even in this case, the calculation precision can be maintained regardless of a change in vapor density rvpt if the computed value of the required total purge flow rate Fpgall is corrected adequately in accordance with the specific gravity of the purge gas or the vapor density rvpt.

Figure 42:
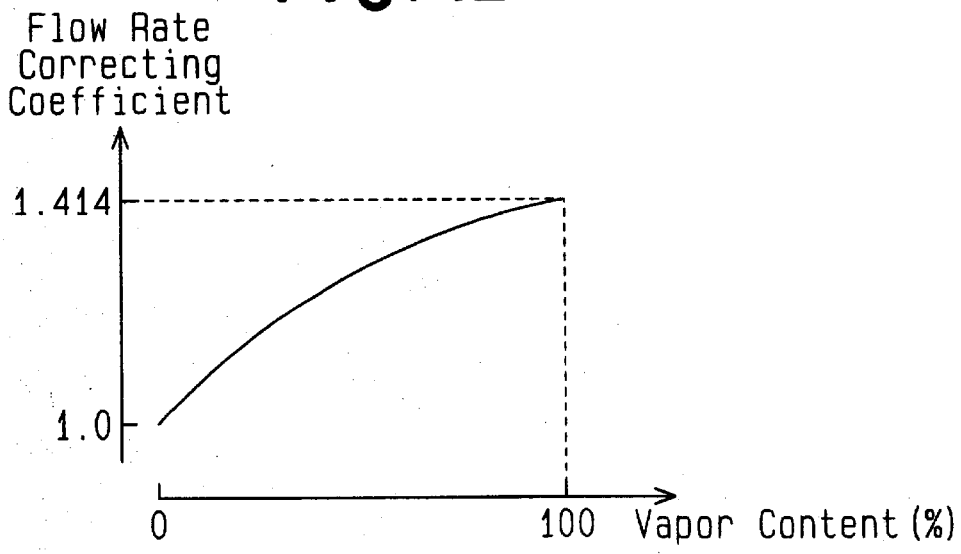
FIG. 42 is a graph showing the relationship between a vapor density and a flow rate correcting coefficient.
Figure 43:
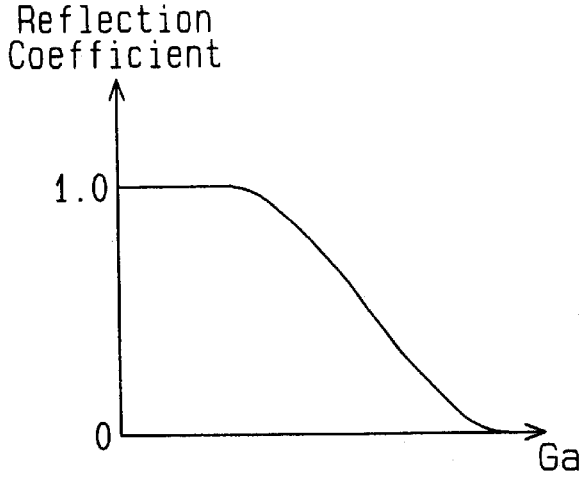
FIG. 43 is a graph showing the relationship between the amount of intake air and a correction amount reflecting coefficient.

For example, the correlation between the ratio of the specific gravity of the purge gas to the specific gravity of the air (the specific gravity ratio) and the ratio of the vapor content in the purge gas (vapor density rvpt) is acquired beforehand and an operational map as shown in FIG. 42 is prepared. Then, the current vapor density rvpt of the purge gas is computed from the current total purge flow rate Fpgall and the total vapor flow rate Fvpall and the specific gravity is obtained as a flow rate correcting coefficient from the operational map. The maximum total purge flow rate Fpgmx computed according to the air-intake passage internal pressure PM from the operational map (FIG. 18) for the maximum total purge flow rate Fpgmx is multiplied by the flow rate correcting coefficient obtained this way. With the resultant value being the final maximum total purge flow rate Fpgmx, the total purge flow rate Fpgall is calculated. Alternatively, a value obtained by multiplying the total purge flow rate Fpgall, computed according to the calculation logic of the embodiment, by the flow rate correcting coefficient. Through the above-described processing, it is possible to calculate the accurate total purge flow rate Fpgall with a change in the specific gravity of the purge gas taken into consideration. In other words, the total purge flow rate Fpgall is accurately computed as a mass flow rate by taking the specific gravity of the purge gas into consideration.

[2-9-4] Process of Reducing Correction Errors of Physical Status Quantities

The embodiment executes a correcting process of correcting the individual physical status quantities or the values of the stored-in-air-layer vapor amount Mgair, the stored-in-adsorbent vapor amount Mgcan and the generated-in-tank vapor flow rate Fvptnk in accordance with the deviation of the air-fuel ratio F/B center (see Section [2-7]). Executing a process of reducing the following correction errors with respect to such a correcting process can ensure a further improvement on the precision of the values of the physical status quantities.

(a) Process of Reducing Correction Errors Caused by Influence of Intake Air Amount Ga When there is an error in air-fuel ratio learned value KG or the like associated with the air-fuel ratio F/B control, an increase in intake air amount Ga amplifies the error-originated calculation error in fuel injection amount Qfin, thus increasing the deviation of the air-fuel ratio F/B center. If the correcting process is performed with the increased deviation of the air-fuel ratio F/B center under such a situation, each physical status quantity may be over-corrected so that when the intake air amount Ga is reduced, purge correction may be carried out excessively.

This problem can be avoided easily by making the degree of correction of each physical status quantity lower for a larger intake air amount Ga, i.e., by making the degree of correction of each physical status quantity lower with respect to the deviation of the air-fuel ratio F/B for a larger intake air amount Ga. Specifically, the problem can be avoided by employing at least one of individual measures exemplified below.

(a-I) Alteration of Correction Reflecting Ratio According to Intake Air Amount Ga The problem can be avoided by setting the ratio of the amount of correction of each physical status quantity or a correction reflecting ratio thereof smaller with respect to the deviation of the air-fuel ratio F/B for a larger intake air amount Ga. The correction reflecting ratio can be obtained by using an operational map or the like involving the intake air amount Ga as exemplified in, for example, FIG. 43.

Figure 44:
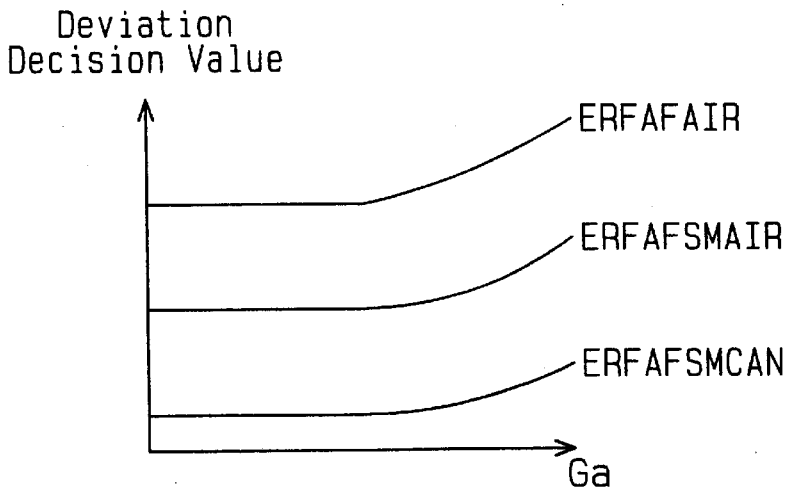
FIG. 44 is a graph showing the relationship between the amount of intake air and a deviation determining value.
Figure 45:
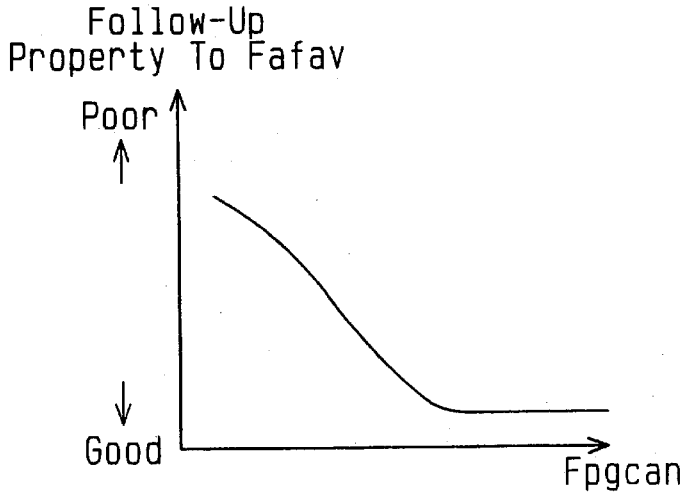
FIG. 45 is a graph showing the relationship between a progressive change constant and a total purge flow rate.

(a-II) Alteration of Decision Value for Deviation of Air-Fuel Ratio F/B According to Intake Air Amount Ga As exemplified in FIG. 44, a process of setting the individual decision values ERFAFAIR, ERFAFSMAIR and ERFAFSMCAN (see Section [2-7-1]) of the deviation of the air-fuel ratio F/B larger for a larger intake air amount Ga is performed. This process can make the degree of correction of each physical status quantity lower with respect to the deviation of the air-fuel ratio F/B center for a larger intake air amount Ga, so that the problem is avoidable. If a process of making the individual stability decision values SFFSFSMAIR and SFFAFSMCAN (also see Section [2-7-1]) greater for a larger intake air amount Ga is likewise performed, the correcting process can be executed more suitably.

(b) Process of Reducing Correction Errors Caused by Influence of Inside-Adsorbent Air Flow Rate Fpgcan According to the embodiment, the deviation of the air-fuel ratio F/B center when a predetermined condition is met is regarded as originated from an error in desorbed-from-adsorbent purge vapor density rvpcan and the stored-in-adsorbent vapor amount Mgcan is corrected according to the deviation. Strictly speaking, the factors of the deviation of the air-fuel ratio F/B center may include other factors, such as an error in air-fuel ratio learned value KG. In a case where the inside-adsorbent air flow rate Fpgcan is small, therefore, if an error in vapor density rvpcan is sought as the whole cause for the deviation of the air-fuel ratio F/B center, an estimation error originated from another factor is amplified when the flow rate Fpgcan is increased, thus resulting in over-correction. According to the embodiment, this problem is coped with by inhibiting the correction of the stored-in-adsorbent vapor amount Mgcan when the inside-adsorbent air flow rate Fpgcan is less than a predetermined value (see Section [2-7-2]).

The mere measure of choice between two actions of permitting and inhibiting correction may not be sufficient to cope with the problem. Even in this case, the problem can be handled properly if the degree of correction of the stored-in-adsorbent vapor amount Mgcan is set smaller for a lower inside-adsorbent air flow rate Fpgcan in accordance with the flow rate Fpgcan. As exemplified in FIG. 45, for example, the problem can also be dealt with if the follow-up property to the center value fafav of the progressive change fafsm [can] of the air-fuel ratio F/B center for correction of the stored-in-adsorbent vapor amount Mgcan is made lower for a lower inside-adsorbent air flow rate Fpgcan in accordance with the flow rate Fpgcan.

One can never say that no similar tendency holds true of the correction of the stored-in-air-layer vapor amount Mgair. Therefore, another possible solution is to set the degree of correction of the stored-in-air-layer vapor amount Mgair lower for a lower air-layer purge flow rate Fpgair.

[2-9-5] Measure Against Direct Flow-In of Generated-in-Tank Vapor

During purging, there is a possibility that vapor directly flows into the purge line 71 from the fuel tank 30 in addition to air-layer purging and desorption-from-adsorbent purging. According to the embodiment, the physical models (see FIG. 13) are constructed, considering such vapor flowing from the tank as negligible in the calculation of the total vapor flow rate Fvpall as the amount is very minute.

Figure 46:
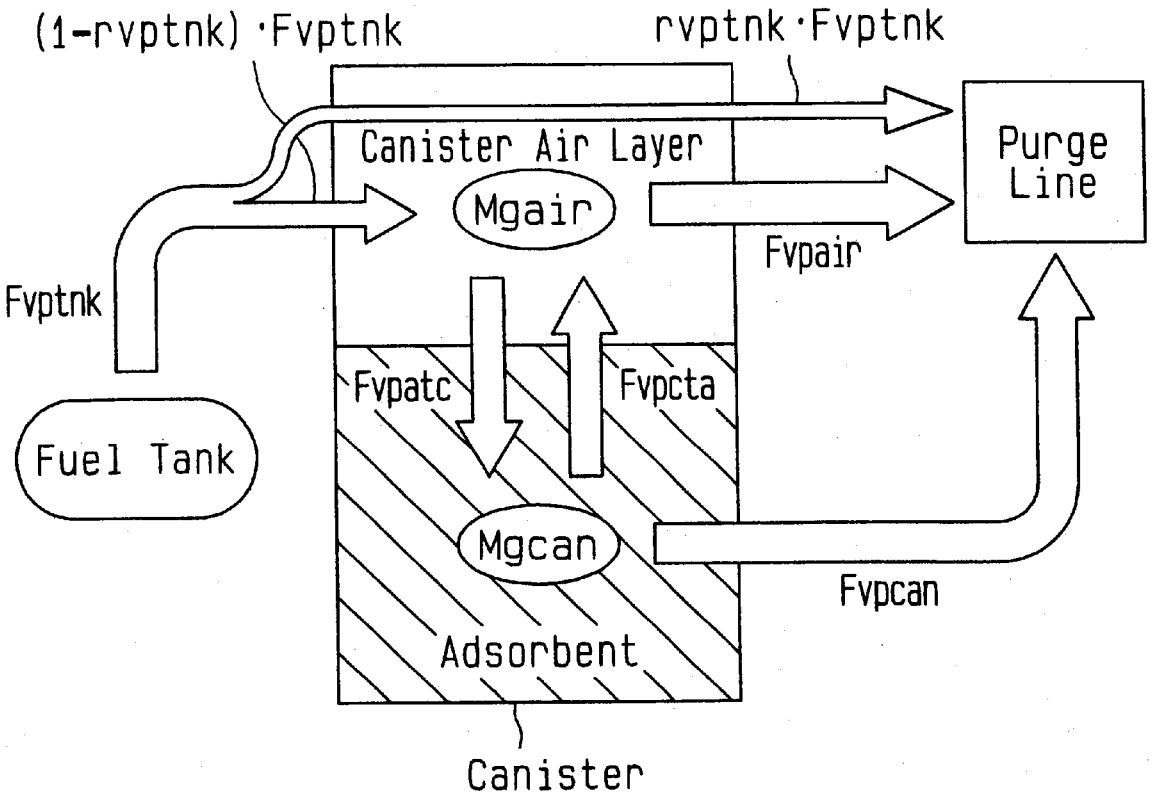
FIG. 46 is a model diagram showing a vapor behavior in the entire purge system according to another embodiment of the invention.

In a case where the total vapor flow rate Fvpall needs to be obtained more strictly or in a case where the flow rate of the flowing-from-tank vapor is not negligible, however, it is necessary to construct a physical model in consideration of the flowing-from-tank vapor as shown in FIG. 46.

As described in the section of the initialization process, the upper limit of the flow rate of the flowing-from-tank vapor that is permitted during vapor purging is estimated to hold a constant ratio with respect to the generated-in-tank vapor flow rate Fvptnk (see Section [2-6-2]). Further, flowing-from-tank vapor with a higher pressure which mostly consists of the vapor component seems to be purged by a higher priority over air-layer purging and desorption-from-adsorbent purging.

Therefore, the total vapor flow rate Fvpall based on the physical model in FIG. 46 can be acquired by, for example, the following calculation expression.

<<Calculation Expression>>

$$Fvpttp \leftarrow Fpgall/PVPTNK(Fvpttp \leqq Fvptnk/RVPTNK)$$

$$rvptnk \leftarrow RVPTNK \cdot Fvpttp/Fvptnk$$

$$Fpgair \leftarrow Fpgall - rvptnk \cdot Fvptnk(0 \leqq Fpgair \leqq Fpgairmx)$$

$$Fpgcan \leftarrow Fpgall - rvptnk \cdot Fvptnk - Fpgair(Fpgcan \geqq 0)$$

$$rvpair \leftarrow Fpgair/Fpgairmx$$

$$Fvpair \leftarrow rvpair \cdot Fvpairmx$$

$$Fvpcan \leftarrow -rvpcan \cdot Fpgcan$$

$$Fvpall \leftarrow rvptnk \cdot Fvptnk + Fvpair + Fvpcan$$

where "Fvpttp" is the maximum value of the flowing-from-tank vapor flow rate allowable during vapor purging. "RVPTNK" indicates a ratio of the upper limit of the flowing-from-tank vapor flow rate allowable during vapor purging to the generated-in-tank vapor flow rate Fvptnk. Here, the ratio RVPTNK is a predetermined constant. Further, "rvptnk" indicates a ratio of the flowing-from-tank vapor to the generated-in-tank vapor flow rate Fvptnk. Those parameters which are not mentioned above are the same as those of the embodiment.

Further, an update amount ΔMgair of the regular update process for the stored-in-air-layer purge flow rate can be acquired from the following calculation expression.

<<Calculation Expression>>

$$\Delta Mgair \leftarrow (1 - rvptnk) \cdot Fvptnk + Fvpcta - Fvpatc - Fvpair$$

The illustrated various processes of the embodiment can be carried out similarly in accordance with the physical model in FIG. 46 by properly changing the calculation expression or the like in consideration of the flowing-from-tank vapor flow rate Fvpttp.

The foregoing description has discussed the details of individual improvements that can be made on the air-fuel ratio control apparatus according to the embodiment.

The following will discuss some essential advantages among those obtained by the embodiment and elaborated in the foregoing description.

(1) The air-fuel ratio control apparatus for an engine according to the embodiment estimates the total vapor flow rate Fvpall corresponding to the total purge flow rate Fpgall in accordance with the physical models of vapor behaviors based on the stored-in-air-layer vapor amount Mgair, the stored-in-adsorbent vapor amount Mgcan and the generated-in-tank vapor flow rate Fvptnk. The fuel injection amount is corrected in accordance with the estimated value. According to the embodiment, it is possible to accurately predict the total vapor flow rate Fvpall to be purged to the air-intake passage 12 from the purge line 71 regardless of a change in vapor behavior in the vapor purge system 20 and control the air-fuel ratio during purging with a high precision.

(2) According to the embodiment, the values of the individual physical status quantities are periodically updated based on the purging condition and the current values of the physical status quantities by using the physical models. This makes it possible to estimate the total vapor flow rate Fvpall only by an open-loop calculation process or feedforward control. Without depending on the feedback control based on the deviation of the air-fuel ratio F/B, the air-fuel ratio during purging corresponding to a change in vapor behavior can be controlled precisely.

(3) According to the embodiment, changes in air-fuel ratio F/B center during vapor purging are monitored and the value of each physical status quantity is corrected in accordance with the deviation of the air-fuel ratio F/B. It is therefore possible to keep each physical status quantity at an accurate value and maintain a high-precision air-fuel ratio.

(4) According to the embodiment, the temporary value Fvps of the total vapor flow rate Fvpall is acquired based on the deviation of the air-fuel ratio F/B, and the initial value of each physical status quantity is acquired based on changes in temporary value Fvps when the VSV 71*a* is gradually opened from the fully-closed state to gradually increase the total purge flow rate Fpgall from "0". If the value of each physical status quantity is unclear, therefore, it is possible to acquire the value and execute control based on the physical models.

(5) According to the embodiment, the angle opening control of the VSV 71*a* is executed while predicting the total vapor flow rate Fvpall with an arbitrary VSV angle Dvsv by using a logic of estimating the total vapor flow rate Fvpall based on the physical models. This makes it possible to adjust the total purge flow rate Fpgall based on the angle opening control of the VSV 71*a* in such a way as to adequately secure the desired total vapor flow rate Fvpall.

(6) According to the embodiment, with the process in Section [2-9-1] added, in the small-angle mode of the VSV 71*a* where the correlation among the air-intake passage internal pressure PM, the VSV angle Dvsv and the total purge flow rate Fpgall is unclear, the VSV 71*a* is temporarily closed fully after which the valve opening control of the VSV 71*a* is executed in accordance with the degree of a change in air-fuel ratio F/B. This structure can adequately carry out vapor purging while suppressing the influence on the air-fuel ratio F/B control even under a situation where it is difficult to grasp the accurate total purge flow rate Fpgall.

The details of the control of the embodiment can be altered adequately. The present invention can be adapted to any vapor purge system as long as the purge system is equipped with a canister which has the aforementioned adsorbent, canister air layer and air hole, and purges vapor, generated in the fuel tank, to the engine intake system through the purge line from the canister.

What is claimed is:

1. An air-fuel ratio control apparatus for controlling the air-fuel ratio of air-fuel mixture drawn into a combustion chamber of an engine, wherein a canister is connected to an intake system of the engine through a purge line, wherein the canister includes an adsorbent, an air layer located between the adsorbent and the purge line, and an air hole for introducing air into the canister, wherein the adsorbent adsorbs fuel vapor generated in a fuel tank and permits adsorbed fuel vapor to be desorbed, wherein air introduced into the canister through the air hole flows to the purge line through the adsorbent, and wherein gas containing fuel vapor is purged to the intake system from the canister through the purge line, the apparatus comprising:

a computer, which performs feedback correction of the amount of fuel supplied to the combustion chamber such that the air-fuel ratio of the air-fuel mixture seeks a target air-fuel ratio, wherein, by using a physical model related to the fuel vapor behaviors, the computer estimates a total vapor flow rate, which represents the flow rate of fuel vapor in gas purged to the intake system, according to a total purge flow rate representing the total flow rate of the purged gas, wherein the physical model is based on a physical status quantity representing the fuel vapor stored state of the air layer, a physical status quantity representing the fuel vapor stored state of the adsorbent, and a physical status quantity representing the vapor generating state in the fuel tank, and wherein, according to the estimated total vapor flow rate, the computer corrects the fuel supply amount, which is subjected to the feedback correction.

2. The apparatus according to claim 1, wherein the computer computes a stored-in-air-layer vapor amount, which represents the amount of fuel vapor stored in the air layer, and a stored-in-adsorbent vapor amount, which represents the amount of fuel vapor stored in the adsorbent, wherein, based on the stored-in-air-layer vapor amount and the stored-in-adsorbent vapor amount, the computer estimates the total vapor flow rate that corresponds to the total purge flow rate.

3. The apparatus according to claim 2, wherein, according to the stored-in-air-layer vapor amount and the total purge flow rate, the computer computes an air-layer vapor flow rate, which represents the flow rate of fuel vapor that is directly drawn into the purge line from the air layer and is purged to the intake system, wherein, according to the stored-in-adsorbent vapor amount and the total purge flow rate, the computer computes a desorbed-from-adsorbent vapor flow rate, which represents the flow rate of fuel vapor that is desorbed from the adsorbent by the force of the stream of air led through the air hole and is purged to the intake system, and wherein the computer computes the sum of the air-layer vapor flow rate and the desorbed-from-adsorbent vapor flow rate and sets the sum as the total vapor flow rate.

4. The apparatus according to claim 2, wherein the computer computes a generated-in-tank vapor flow rate, which represents the flow rate of fuel vapor that flows into the canister from the fuel tank.

5. The apparatus according to claim 1, wherein the computer computes a stored-in-air-layer vapor amount, which represents the amount of fuel vapor stored in the air layer, a stored-in-adsorbent vapor amount, which represents the amount of fuel vapor stored in the adsorbent, and a generated-in-tank vapor flow rate, which represents the flow rate of fuel vapor that flows into the canister from the fuel tank, wherein, based on the stored-in-air layer vapor amount, the stored-in-adsorbent vapor amount, and the generated-in-tank vapor flow rate, the computer estimates the total vapor flow rate that corresponds to the total purge flow rate.

6. The apparatus according to claim 5, wherein, according to the stored-in-air-layer vapor amount and the total purge flow rate, the computer computes an air-layer vapor flow rate, which represents the flow rate of fuel vapor that is directly drawn into the purge line from the air layer and is purged to the intake system, wherein, according to the stored-in-adsorbent vapor amount and the total purge flow rate, the computer computes a desorbed-from-adsorbent vapor flow rate, which represents the flow rate of fuel vapor that is desorbed from the adsorbent by the force of the stream of air led through the air hole and is purged to the intake system, wherein, according to the generated-in-tank vapor flow rate and the total purge flow rate, the computer computes a flowed-from-tank vapor flow rate, which represents the flow rate of fuel vapor that is directly drawn into the purge line from the fuel tank and is purged to the intake system, and wherein the computer computes the sum of the air-layer vapor flow rate, the desorbed-from-adsorbent vapor flow rate, and the flowed-from-tank vapor flow rate, and sets the sum as the total vapor flow rate.

7. The apparatus according to claim 3, wherein, based on the stored-in-air-layer vapor amount and the total purge flow rate, the computer computes an air-layer purge flow rate, which represents the flow rate of gas containing fuel vapor that is directly drawn into the purge line from the air layer and is purged to the intake system, and wherein, according to the air-layer purge flow rate and the stored-in-air-layer vapor amount, the computer computes the air-layer vapor flow rate.

8. The apparatus according to claim 7, wherein, based on the stored-in-air-layer vapor amount, the computer computes the maximum value of the air-layer purge flow rate permitted during purging of fuel vapor, wherein, based on comparison between the maximum value and the total purge flow rate, the computer computes the air-layer purge flow rate.

9. The apparatus according to claim 3, the computer computes an inside-adsorbent air flow rate, which represents the flow rate of air introduced through the air hole during purging of fuel vapor, wherein, according to the inside-adsorbent air flow rate and the stored-in-adsorbent vapor amount, the computer computes the desorbed-from-adsorbent vapor flow rate.

10. The apparatus according to claim 9, wherein, according to the stored-in-adsorbent vapor amount, the computer computes a desorbed-from-adsorbent vapor density, which represents the content of fuel vapor in gas that is drawn into the purge line from the air hole through the adsorbent during purging of fuel vapor, and wherein the computer computes the product of the desorbed-from-adsorbent vapor density and the inside-adsorbent air flow rate and sets the computed product as the desorbed-from-adsorbent vapor flow rate.

11. The apparatus according to claim 9, wherein the computer computes the inside-adsorbent air flow rate based on the stored-in-air-layer vapor amount and the total purge flow rate.

12. The apparatus according to claim 7, wherein, based on the stored-in-air-layer vapor amount, the computer computes the maximum value of the air-layer purge flow rate permitted during purging of fuel vapor, wherein, based on comparison between the maximum value and the total purge flow rate, the computer computes the inside-adsorbent air flow rate, which represents the flow rate of air that is introduced through the air hole during purging of fuel vapor, and wherein, according to the inside-adsorbent air flow rate and the stored-in-adsorbent vapor amount, the computer computes the desorbed-from-adsorbent vapor flow rate.

13. The apparatus according to claim 2, wherein the computer periodically updates the value of the stored-in-air-layer vapor amount and the value of the stored-in-adsorbent vapor amount according to the purging condition of fuel vapor.

14. The apparatus according to claim 13, wherein the computer computes the rate of movement of fuel vapor exchanged between the air layer and the adsorbent, and wherein the computer periodically updates the value of the stored-in-air-layer vapor amount and the value of the stored-in-adsorbent vapor amount according to the rate of movement.

15. The apparatus according to claim 14, wherein the computer computes the rate of movement based on the current value of the stored-in-air-layer vapor amount and the current value of the stored-in-adsorbent vapor amount.

16. The apparatus according to claim 15, wherein the computer computes the adsorption speed of fuel vapor to the adsorbent from the air layer, wherein the adsorption speed is proportional to the current value of the stored-in-air-layer vapor amount and to the non-adsorbed amount of fuel vapor in the adsorbent, and wherein the computer computes the rate of movement based on the adsorption speed.

17. The apparatus according to claim 15, wherein the computer computes a natural desorption speed, which represents the moving speed of fuel vapor that is naturally desorbed from the adsorbent to the air layer without depending the force of the stream of air led through the air hole, wherein the natural desorption speed is proportional to the current value of the stored-in-adsorbent vapor amount, and wherein the computer computes the rate of movement based on the natural desorption speed.

18. The apparatus according to claim 6, wherein the computer computes the rate of movement of fuel vapor exchanged between the air layer and the adsorbent, and wherein the computer periodically updates the value of the stored-in-air-layer vapor amount according to the rate of movement, the generated-in-tank vapor flow rate, and the air-layer vapor flow rate.

19. The apparatus according to claim 6, wherein the computer computes the rate of movement of fuel vapor exchanged between the air layer and the adsorbent, and wherein the computer periodically updates the value of the stored-in-adsorbent vapor amount according to the rate of movement and the desorbed-from-adsorbent vapor flow rate.

20. The apparatus according to claim 13, wherein the computer computes a correction value for the feedback correction of the fuel supply amount based on a deviation of the actual air-fuel ratio from the target air-fuel ratio, wherein, based on a change in the feedback correction value that correspond to a changes in the total purge flow rate, the computer computes a provisional value of the total vapor flow rate, and wherein the computer computes an initial value of the stored-in-air-layer vapor amount and an initial value of the stored-in-adsorbent vapor amount based on a change in the provisional value of the total vapor flow rate when the total purge flow rate is gradually increased from zero.

21. The apparatus according to claim 4, wherein the computer computes a correction value for the feedback correction of the fuel supply amount based on a deviation of the actual air-fuel ratio from the target air-fuel ratio, wherein, based on a change in the feedback correction value that corresponds to a change in the total purge flow rate, the computer computes a provisional value of the total vapor flow rate, wherein the computer computes an initial value of the stored-in-air-layer vapor amount, an initial value of the stored-in-adsorbent vapor amount, and an initial value of the generated-in-tank vapor flow rate based on a change in the provisional value of the total vapor flow rate when the total purge flow rate is gradually increased from zero, and wherein the computer periodically updates the value of the stored-in-air-layer vapor amount and the value of the stored-in-adsorbent vapor amount according to the purging condition of fuel vapor.

22. The apparatus according to claim 20, wherein the computer computes the initial values according to a change in the density of fuel vapor in gas that is purged from the purge line to the intake system when the total purge flow rate is gradually increased from zero.

23. The apparatus according to claim 22, wherein the computer computes the initial values based on comparison between the value of the density of fuel vapor, which is computed based on the provisional value of the total vapor flow rate, and the value of density of fuel vapor estimated based on the physical model.

24. The apparatus according to claim 2, wherein the computer computes a correction value for the feedback correction of the fuel supply amount based on a deviation of the actual air-fuel ratio from the target air-fuel ratio, wherein, based on a deviation of the feedback correction value from a predetermined reference value during purging of the fuel vapor, the computer corrects at lease one of the value of the stored-in-air-layer vapor amount and the value of the stored-in-adsorbent vapor amount.

25. The apparatus according to claim 24, wherein the computer selects one of the value of the stored-in-air-layer vapor amount and the value of the stored-in-adsorbent vapor amount that needs to be corrected according to the mode of deviation of the feedback correction value, and wherein the computer corrects the selected value.

26. The apparatus according to claim 25, wherein the computer selects and corrects the stored-in-air-layer vapor amount when the feedback correction value is deviated abruptly due to a change of the running state of the engine.

27. The apparatus according to claim 25, wherein the computer selects and corrects the stored-in-adsorbent vapor amount when the feedback correction value is gradually deviated in passage of the time regardless of the running state of the engine.

28. The apparatus according to claim 24, wherein the computer corrects the value of the stored-in-air-layer vapor amount and the value of the stored-in-adsorbent vapor amount based on progressive change values of the feedback correction value, and wherein the progressive change value used for correcting the stored-in-air-layer vapor amount has a greater degree of response property to a change in the feedback correction value than the progressive change value used for correcting the stored-in-adsorbent vapor amount.

29. The apparatus according to claim 24, wherein, when correcting the value of the stored-in-air-layer vapor amount, the computer also corrects the value of the stored-in-adsorbent vapor amount according to the correction amount of the stored-in-air-layer vapor amount.

30. The apparatus according to claim 4, wherein the computer computes a correction value for the feedback correction of the fuel supply amount based on a deviation of the actual air-fuel ratio from the target air-fuel ratio, wherein, based on a deviation of the feedback correction value from a predetermined reference value during purging of the fuel vapor, the computer corrects at lease one of the value of the stored-in-air-layer vapor amount and the value of the stored-in-adsorbent vapor amount, and wherein, when correcting the value of the stored-in-air-layer vapor amount, the computer also corrects the value of the generated-in-tank vapor flow rate according to the correction amount of the stored-in-air-layer vapor amount.

31. The apparatus according to claim 24, wherein, as the amount of air passing through the intake system increases, the computer decreases the degree of correction of the value of the stored-in-air-layer vapor amount and the value of the stored-in-adsorbent vapor amount.

32. The apparatus according to claim 24, wherein, as the total purge flow rate decreases, the computer decreases the degree of correction of the value of the stored-in-air-layer vapor amount and the value of the stored-in-adsorbent vapor amount with respect to a deviation of the feedback correction value.

33. The apparatus according to claim 1, further comprising a purge regulator for regulating the total purge flow rate, wherein the computer uses an estimation logic of the total vapor flow rate for predicting the total vapor flow rate when the total purge flow rate is set as a provisional target value, wherein the computer sets the target value of the total purge flow rate based on the prediction, and wherein the computer controls the purge regulator such that the actual total purge flow rate seeks the target value.

34. The apparatus according to claim 33, wherein the computer sets the target value of the total purge flow rate such that the predicted value of the total vapor flow rate when the total purge flow rate is set to the target value does not exceed a predetermined upper limit value.

35. The apparatus according to claim 34, wherein the computer sets the upper limit value according to the running state of the engine.

36. The apparatus according to claim 33, wherein the computer sets the target value of the total purge flow rate such that the change amount of the total purge flow rate from the current value does not exceed a predetermined value.

37. The apparatus according to claim 33, wherein the computer sets the target value of the total purge flow rate such that the difference between the predicted value of the total vapor flow rate when the total purge flow rate is set to the target value and the current value of the total vapor flow rate does not exceed a predetermined value.

38. The apparatus according to claim 33, wherein the computer sets the target value of the total purge flow rate such that the predicted value of the total vapor flow rate when the total purge flow rate is set to the target value is increased from the current value by an amount that is equal to or less than a predetermined value.

39. The apparatus according to claim 33, wherein the computer sets the target value of the total purge flow rate such that a correction value of the fuel supply amount, which is required according to the predicted value of the total vapor flow rate when the total purge flow rate is set to the target value, is changed from the current value by an amount that is equal to or less than a predetermined value.

40. The apparatus according to claim 39, wherein the correction value of the fuel supply amount is a decrease correction value for decreasing the fuel supply amount according to the total vapor flow rate, wherein the computer sets the target value of the total purge flow rate such that the decrease correction value, which is required according to the predicted value of the total vapor flow rate when the total purge flow rate is set to the target value, is not increased from the current value by an amount that is greater than the predetermined value.

41. The apparatus according to claim 1, further comprising a purge regulating valve, which adjusts the opening degree for changing the cross-sectional area of the purge line, and wherein the computer computes the total purge flow rate based on the inner pressure of the intake system and the opening degree of the purge regulation valve.

42. The apparatus according to claim 41, wherein the computer computes the volumetric flow rate of gas that is purged from the purge line to the intake system based on the inner pressure of the intake system and the opening degree of the purge regulating valve, wherein the computer converts the volumetric flow rate into a mass flow rate according to the estimated total vapor flow rate, and wherein the computer sets the mass flow rate as the total purge flow rate.

43. The apparatus according to claim 41, wherein the computer computes a correction value for the feedback correction of the fuel supply amount based on a deviation of the actual air-fuel ratio from the target air-fuel ratio, wherein, when a target value of the opening degree of the purge regulation valve is less than a predetermined value, the computer executes small-angle processing for the purge regulation valve, and wherein, during the small-angle processing, the computer first fully closes the purge regulation valve and then controls the opening degree of the purge regulation valve according to the degree of a change in the feedback correction value.

44. The apparatus according to claim 43, wherein, during the small-angle processing, the computer computes a provisional value of the total vapor flow rate based on a change in the feedback correction value that corresponds to a change in the total purge flow rate, and wherein the computer corrects the fuel supply amount according to the provisional value of the total vapor flow rate.

45. The apparatus according to claim 43, wherein the computer prohibits the values of the physical status quantities from being changed during the small-angle processing.

46. A method for controlling the air-fuel ratio of air-fuel mixture drawn into a combustion chamber of an engine, wherein a canister is connected to an intake system of the engine through a purge line, wherein the canister includes an adsorbent, an air layer located between the adsorbent and the purge line, and an air hole for introducing air into the canister, wherein the adsorbent adsorbs fuel vapor generated in a fuel tank and permits adsorbed fuel vapor to be desorbed, wherein air introduced into the canister through the air hole flows to the purge line through the adsorbent, and wherein gas containing fuel vapor is purged to the intake system from the canister through the purge line, the method comprising:

performing feedback correction of the amount of fuel supplied to the combustion chamber such that the air-fuel ratio of the air-fuel mixture seeks a target air-fuel ratio;

obtaining a physical status quantity representing the vapor stored state of the air layer;

obtaining a physical status quantity representing the fuel vapor stored state of the adsorbent;

obtaining a physical status quantity representing the vapor generating state in the fuel tank;

estimating a total vapor flow rate, which represents the flow rate of fuel vapor in gas purged to the intake system, according to a total purge flow rate representing the total flow rate of the purged gas by using a physical model related to the fuel vapor behaviors, wherein the physical model is based on the obtained physical status quantities; and correcting the fuel supply amount, which is subjected to the feedback correction, according to the estimated total vapor flow rate.

* * * * *